US006583096B1

(12) United States Patent
Kott et al.

(10) Patent No.: US 6,583,096 B1
(45) **Date of Patent: *Jun. 24, 2003**

(54) LAUNDRY DETERGENTS COMPRISING MODIFIED ALKYLBENZENE SULFONATES

(75) Inventors: Kevin Lee Kott, Cincinnati, OH (US); Jeffrey John Scheibel, Loveland, OH (US); Roland George Severson, Cincinnati, OH (US); Thomas Anthony Cripe, Loveland, OH (US); James Charles Theophile Roger Burckett-St. Laurent, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/807,364

(22) PCT Filed: Oct. 13, 1999

(86) PCT No.: PCT/US99/24031

§ 371 (c)(1),
(2), (4) Date: Apr. 12, 2001

(87) PCT Pub. No.: WO00/23548

PCT Pub. Date: Apr. 27, 2000

Related U.S. Application Data

(60) Provisional application No. 60/104,962, filed on Oct. 20, 1998.

(51) Int. Cl.[7] ..... C11D 17/00

(52) U.S. Cl. ..... 510/357; 510/424; 510/426; 510/428; 510/492

(58) Field of Search ..... 510/267, 352, 510/357, 424, 426, 428, 492

(56) References Cited

U.S. PATENT DOCUMENTS

| | | | |
|---|---|---|---|
| 2,488,382 A | 7/1949 | Lewis | |
| 2,564,072 A | 8/1951 | Lien et al. | |
| 3,196,174 A | 7/1965 | Cohen | |
| 3,238,249 A | 3/1966 | Mirviss et al. | |
| 3,312,745 A | 4/1967 | Habeshaw et al. | |
| 3,341,614 A | 9/1967 | Wirth et al. | |
| 3,355,484 A | 11/1967 | Bloch | |
| 3,442,964 A | 5/1969 | Oldham | |
| 3,442,965 A | 5/1969 | Oldham | |
| 3,492,364 A | 1/1970 | Jones et al. | |
| 3,674,885 A | 7/1972 | Grisinger et al. | |
| 4,301,316 A | 11/1981 | Young | |
| 4,310,317 A | 1/1982 | Nomura et al. | |
| 4,447,664 A | 5/1984 | Murchison et al. | |
| 4,533,651 A | 8/1985 | Masters et al. | |
| 4,587,374 A | 5/1986 | Peters | |
| 4,840,929 A | 6/1989 | Chen et al. | |
| 4,855,527 A | 8/1989 | Page et al. | |
| 4,870,038 A | 9/1989 | Page et al. | |
| 4,959,491 A | 9/1990 | Threlkel | |
| 4,962,256 A | 10/1990 | Le et al. | |
| 4,973,788 A | 11/1990 | Lin et al. | |
| 4,990,718 A | 2/1991 | Pelrine | |
| 4,996,386 A | 2/1991 | Hamilton, Jr. et al. | |
| 5,026,933 A | 6/1991 | Blain et al. | |
| 5,087,788 A | 2/1992 | Wu | |
| 5,116,794 A | 5/1992 | Skeels et al. | |
| 5,139,759 A | 8/1992 | Cannan et al. | |
| 5,164,169 A | 11/1992 | Rubin | |
| 5,196,625 A | 3/1993 | Threlkel et al. | |
| 5,210,060 A | 5/1993 | Radlowski et al. | |
| 5,227,558 A | 7/1993 | Shamshoum et al. | |
| 5,256,392 A | 10/1993 | Shamshoum | |
| 5,393,718 A | 2/1995 | Skeels et al. | |
| 5,510,306 A | 4/1996 | Murray | |
| 5,522,984 A | 6/1996 | Gajda et al. | |
| 5,565,099 A | 10/1996 | Fauret et al. | |
| 5,625,105 A | 4/1997 | Lin et al. | |
| 5,633,422 A | 5/1997 | Murray | |
| 5,648,484 A | 7/1997 | Wu | |
| 5,648,485 A | 7/1997 | Dolphin et al. | |
| 5,744,673 A | 4/1998 | Skeels et al. | |
| 5,777,187 A | 7/1998 | Knifton et al. | |
| 5,811,623 A | 9/1998 | Ryu et al. | |
| 6,306,817 B1 * | 10/2001 | Kott et al. | 510/535 |

FOREIGN PATENT DOCUMENTS

| | | |
|---|---|---|
| EP | 364012 A1 | 4/1990 |
| EP | 466558 | 1/1992 |
| EP | 469940 A1 | 5/1992 |
| FR | 2697246 | 4/1994 |
| SU | 793972 | 1/1981 |

OTHER PUBLICATIONS

"Surfactant Science", vol. 40, Chapter 6, Marcel Dekker, NY 1992.

"Surfactant Science", vol. 40, "Analysis of Surfactants" pp. 230–231, Marcel Dekker, NY 1992.

"Surfactant Science", vol. 56, Chapter 2 Alkylarylsurlfonates: History, Manufacture, Analysis and Environmental Properties, pp. 39–108, Marcel Dekker, NY 1996.

"Surfactant Science", vol. 73, Chapter 7, Marcel Dekker, NY 1992.

"Surfactant Science", vol. 73, "Anionic Surfactants" p. 272 Marcel Dekker, NY 1992.

* cited by examiner

*Primary Examiner*—Necholus Ogden
(74) *Attorney, Agent, or Firm*—C. Brant Cook; Frank Taffy; Kim W. Zerby

(57) ABSTRACT

Modified alkylbenzene sulfonate surfactant mixtures comprise a mixture of specific branched and non-branched alkylbenzene sulfonate compounds, and are further characterised by a 2/3-phenyl index of 160–275. Detergent and cleaning products containing these mixtures are also claimed.

20 Claims, No Drawings

LAUNDRY DETERGENTS COMPRISING MODIFIED ALKYLBENZENE SULFONATES

This application claims the benefit of Provisional application Ser. No. 60/104,962, filed Oct. 20, 1998.

FIELD OF THE INVENTION

The present invention relates to particular types of alkylbenzene sulfonate surfactant mixtures containing branching and adapted for laundry and cleaning product use by controlling compositional parameters, especially a 2/3-phenyl index and a 2-methyl-2-phenyl index, as well as to improved detergent and cleaning products containing these surfactant mixtures, to alkylbenzene precursors for the surfactant mixtures, and to methods of making the precursors as well as the surfactant mixtures. The present compositions are especially useful for fabric laundering.

BACKGROUND OF THE INVENTION

Historically, highly branched alkylbenzene sulfonate surfactants, such as those based on tetrapropylene, known as "ABS" or "TPBS", were used in detergents. However, these were found to be very poorly biodegradable. A long period followed of improving manufacturing processes for alkylbenzene sulfonates, making them as linear as practically possible, hence the acronym "LAS". The overwhelming part of a large art of linear alkylbenzene sulfonate surfactant manufacture is directed to this objective. All relevant large-scale commercial alkylbenzene sulfonate processes in use today are directed to linear alkylbenzene sulfonates. However, linear alkylbenzene sulfonates are not without limitations, for example, they would be more desirable if improved for hard water cleaning and/or cold water cleaning properties. They can often fail to produce good cleaning results, for example when formulated with nonphosphate builders and/or when used in hard water areas.

As a result of the limitations of the alkylbenzene sulfonates, consumer cleaning formulations have often needed to include a higher level of cosurfactants, builders, and other additives than would have been needed given a superior alkylbenzene sulfonate.

The art of alkylbenzene sulfonate detergents is replete with references which teach both for and against almost every aspect of these compositions. Moreover, there are believed to be erroneous teachings and technical misconceptions about the mechanism of LAS operation under in-use conditions, particularly in the area of hardness tolerance. The volume of such references debases the art as a whole and makes it difficult to select the useful teachings from the useless without repeated experimentation. To further understand the state of the art, it should be appreciated that there has been not only a lack of clarity on which way to go to fix the unresolved problems of linear LAS, but also a range of misconceptions, not only in the understanding of biodegradation but also in basic mechanisms of operation of LAS in presence of hardness.

Also, while the currently commercial, essentially linear alkylbenzene sulfonate surfactants are relatively simple compositions to define and analyze, compositions containing both branched and linear alkylbenzene sulfonate surfactants are complex. In general such compositions can be highly varied, containing one or more different kinds of branching in any of a number of positions on the aliphatic chain. A very large number, e.g., hundreds, of distinct chemical species are possible in such mixtures. Accordingly there is an onerous burden of experimentation if it is desired to improve such compositions so that they can clean fabrics better in detergent compositions while at the same time remaining biodegradable. The formulator's knowledge is key to guiding this effort.

Yet another currently unresolved problem in alkylbenzene sulfonate manufacture is to make more effective use of current LAB feedstocks. It would be highly desirable, both from a performance point of view and from an economic point of view, to better utilize certain desirable types of branched hydrocarbons.

Accordingly there is a substantial unmet need for further improvements in alkylbenzene sulfonate surfactant mixtures, especially with respect to those offering one or more of the advantages of superior cleaning, hardness tolerance, satisfactory biodegradability, and cost.

BACKGROUND ART

U.S. Pat. Nos. 5,659,099, 5,393,718, 5,256,392, 5,227,558, 5,139,759, 5,164,169, 5,116,794, 4,840,929, 5,744,673, 5,522,984, 5,811,623, 5,777,187, WO 9,729,064, WO 9,747573, WO 9,729,063, U.S. Pat. Nos. 5,026,933; 4,990,718; 4,301,316; 4,301,317; 4,855,527; 4,870,038; 2,477,382; EP 466,558, Jan. 15, 1992; EP 469,940, Feb. 5, 1992; FR 2,697,246, Apr. 29, 1994; SU 793,972, Jan. 7, 1981; U.S. Pat. Nos. 2,564,072; 3,196,174; 3,238,249; 3,355,484; 3,442,964; 3,492,364; 4,959,491; WO 88/07030, Sep. 25, 1990; U.S. Pat. Nos. 4,962,256, 5,196,624; 5,196,625; EP 364,012 B, Feb. 15, 1990; U.S. Pat. Nos. 3,312,745; 3,341,614; 3,442,965; 3,674,885; 4,447,664; 4,533,651; 4,587,374; 4,996,386; 5,210,060; 5,510,306; WO 95/17961, Jul. 6, 1995; WO 95/18084; U.S. Pat. Nos. 5,510,306; 5,087,788; 4,301,316; 4,301,317; 4,855,527; 4,870,038; 5,026,933; 5,625,105 and 4,973,788. The manufacture of alkylbenzene sulfonate surfactants has recently been reviewed. See Vol 56 in "Surfactant Science" series, Marcel Dekker, New York, 1996, including in particular Chapter 2 entitled "Alkylaryl-sulfonates: History, Manufacture, Analysis and Environmental Properties", pages 39–108 which includes 297 literature references. Surfactant-related analytical methods are described in "Surfactant Science" series, Vol 73, Marcel Dekker, New York, 1998 and "Surfactant Science" series, Vol 40, Marcel Dekker, New York, 1992. Documents referenced herein are incorporated in their entirety. See also copending U.S. Patent applications No. 60/053,319 filed on Jul. 21st, 1997, No. 60/053,318, filed on Jul. 21st, 1997, No. 60/053,321, filed on Jul. 21st, 1997, No. 60/053,209, filed on Jul. 21st, 1997, No. 60/053,328, filed on Jul. 21st, 1997, No. 60/053,186, filed on Jul. 21st, 1997 and the art cited therein.

SUMMARY OF THE INVENTION

It has now surprisingly been found that there exist certain alkylbenzene sulfonate surfactant mixtures, hereinafter "modified alkylbenzene sulfonate surfactant mixtures" which offer one or more, and even several of the above-outlined advantages. The discovery of these mixtures solves important problems of the kind described in the background.

Thus in accordance with a first embodiment of the present invention, a novel modified alkylbenzene sulfonate surfactant mixture is provided. This novel surfactant mixture comprises, preferably consists essentially of:

(a) from about 15% to about 99%, preferably from about 15% to about 60%, more preferably from about 20% to about 40%, by weight of a mixture of branched alkylbenzene sulfonates having formula (I):

(I)

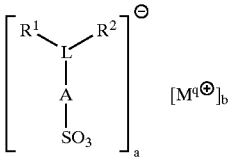

wherein L is an acyclic aliphatic moiety consisting of carbon and hydrogen, the L having two methyl termini and the L having no substituents other than A, $R^1$ and $R^2$; and wherein the mixture of branched alkylbenzene sulfonates contains two or more, preferably at least three, optionally more of the branched alkylbenzene sulfonates differing in molecular weight of the anion of the formula (I) and wherein the mixture of branched alkylbenzene sulfonates has a sum of carbon atoms in $R^1$, L and $R^2$ of from 9 to 15, preferably from 10 to 14; an average aliphatic carbon content, i.e., based on $R^1$, L and $R^2$ and excluding A, of from about 10.0 to about 14.0, preferably from about 11.0 to about 13.0, more preferably from about 11.5 to about 12.5, carbon atoms; M is a cation or cation mixture, preferably selected from H, Na, K, Ca, Mg and mixtures thereof, more preferably selected from H, Na, K and mixtures thereof, more preferably still, selected from H, Na, and mixtures thereof having a valence q, typically from 1 to 2, preferably 1; a and b are integers selected such that the branched alkylbenzene sulfonates are electroneutral, a is typically from 1 to 2, preferably 1, b is 1; $R^1$ is $C_1$–$C_3$ alkyl, preferably $C_1$–$C_2$ alkyl, more preferably methyl; $R^2$ is selected from H and $C_1$–$C_3$ alkyl, preferably H and $C_1$–$C_2$ alkyl, more preferably H and methyl, more preferably H and methyl provided that in at least about 0.5, more preferably 0.7, more preferably 0.9 to 1.0 mole fraction of the branched alkylbenzene sulfonates, $R^2$ is H; A is a benzene moiety, typically A is the moiety —$C_6H_4$—, with the $SO_3$ moiety of Formula (1) in para-position to the L moiety, though in some proportion, usually no more than about 5%, preferably from 0 to 5% by weight, the $SO_3$ moiety is ortho- to L; and (b) from about 1% to about 85%, preferably from about 40% to about 85%, more preferably from about 60% to about 80%, by weight of a mixture of nonbranched alkylbenzene sulfonates having formula (II):

(II)

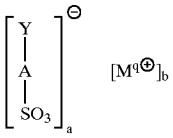

wherein a, b, M, A and q are as defined hereinbefore and Y is an unsubstituted linear aliphatic moiety consisting of carbon and hydrogen having two methyl termini, and wherein the Y has a sum of carbon atoms of from 9 to 15, preferably from 10 to 14, and the Y has an average aliphatic carbon content of from about 10.0 to about 14.0, preferably from about 11.0 to about 13.0, more preferably 11.5 to 12.5 carbon atoms; and wherein the modified alkylbenzene sulfonate surfactant mixture is further characterized by a 2/3-phenyl index of from about 160 to about 275, preferably from about 170 to about 265, more preferably from about 180 to about 255; and also preferably wherein the modified alkylbenzene sulfonate surfactant mixture has a 2-methyl-2-phenyl index of less than about 0.3, preferably less than about 0.2, more preferably less than about 0.1, more preferably still, from 0 to 0.05.

In accordance with a second embodiment of present invention, a novel surfactant mixture is provided. This novel surfactant mixture comprises, preferably consisting essentially of the product of a process comprising the steps of:

(I) alkylating benzene with an alkylating mixture in the presence of a zeolite beta catalyst;

(II) sulfonating the product of (I); and, optionally, but very preferably (III) neutralizing the product of (II);

wherein the alkylating mixture comprises:

(a) from about 1% to about 99.9%, by weight of branched $C_9$–$C_{20}$, preferably $C_9$–$C_{15}$, more preferably $C_{10}$–$C_{14}$ monoolefins, the branched monoolefins having structures identical with those of the branched monoolefins formed by dehydrogenating branched paraffins of formula $R^1LR^2$ wherein L is an acyclic aliphatic moiety consisting of carbon and hydrogen and containing two terminal methyls; $R^1$ is $C_1$ to $C_3$ alkyl; and $R^2$ is selected from H and $C_1$ to $C_3$ alkyl; and (b) from about 0.1% to about 85%, by weight of $C_9$–$C_{20}$, preferably $C_9$–$C_{15}$, more preferably $C_{10}$–$C_{14}$ linear aliphatic olefins;

wherein the alkylating mixture contains the branched $C_9$–$C_{20}$ monoolefins having at least two different carbon numbers in the $C_9$–$C_{20}$ range, and has a mean carbon content of from about 9.0 to about 15.0, preferably from about 10.0 to about 14.0, more preferably from about 1.0 to about 13.0, more preferably still from about 11.5 to about 12.5 carbon atoms; and wherein the components (a) and (b) are at a weight ratio of at least about 15:85.

In accordance with a third embodiment of present invention, a novel surfactant mixture is provided. This novel surfactant mixture consists essentially of the product of a process comprising the steps, in sequence, of:

(I) alkylating benzene with an alkylating mixture in the presence of a zeolite beta catalyst;

(II) sulfonating the product of (I); and (III) neutralizing the product of (II);

wherein the alkylating mixture comprises:

(a) from about 1% to about 99.9%, by weight of a branched alkylating agent selected from:

(i) $C_9$–$C_{20}$ (preferably $C_9$–$C_{15}$, more preferably $C_{10}$–$C_{14}$) internal monoolefins $R^1LR^2$ wherein L is an acyclic olefinic moiety consisting of carbon and hydrogen and containing two terminal methyls;

(ii) $C_9$–$C_{20}$ (preferably $C_9$–$C_{15}$, more preferably $C_{10}$–$C_{14}$) alpha monoolefins $R^1AR^2$ wherein A is an acyclic alpha-olefinic moiety consisting of carbon and hydrogen and containing one terminal methyl and one terminal olefinic methylene;

(iii) $C_9$–$C_{20}$ (preferably $C_9$–$C_{15}$, more preferably $C_{10}$–$C_{14}$) vinylidene monoolefins $R^1BR^2$ wherein B is an acyclic vinylidene olefin moiety consisting of carbon and hydrogen and containing two terminal methyls and one internal olefinic methylene;

(iv) $C_9$–$C_{20}$ (preferably $C_9$–$C_{15}$, more preferably $C_{10}$–$C_{14}$) primary alcohols $R^1QR^2$ wherein Q is an acyclic aliphatic primary terminal alcohol moiety consisting of carbon, hydrogen and oxygen and containing one terminal methyl;

(v) $C_9$–$C_{20}$ (preferably $C_9$–$C_{15}$, more preferably $C_{10}$–$C_{14}$) primary alcohols $R^1ZR^2$ wherein Z is an acyclic aliphatic primary nonterminal alcohol moiety consisting of carbon, hydrogen and oxygen and containing two terminal methyls; and (vi) mixtures thereof;

wherein in any of (i)–(vi), the $R^1$ is $C_1$ to $C_3$ alkyl and the $R^2$ is selected from H and $C_1$ to $C_3$ alkyl; and (b) from about 0.1% to about 85%, by weight of $C_9$–$C_{20}$ (preferably $C_9$–$C_{15}$, more preferably $C_{10}$–$C_{14}$) linear alkylating agent selected from $C_9$–$C_{20}$ (preferably $C_9$–$C_{15}$ more preferably $C_{10}$–$C_{14}$) linear aliphatic olefins, $C_9$–$C_{20}$ (preferably $C_9$–$C_{15}$, more preferably $C_{10}$–$C_{14}$) linear aliphatic alcohols and mixtures thereof;

wherein the alkylating mixture contains the branched alkylating agents having at least two different carbon numbers in the $C_9$–$C_{20}$ (preferably $C_9$–$C_{15}$, more preferably $C_{10}$–$C_{14}$) range, and has a mean carbon content of from about 9.0 to about 15.0 carbon atoms (preferably from about 10.0 to about 14.0, more preferably from about 11.0 to about 13.0, more preferably still from about 11.5 to about 12.5); and wherein the components (a) and (b) are at a weight ratio of at least about 15:85 (preferably having linear component (b) in excess of branched component (a), for example 51% or more by weight of (b) and 49% or less of (a), more preferably 55% to 85% by weight of (b) and 15% to 45% of (a), more preferably still 60% to 80% by weight of (b) and 20% to 40% of (a) wherein these percentages by weight exclude any other materials, for example diluent hydrocarbons, that may be present in the process).

In accordance with a fourth embodiment of present invention, a novel detergent composition is provided. This novel detergent composition comprising, preferably consisting essentially of:

(a) from about 0.1% to about 50%, preferably from about 0.5% to about 40%, more preferably from about 1% to about 35%, by weight of a linear alkylbenzene sulfonate surfactant mixture having a 2/3-phenyl index of from about 160 to about 275, preferably from about 170 to about 265, more preferably from about 180 to about255;

(b) from about 0.1% to about 99.9%, preferably from about 5% to about 98%, more preferably from about 50% to about 95%), by weight of conventional cleaning adjuncts other than surfactants; and (c) from 0% to about 50%, in some preferred embodiments, 0%, and in others preferably from about 0.1% to about 30%, more typically from about 0.2% to about 10%, by weight of a surfactant other than the linear alkylbenzene sulfonate surfactant mixture;

provided that when the detergent composition comprises any other alkylbenzene sulfonate than the alkylbenzene sulfonate of the linear alkylbenzene sulfonate surfactant mixture, the linear alkylbenzene sulfonate surfactant mixture and the other alkylbenzene sulfonate, as a mixture, have an overall 2/3-phenyl index of from about 160 to about 275, preferably from about 170 to about 265, more preferably from about 180 to about 255.

The present invention is also directed to detergent compositions comprising the surfactant mixtures of embodiments one, two and three as well as conventional detergent adjuncts. The present invention also is directed to methods of cleaning using these compositions.

The preferred cleaning composition embodiments also contain specific cleaning additives, defined hereafter.

All percentages, ratios and proportions herein are by weight, unless otherwise specified. All temperatures are in degrees Celsius (° C.) unless otherwise specified. All documents cited are in relevant part, incorporated herein by reference.

DETAILED DESCRIPTION OF THE INVENTION

The present invention relates to novel surfactant compositions. It also relates to novel cleaning compositions containing the novel surfactant system and methods of cleaning using the cleaning compositions.

In accordance with the first embodiment one preferred surfactant mixture comprises: a mixture of the branched alkylbenzene sulfonates and nonbranched alkylbenzene sulfonates, wherein the 2-methyl-2-phenyl index of the modified alkylbenzene sulfonate surfactant mixture is less than about 0.05, and wherein in the mixture of branched and nonbranched alkylbenzene sulfonates, the average aliphatic carbon content is from about 11.5 to about 12.5 carbon atoms; the $R^1$ is methyl; the $R^2$ is selected from H and methyl provided that in at least about 0.7 mole fraction of the branched alkylbenzene sulfonates $R^2$ is H; and wherein the sum of carbon atoms in $R^1$, L and $R^2$ is from 10 to 14; and further wherein in the mixture of nonbranched alkylbenzene sulfonates, the Y has a sum of carbon atoms of from 10 to 14 carbon atoms, the average aliphatic carbon content of the nonbranched alkylbenzene sulfonates is from about 11.5 to about 12.5 carbon atoms, and the M is a monovalent cation or cation mixture selected from H, Na and mixtures thereof In accordance with the second embodiment one preferred alkylating mixture comprises:

(a) from about 0.5% to about 47.5%, by weight of said branched alkylating agent selected from:

(i) $C_9$–$C_{14}$ internal monoolefins $R^1LR^2$ wherein L is an acyclic olefinic moiety consisting of carbon and hydrogen and containing two terminal methyls;

(ii) $C_9$–$C_{14}$ alpha monoolefins $R^1AR^2$ wherein A is an acyclic alpha-olefinic moiety consisting of carbon and hydrogen and containing one terminal methyl and one terminal olefinic methylene; and (iii) mixtures thereof;

wherein in any of (i)–(iii), said $R^1$ is methyl, and said $R^2$ is H or methyl provided that in at least about 0.7 mole fraction of the total of said monoolefins, $R^2$ is H; and (b) from about 0.1% to about 25%, by weight of $C_9$–$C_{14}$ linear aliphatic olefins; and (c) from about 50% to about 98.9%, by weight of carrier materials selected from paraffins and inert nonparaffinic solvents;

wherein said alkylating mixture contains said branched alkylating agents having at least two different carbon numbers in said $C_9$–$C_{14}$ range, and has a mean carbon content of from about 11.5 to about 12.5 carbon atoms; and wherein said components (a) and (b) are at a weight ratio of from about 20:80 to about 49:51.

Preferably the surfactant mixtures according to the present invention also have a 2-methyl-2-phenyl index of less than about 0.3, more preferably less than about 0.2, even more preferably less than about 0.1, even more preferably still, from 0 to 0.05.

Definitions

Methyl termini The terms "methyl termini" and/or "terminal methyl" mean the carbon atoms which are the terminal carbon atoms in alkyl moieties, that is L, and/or Y of formula (I) and formula (II) respectively are always bonded to three hydrogen atoms. That is, they will form a $CH_3$— group. To better explain this, the structure below shows the two terminal methyl groups in an alkylbenzene sulfonate.

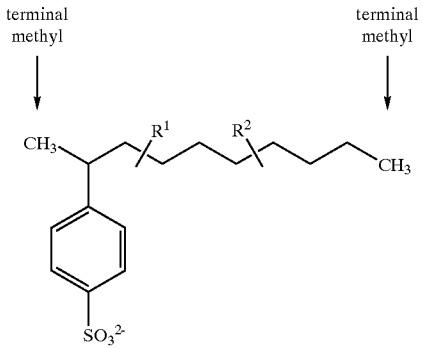

The term "AB" herein when used without further qualification is an abbreviation for "alkylbenzene" of the so-called "hard" or nonbiodegradable type which on sulfonation forms "ABS". The term "LAB" herein is an abbreviation for "linear alkylbenzene" of the current commercial, more biodegradable type, which on sulfonation forms linear alkylbenzene sulfonate, or "LAS". The term "MLAS" herein is an abbreviation for the modified alkylbenzene sulfonate mixtures of the invention.

Impurities: The surfactant mixtures herein are preferably substantially free from impurities selected from tri-branched impurities, dialkyl tetralin impurities and mixtures thereof. By "substantially free" it is meant that the amounts of such impurities are insufficient to contribute positively or negatively to the cleaning effectiveness of the composition. Typically there is less than about 5%, preferably less than about 1%, more preferably about 0.1% or less of the impurity, that is typically no one of the impurities is practically detectable.

Illustrative Structures

The better to illustrate the possible complexity of modified alkylbenzene sulfonate surfactant mixtures of the invention and the resulting detergent compositions, structures (a) to (v) below are illustrative of some of the many preferred compounds of formula (I). These are only a few of hundreds of possible preferred structures that make up the bulk of the composition, and should not be taken as limiting of the invention.

(a)

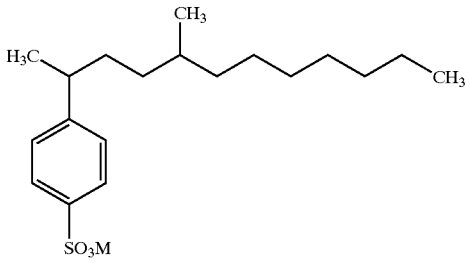

-continued (b)

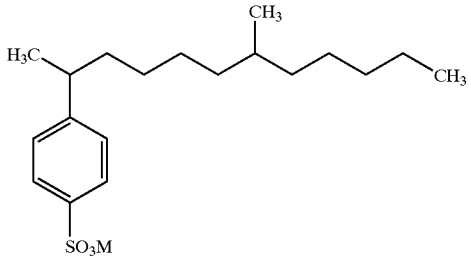

(c)

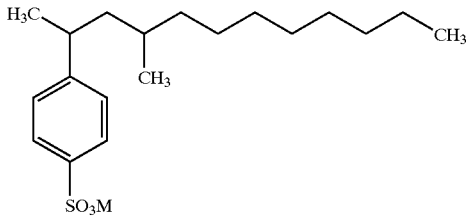

(d)

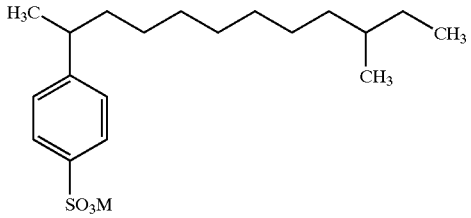

(e)

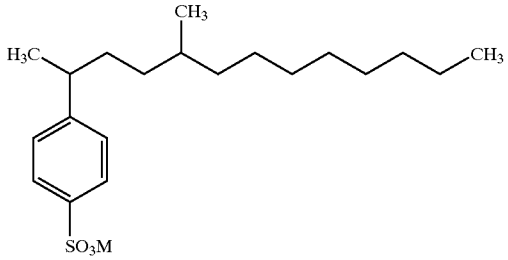

(f)

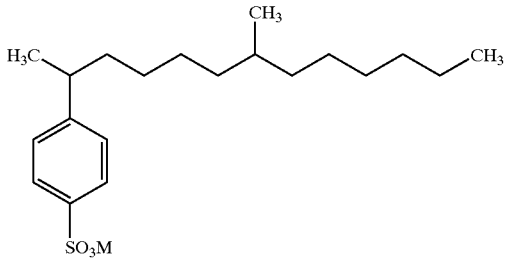

-continued
(g)
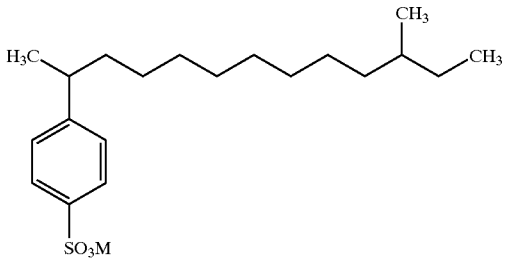
(h)
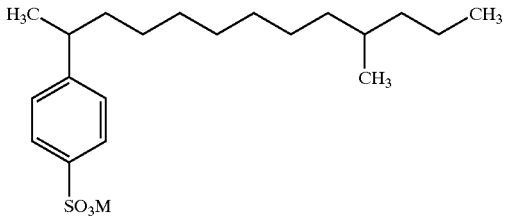
(i)
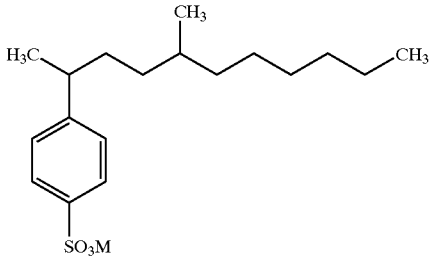
(j)
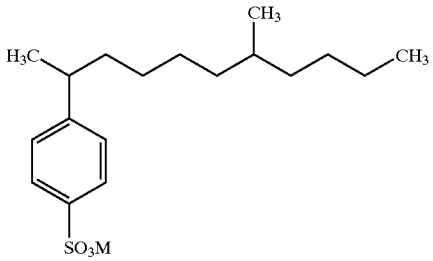
(k)
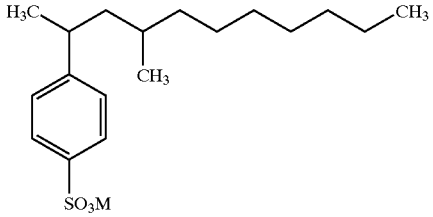
(l)
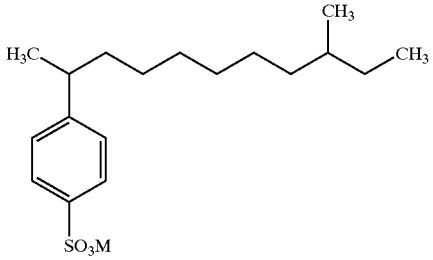
-continued
(m)
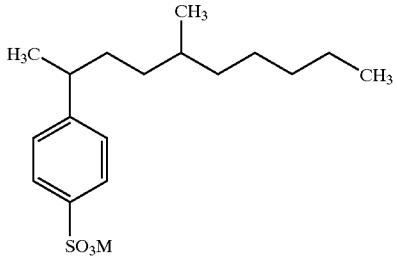
(n)
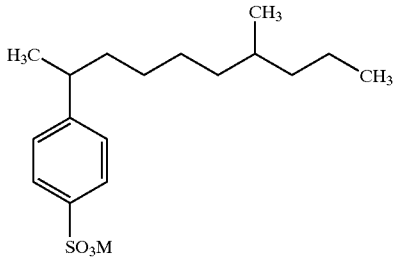
(o)
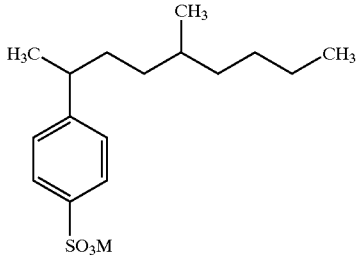
(p)
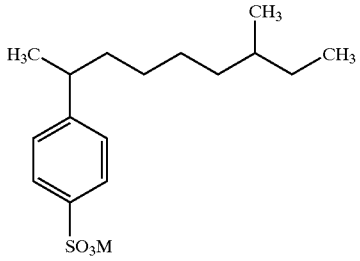
(q)
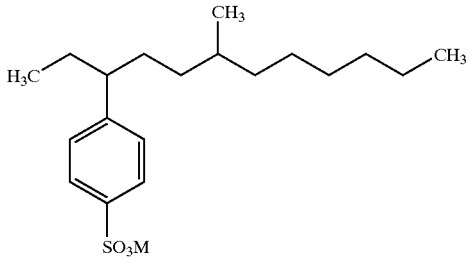
(r)
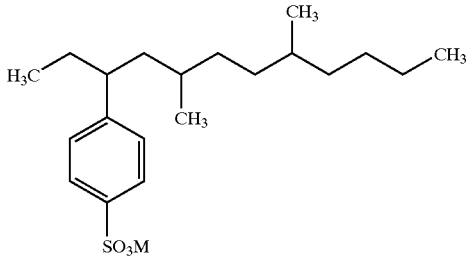

-continued (s)

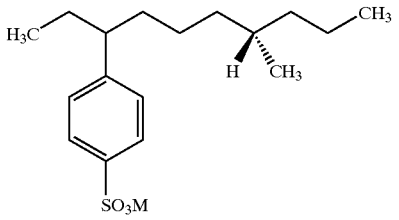

(t)

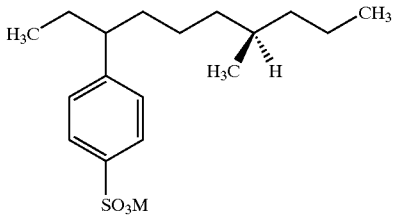

(u)

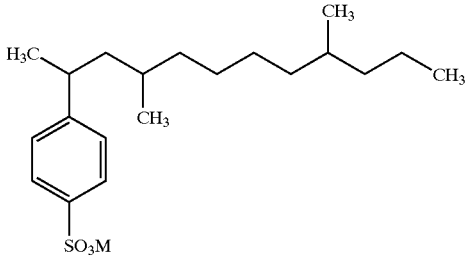

(v)

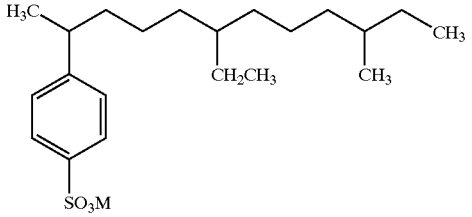

Structures (w) and (x) nonlimitingly illustrate less preferred compounds of Formula (I) which can be present, at lower levels than the above-illustrated preferred types of stuctures, in the modified alkylbenzene sulfonate surfactant mixtures of the invention and the resulting detergent compositions.

(w)

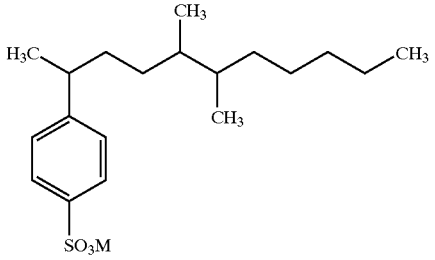

-continued (x)

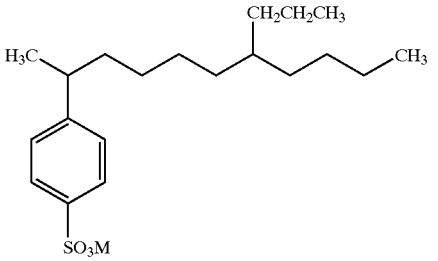

Structures (y), (z), and (aa) nonlimitingly illustrate compounds broadly within Formula (I) that are not preferred but which can be present in the modified alkylbenzene sulfonate surfactant mixtures of the invention and the resulting detergent compositions.

(y)

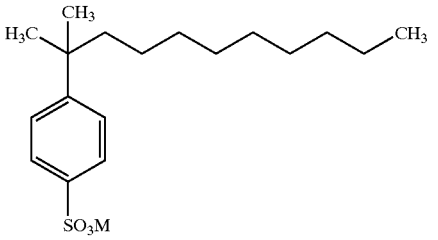

(z)

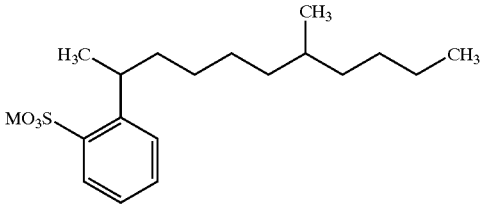

(aa)

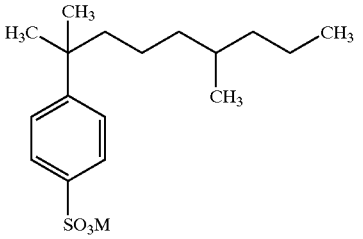

(bb)

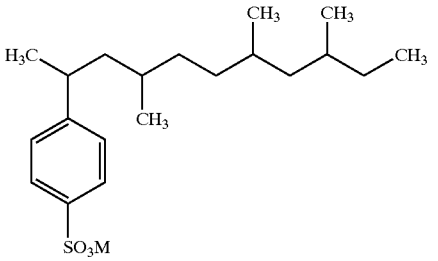

Structure (bb) is illustrative of a tri-branched structure not within Formula (I), but that can be present as an impurity.

Preferably the branched alkylbenzene sulfonate is the product of sulfonating a branched alkylbenzene, wherein the branched alkylbenzene is produced by alkylating benzene with a branched olefin over an zeolite beta catalyst which may be fluoridated or non-fluoridated, more preferably the zeolite beta catalyst is an acidic zeolite beta catalyst. The preferred acidic zeolite beta catalysts are HF-treated calcined zeolite beta catalysts.

In outline, modified alkylbenzene sulfonate surfactant mixtures herein can be made by the steps of:

(I) alkylating benzene with an alkylating mixture;

(II) sulfonating the product of (I); and (optionally but very preferably)

(III) neutralizing the product of (II).

Provided that suitable alkylation catalysts and process conditions as taught herein are used, the product of step (I) is a modified alkylbenzene mixture in accordance with the invention. Provided that sulfonation is conducted under conditions generally known and reapplicable from LAS manufacture, see for example the literature references cited herein, the product of step (II) is a modified alkylbenzene sulfonic acid mixture in accordance with the invention. Provided that neutralization step (III) is conducted as generally taught herein, the product of step (III) is a modified alkylbenzene sulfonate surfactant mixture in accordance with the invention. Since neutralization can be incomplete, mixtures of the acid and neutralized forms of the present modified alkylbenzene sulfonate systems in all proportions, e.g., from about 1000:1 to 1:1000 by weight, are also part of the present invention. Overall, the greatest criticalities are in step (I).

Thus it is further preferred that in step (I) the alkylation is performed at a temperature of from about 125° C. to about 230° C., preferably from about 175° C. to about 215° C. and at a pressure of from about 50 psig to about 1000 psig, preferably from about 100 psig to about 250 psig. Time for this alkylation reaction can vary, however it is further preferred that the time for this alkylation be from about 0.01 hour to about 18 hours, more preferably, as rapidly as possible, more typically from about 0.1 hour to about 5 hours, or from about 0.1 hour to about 3 hours.

In general it is found preferable in step (I) to couple together the use of relatively low temperatures (e.g., 175° C. to about 215° C.) with reaction times of medium duration (1 hour to about 8 hours) in the above-indicated ranges.

Moreover, it is contemplated that the alkylation "step" (I) herein can be "staged" so that two or more reactors operating under different conditions in the defined ranges may be useful. By operating a plurality of such reactors, it is possible to allow for material with less preferred 2-methyl-2-phenyl index to be initially formed and, surprisingly, to convert such material into material with a more preferred 2-methyl-2-phenyl index.

Thus a surprising discovery as part of the present invention is that one can attain low levels of quaternary alkylbenzenes in zeolite beta catalyzed reactions of benzene with branched olefins, as characterized by a 2-methyl-2-phenyl index of less than 0.1.

Alkylation Catalyst

The present invention uses a particularly defined alkylation catalyst. Such catalyst comprises a moderate acidity, medium-pore zeolite defined in detail hereinafter. A particularly preferred alkylation catalyst comprises at least partially dealuminized acidic nonfluoridated or at least partially dealuminized acidic fluoridated zeolite beta.

Numerous alkylation catalysts are readily determined to be unsuitable. Unsuitable alkylation catalysts include the DETAL® process catalysts, aluminum chloride, HF, and many others. Indeed no alkylation catalyst currently used for alkylation in the commercial production of detergent linear alkylbenzenesulfonates is suitable.

In contrast, suitable alkylation catalyst herein is selected from shape-selective moderately acidic alkylation catalysts, preferably zeolitic. More particularly, the zeolite in such catalysts for the alkylation step step I is preferably selected from the group consisting of ZSM-4, ZSM-20, and zeolite beta, more preferably zeolite beta, in at least partially acidic form. More preferably, the zeolite in step I (the alkylation step) is substantially in acid form and is contained in a catalyst pellet comprising a conventional binder and further wherein said catalyst pellet comprises at least about 1%, more preferably at least 5%, more typically from 50% to about 90%, of said zeolite, wherein said zeolite is preferably a zeolite beta. More generally, suitable alkylation catalyst is typically at least partially crystalline, more preferably substantially crystalline not including binders or other materials used to form catalyst pellets, aggregates or composites. Moreover the catalyst is typically at least partially acidic zeolite beta. This catalyst is useful for the alkylation step identified as step I in the claims hereinafter.

The largest pore diameter characterizing the zeolites useful in the present alkylation process may be in the range of 6 Angstrom to 8 Angstrom, such as in zeolite beta. It should be understood that, in any case, the zeolites used as catalysts in the alkylation step of the present process have a major pore dimension intermediate between that of the large pore zeolites, such as the X and Y zeolites, and the relatively smaller pore size zeolites such as mordenite, offretite, HZSM-12 and HZSM-5. Indeed ZSM-5 has been tried and found inoperable in the present invention. The pore size dimensions and crystal structures of certain zeolites are specified in ATLAS OF ZEOLITE STRUCTURE TYPES by W. M. Meier and D. H. Olson, published by the Structure Commission of the International Zeolite Association (1978 and more recent editions) and distributed by Polycrystal Book Service, Pittsburgh, Pa.

The zeolites useful in the alkylation step of the instant process generally have at least 10 percent of the cationic sites thereof occupied by ions other than alkali or alkaline-earth metals. Typical but non-limiting replacing ions include ammonium, hydrogen, rare earth, zinc, copper and aluminum. Of this group, particular preference is accorded ammonium, hydrogen, rare earth or combinations thereof. In a preferred embodiment, the zeolites are converted to the predominantly hydrogen form, generally by replacement of the alkali metal or other ion originally present with hydrogen ion precursors, e.g., ammonium ions. which upon calcination yield the hydrogen form. This exchange is conveniently carried out by contact of the zeolite with an ammonium salt solution, e.g., ammonium chloride, utilizing well known ion exchange techniques. In certain preferred embodiments, the extent of replacement is such as to produce a zeolite material in which at least 50 percent of the cationic sites are occupied by hydrogen ions.

The zeolites may be subjected to various chemical treatments, including alumina extraction (dealumination) and combination with one or more metal components, particularly the metals of Groups IIB, III, IV, VI, VII and VIII. It is also contemplated that the zeolites may, in some instances, desirably be subjected to thermal treatment, including steaming or calcination in air, hydrogen or an inert gas, e.g. nitrogen or helium.

A suitable modifying treatment entails steaming of the zeolite by contact with an atmosphere containing from about 5 to about 100% steam at a temperature of from about 250° C. to 1000° C. Steaming may last for a period of between about 0.25 and about 100 hours and may be conducted at pressures ranging from sub-atmospheric to several hundred atmospheres.

In practicing the desired alkylation step of the instant process, it may be useful to incorporate the above-described intermediate pore size crystalline zeolites in another material, e.g., a binder or matrix resistant to the temperature and other conditions employed in the process. Such matrix materials include synthetic or naturally occurring substances as well as inorganic materials such as clay, silica, and/or metal oxides. Matrix materials can be in the form of gels including mixtures of silica and metal oxides. The latter may be either naturally occurring or in the form of gels or gelatinous precipitates. Naturally occurring clays which can be composited with the zeolite include those of the montmorillonite and kaolin families, which families include the sub-bentonites and the kaolins commonly known as Dixie, McNamee-Georgia and Florida clays or others in which the main mineral constituent is halloysite, kaolinite, dickite, nacrite or anauxite. Such clays can be used in the raw state as originally mined or initially subjected to calcination, acid treatment or chemical modification.

In addition to the foregoing materials, the intermediate pore size zeolites employed herein may be compounded with a porous matrix material, such as alumina, silica-alumina, silica-magnesia, silica-zirconia, silica-thoria, silica-beryllia, and silica-titania, as well as ternary combinations, such as silica-alumina-thoria, silica-alumina-zirconia, silica-alumina-magnesia and silica-magnesia-zirconia. The matrix may be in the form of a cogel. The relative proportions of finely divided zeolite and inorganic oxide gel matrix may vary widely, with the zeolite content ranging from between about 1 to about 99% by weight and more usually in the range of about 5 to about 80% by weight of the composite.

A group of zeolites which includes some useful for the alkylation step herein have a silica:alumina ratio of at least 10:1, preferably at least 20:1. The silica:alumina ratios referred to in this specification are the structural or framework ratios, that is, the ratio for the $SiO_4$ to the $AlO_4$ tetrahedra. This ratio may vary from the silica:alumina ratio determined by various physical and chemical methods. For example, a gross chemical analysis may include aluminum which is present in the form of cations associated with the acidic sites on the zeolite, thereby giving a low silica:alumina ratio. Similarly, if the ratio is determined by thermogravimetric analysis (TGA) of ammonia desorption, a low ammonia titration may be obtained if cationic aluminum prevents exchange of the ammonium ions onto the acidic sites. These disparities are particularly troublesome when certain treatments such as the dealuminization methods described below which result in the presence of ionic aluminum free of the zeolite structure are employed. Due care should therefore be taken to ensure that the framework silica:alumina ratio is correctly determined.

When the zeolites have been prepared in the presence of organic cations they are catalytically inactive, possibly because the intracrystalline free space is occupied by organic cations from the forming solution. They may be activated by heating in an inert atmosphere at 540° C. for one hour, for example, followed by base exchange with ammonium salts followed by calcination at 540° C. in air. The presence of organic cations in the forming solution may not be absolutely essential to the formation of the zeolite; but it does appear to favor the formation of this special type of zeolite. Some natural zeolites may sometimes be converted to zeolites of the desired type by various activation procedures and other treatments such as base exchange, steaming, alumina extraction and calcination. The zeolites preferably have a crystal framework density, in the dry hydrogen form, not substantially below about 1.6 g.cm-3. The dry density for known structures may be calculated from the number of silicon plus aluminum atoms per 1000 cubic Angstroms, as given, e.g., on page 19 of the article on Zeolite Structure by W. M. Meier included in "Proceedings of the Conference on Molecular Sieves, London, April 1967", published by the Society of Chemical Industry, London, 1968. Reference is made to this paper for a discussion of the crystal framework density. A further discussion of crystal framework density, together with values for some typical zeolites, is given in U.S. Pat. No. 4,016,218, to which reference is made. When synthesized in the alkali metal form, the zeolite is conveniently converted to the hydrogen form, generally by intermediate formation of the ammonium form as a result of ammonium ion exchange and calcination of the ammonium form to yield the hydrogen form. It has been found that although the hydrogen form of the zeolite catalyzes the reaction successfully, the zeolite may also be partly in the alkali metal form.

Prefered zeolite catalysts include zeolite beta, HZSM-4, HZSM-20 and HZSM-38. Most prefered catalyst is acidic zeolite beta. A zeolite beta suitable for use herein is disclosed in U.S. Pat. No. 3,308,069 to which reference is made for details of this zeolite and its preparation.

Zeolite beta catalysts in the acid form are also commercially available as Zeocat PB/H from Zeochem. Other zeolite beta catalysts suitable for use can be provided by UOP Chemical Catalysts and Zeolyst International.

Most generally, alkylation catalysts may be used herein provided that the alkylation catalyst 1) can accommodate into the smallest pore diameter of said catalyst said branched olefins described herein and 2) selectively alkylate benzene with said branched olefins and/or mixture with nonbranched olefins with sufficient selectivity to provide the 2/3-Ph index values defined herein.

In one preferred mode, a hydrotrope or hydrotrope precursor is added either after step (I). during or after step (II) and prior to step (III) or during or after step (m). The hydrotropes are selected from any suitable hydrotrope, typically a sulfonic acid or sodium sulfonate salt of toluene, cumene, xylene, napthalene or mixtures thereof. The hydrotropes precursors are selected from any suitable, hydrotrope precursor typically toluene, cumene, xylene, napthalene or mixtures thereof.

Sulfonation and Workup or Neutralization (Steps II/III)

Preferably the sulfonating step (II) is performed using a sulfonating agent, preferably selected from the group consisting of sulfuric acid, sulfur trioxide with or without air, chlorosulfonic acid, oleum, and mixtures thereof. Furthermore, it is preferable in step (II) to remove components other than monoalkylbenzene prior to contacting the product of step (I) with sulfonating agent.

In general, sulfonation of the modified alkylbenzenes in the instant process can be accomplished using any of the well-known sulfonation systems, including those described in "Detergent Manufacture Including Zeolite Builders and other New Materials", Ed. Sittig., Noyes Data Corp., 1979, as well as in Vol. 56 in "Surfactant Science" series, Marcel Dekker, New York, 1996, including in particular Chapter 2 entitled "Alkylarylsulfonates: History, Manufacture, Analysis and Environmental Properties", pages 39–108 which includes 297 literature references. This work provides access to a great deal of literature describing various processes and process steps, not only sulfonation but also dehydrogenation, alkylation, alkylbenzene distillation and the like. Common sulfonation systems useful herein include sulfuric acid, chlorosulfonic acid, oleum, sulfur trioxide and the like. Sulfur trioxide/air is especially preferred. Details of sulfonation using a suitable air/sulfur trioxide mixture are provided in U.S. Pat. No. 3,427,342, Chemithon. Sulfonation processes are further extensively described in "Sulfonation Technology in the Detergent Industry", W. H. de Groot, Kluwer Academic Publishers, Boston, 1991.

Any convenient workup steps may be used in the present process. Common practice is to neutralize after sulfonation with any suitable alkali. Thus the neutralization step can be conducted using alkali selected from sodium, potassium, ammonium, magnesium and substituted ammonium alkalis and mixtures thereof. Potassium can assist solubility, magnesium can promote soft water performance and substituted ammonium can be helpful for formulating specialty variations of the instant surfactants. The invention encompasses any of these derivative forms of the modified alkylbenzenesulfonate surfactants as produced by the present process and their use in consumer product compositions.

Alternately the acid form of the present surfactants can be added directly to acidic cleaning products, or can be mixed with cleaning ingredients and then neutralized.

Preferably the neutralisation step (III) is performed using a basic salt. Preferably the basic salt having a cation selected from the group consisting of alkali metal, alkaline earth metal, ammonium, substituted ammonium, and mixtures thereof and an anion selected from hydroxide, oxide, carbonate, silicate, phosphate and mixtures thereof. More preferably the basic salt is selected from the group consisting of sodium hydroxide, potassium hydroxide, magnesium hydroxide, calcium hydroxide, ammonium hydroxide, and mixtures thereof.

The processes are tolerant of variation, for example conventional steps can be added before, in parallel with, or after the outlined steps (I), (II) and (III). This is especially the case for accomodating the use of hydrotropes or their precursors.

PREPARATIVE EXAMPLES

Example 1

Mixture of 4-methyl-4-nonanol, 5methyl-5decanol, 6methyl-6undecanol and 6methyl-6dodecanol (A Starting-material for Branched Olefins)

A mixture of 4.65 g of 2-pentanone, 20.7 g of 2-hexanone, 51.0 g of 2-heptanone, 36.7 g of 2-octanone and 72.6 g of diethyl ether is added to an addition funnel. The ketone mixture is then added dropwise over a period of 2.25 hours to a nitrogen blanketed stirred three neck 2 L round bottom flask, fined with a reflux condenser and containing 600 mL of 2.0 M n-pentylmagnesium bromide in diethyl ether and an additional 400 mL of diethyl ether. After the addition is complete the reaction mixture is stirred an additional 2.5 hours at 20° C. The reaction mixture is then added to 1 kg of cracked ice with stirring. To this mixture is added 393.3 g of 30% sulphuric acid solution. The aqueous acid layer is drained and the remaining ether layer is washed twice with 750 mL of water. The ether layer is then evaporated under vacuum to yield 176.1 g of a mixture of 4-methyl 4-nonanol, 5-methyl-5-decanol, 6-methyl-6-undecanol and 6-methyl-6-dodecanol.

Example 2

Substantially Mono Methyl Branched Olefin Mixture with Randomized Branching an Alkylating Agent for Preparing Modified Alkylbenzenes in Accordance with the Invention a) A 174.9 g sample of the mono methyl branched alcohol mixture of example 1 is added to a nitrogen blanketed stirred three neck round bottom 500 mL flask, fitted with a Dean Stark trap and a reflux condenser along with 35.8 g of a shape selective zeolite catalyst (acidic mordenite catalyst Zeocat™ FM-8/25H). With mixing, the mixture is then heated to about 110–55° C. and water and some olefin is collected over a period of 4–5 hours in the Dean Stark trap. The conversion of the alcohol mixture of example 1 to a substantially non-randomized methyl branched olefin mixture is now complete and the reaction mixture is cooled to 20° C. The substantially non-randomized methyl branched olefin mixture remaining in the flask is filtered to remove catalyst. The solid filter cake is washed twice with 100 mL portions of hexane. The hexane filtrate is evaporated under vacuum and the resulting product is combined with the first filtrate to give 148.2 g of a substantially non-randomized methyl branched olefin mixture.

b) The olefin mixture of example 2a is combined with 36 g of a shape selective zeolite catalyst (acidic mordenite catalyst Zeocat™ FM-8/25H) and reacted according to example 2a with the following changes. The reaction temperature is raised to 190–200° C. for a period of about 1–2 hours to randomize the specific branch positions in the olefin mixture. The reaction mixture is cooled to 20° C. The substantially mono methyl branched olefin mixture with randomized branching remaining in the flask is filtered to remove catalyst. The solid filter cake is washed twice with 100 mL portions of hexane. The hexane filtrate is evaporated under vacuum and the resulting product is combined with the first filtrate to give 147.5 g of a substantially mono methyl branched olefin mixture with randomized branching.

Example 3

Substantially Mono Methyl Branched Alkylbenzene Mixture 2/3-Phenyl Index of About 200 and a 2-Methyl-2-Phenyl Index of About 0.005 (A Modified Alkylbenzene Mixture in Accordance with the Invention)

147 g of the substantially mono methyl branched olefin mixture with randomized branching of example 2 and 36 g of a shape selective zeolite catalyst (acidic beta zeolite catalyst Zeocat™ PB/H) are added to a 2 gallon stainless steel, stirred autoclave. Residual olefin and catalyst in the container are washed into the autoclave with 300 mL of n-hexane and the autoclave is sealed. From outside the autoclave cell, 2000 g of benzene (contained in a isolated vessel and added by way of an isolated pumping system inside the isolated autoclave cell) is added to the autoclave. The autoclave is purged twice with 250 psig $N_2$, and then charged to 60 psig $N_2$. The mixture is stirred and heated to about 200° C. for about 4–6 hours. The autoclave is cooled to about 20° C. overnight. The valve is opened leading from the autoclave to the benzene condenser and collection tank. The autoclave is heated to about 120° C. with continuous collection of benzene. No more benzene is collected by the time the reactor reaches 120° C. The reactor is then cooled to 40° C. and 750 g of n-hexane is pumped into the autoclave with mixing. The autoclave is then drained to remove the reaction mixture. The reaction mixture is filtered to remove catalyst and the n-hexane is evaporated under low vacuum. The product is then distilled under high vacuum (1–5 mm of Hg). The substantially mono methyl branched alkylbenzene mixture with a 2/3-Phenyl Index of about 200 and a 2-methyl-2-phenyl index of about 0.005 is collected from 76° C.–130° C. (167 g).

Example 4

Substantially Mono Methyl Branched Alkylbenzenesulfonic Acid Mixture With a 2/3-Phenyl Index of About 200 and a 2-Methyl-2-Phenyl Index of About 0.005 (A Modified Alkylbenzene Sulfonic Acid Mixture in Accordance with the Invention)

The product of example 3 is sulfonated with a molar equivalent of chlorosulfonic acid using methylene chloride as solvent. The methylene chloride is removed to give 210 g of a substantially mono methyl branched alkylbenzenesulfonic acid mixture with a 2/3-Phenyl Index of about 200 and a 2-methyl-2-phenyl index of about 0.005.

Example 5

Substantially Mono Methyl Branched Alkylbenzenesulfonate, Sodium Salt Mixture With a 2/3-Phenyl Index of About 200 and 2-Methyl-2-Phenyl Index of About 0.005 (A Modified Alkylbenzene Sulfonate Surfactant Mixture in Accordance with the Invention)

The product of example 4 is neutralized with a molar equivalent of sodium methoxide in methanol and the methanol is evaporated to give 225 g of a substantially mono methyl branched alkylbenzenesulfonate, sodium salt mixture with a 2/3-Phenyl Index of about 200 and a 2-methyl-2-phenyl index of about 0.005

Example 6

Substantially Linear Alkylbenzene Mixture With a 2/3-Phenyl Index of About 200 and a 2-Methyl-2-Phenyl Index of About 0.02. (An Alkylbenzene Mixture Used as a Component of Modified Alkylbenzenes)

A mixture of chain lengths of substantially linear alkylbenzenes with a 2/3-Phenyl Index of about 200 and a 2-methyl-2-phenyl index of about 0.02 is prepared using a shape zeolite catalyst (acidic beta zeolite catalyst Zeocat™ PB/H). A mixture of 15.1 g of Neodene (R)10, 136.6 g of Neodene(R)1112, 89.5 g of Neodene(R)12 and 109.1 g of 1-tridecene is added to a 2 gallon stainless steel, stirred autoclave along with 70 g of a shape selective catalyst (acidic beta zeolite catalyst Zeocat™ PB/H). Neodene is a trade name for olefins from Shell Chemical Company. Residual olefin and catalyst in the container are washed into the autoclave with 200 mL of n-hexane and the autoclave is sealed. From outside the autoclave cell, 2500 benzene (contained in a isolated vessel and added by way of an isolated pumping system inside the isolated autoclave cell) is added to the autoclave. The autoclave is purged twice with 250 psig $N_2$, and then charged to 60 psig $N_2$. The mixture is stirred and heated to 170° C. to 175° C. for about 18 hours then cooled to 70–80° C. The valve is opened leading from the autoclave to the benzene condenser and collection tank. The autoclave is heated to about 120° C. with continuous collection of benzene in collection tank. No more benzene is collected by the time the reactor reaches 120° C. The reactor is then cooled to 40° C. and 1 kg of n-hexane is pumped into the autoclave with mixing. The autoclave is then drained to remove the reaction mixture. The reaction mixture is filtered to remove catalyst and the n-hexane is evaporated under low vacuum. The product is then distilled under high vacuum (1–5 mm of Hg). The substantially linear alkylbenzene mixture with a 2/3-Phenyl Index of about 200 and a 2-methyl-2-phenyl index of about 0.02 is collected from 85° C.–150° C. (426.2 g).

Example 7

Substantially Linear Alkylbenzenesulfonic Acid Mixture with a 2/3-Phenyl Index of About 200 and a 2-Methyl-2-Phenyl Index of about 0.02 (An Alkylbenzenesulfonic Acid Mixture to be Used as a Component of Modified Alkylbenzenesulfonic Acid in Accordance with the Invention)

422.45 g of the product of example 6 is sulfonated with a molar equivalent of chlorosulfonic acid using methylene chloride as solvent. The methylene chloride is removed to give 574 g of a substantially linear alkylbenzenesulfonic acid mixture with a 2/3-Phenyl Index of about 200 and a 2-methyl-2-phenyl index of about 0.02.

Example 8

Substantially Linear Alkylbenzene Sulfonic Acid Mixture With a 2/3-Phenyl Index of About 200 and a 2-Methyl-2-Phenyl Index of About 0.02 (An Alkylbenzenesulfonate Surfactant Mixture to be Used as a Component of Modified Alkylbenzenesulfonate Surfactant Mixtures in Accordance with the Invention)

The substantially linear alkylbenzene sulfonic acid mixture of example 7 is neutralized with a molar equivalent of sodium methoxide in methanol and the methanol is evaporated to give 613 g of the substantially linear alkylbenzene sulfonate, sodium salt mixture with a 2/3-Phenyl Index of about 200 and a 2-methyl-2-phenyl index of about 0.02.

Example 9

6,10-Dimethyl-2-undecanol (A Starting-material for Branched Olefins)

To a glass autoclave liner is added 299 g of geranylacetone, 3.8 g or 5% ruthenium on carbon and 150 ml of methanol. The glass liner is sealed inside a 3 L, stainless steel, rocking autoclave and the autoclave purged once with 250 psig $N_2$, once with 250 psig $H_2$ and then charged with 1000 psig $H_2$. With mixing, the reaction mixture is heated. At about 75° C., the reaction initiates and begins consuming $H_2$ and exotherms to 170–180° C. In 10–15 minutes, the temperature has dropped to 100–110° C. and the pressure dropped to 500 psig. The autoclave is boosted to 1000 psig with $H_2$ and mixed at 100–110° C. for an additional 1 hour and 40 minutes with the reaction consuming an additional 160 psig $H_2$ but at which time no more $H_2$ consumption is observed. Upon cooling the autoclave to 40° C., the reaction mixture removed, filtered to remove catalyst and concentrated by evaporation of methanol under vacuum to yield 297.75 g of 6,10-dimethyl-2-undecanol.

Example 10

5,7-Dimethyl-2-decanol (A Starting-material for Branched Olefins)

To a glass autoclave liner is added 249 g of 5,7-dimethyl-3,5,9-decatrien-2-one, 2.2 g or 5% ruthenium on carbon and 200 ml of methanol. The glass liner is sealed inside a 3 L, stainless steel, rocking autoclave and the autoclave purged once with 250 psig $N_2$, once with 250 psig $H_2$ and then charged with 500 psig $H_2$. With mixing, the reaction mixture is heated. At about 75° C., the reaction initiates and begins consuming $H_2$ and exotherms to 170° C. In 10 minutes, the temperature has dropped to 115–120° C. and the pressure dropped to 270 psig. The autoclave is boosted to 1000 psig with $H_2$, mixed at 110–115° C. for an additional 7 hours and 15 minutes then cooled to 30° C. The reaction mixture is removed from autoclave, filtered to remove catalyst and concentrated by evaporation of methanol under vacuum to yield 225.8 g of 5,7-dimethyl-2-decanol.

Example 11

4,8-Dimethyl-2-nonanol (A Starting-material for Branched Olefins)

A mixture of 671.2 g of citral and 185.6 g of diethyl ether is added to an addition funnel. The citral mixture is then added dropwise over a five hour period to a nitrogen blanketed, stirred, 5 L, 3-neck, round bottom flask equipped with a reflux condenser containing 1.6 L of 3.0 M methylmagnesium bromide solution and an additional 740 ml of diethyl ether. The reaction flask is situated in an ice water bath to control exotherm and subsequent ether reflux. After addition is complete, the ice water bath is removed and the reaction allowed to mix for an additional 2 hours at 20–25° C. at which point the reaction mixture is added to 3.5 Kg of cracked ice with good mixing. To this mixture is added 1570 g of 30% sulfuric acid solution. The aqueous acid layer is drained and the remaining ether layer washed twice with 2 L of water. The ether layer is concentrated by evaporation of the ether under vacuum to yield 720.6 g of 4,8-dimethyl-3,7-nonadien-2-ol. To a glass autoclave liner is added 249.8 g of the 4,8-dimethyl-3,7-nonadien-2-ol, 5.8 g or 5% palladium on activated carbon and 200 ml of n-hexane. The glass liner is sealed inside a 3 L, stainless steel, rocking autoclave and the autoclave purged twice with 250 psig $N_2$, once with 250 psig H2 and then charged with 100 psig $H_2$. Upon mixing, the reaction initiates and begins consuming $H_2$ and exotherms to 75° C. The autoclave is heated to 80° C., boosted to 500 psig with $H_2$, mixed for 3 hours and then cooled to 30° C. The reaction mixture is removed from autoclave, filtered to remove catalyst and concentrated by evaporation of n-hexane under vacuum to yield 242 g of 4,8-dimethyl-2-nonanol.

Example 12

Substantially Dimethyl Branched Olefin Mixture with Randomized Branching (A Branched Olefin Mixture Which is an Alkylating Agent for Preparing Modified Alkylbenzenes in Accordance with the Invention)

To a nitrogen blanketed, 2 L, 3-neck round bottom flask equipped with thermometer, mechanical stirrer and a Dean-Stark trap with reflux condenser is added 225 g of 4,8-dimethyl-2-nonanol (example 11), 450 g of 5,7-dimethyl-2-decanol (example 10), 225 g of 6,10-dimethyl-2-undecanol (example 9) and 180 g of a shape selective zeolite catalyst (acidic mordenite catalyst Zeocat™ FM-8/25H). With mixing, the mixture is heated (135–160° C.) to the point water and some olefin is driven off and collected in Dean-Stark trap at a moderate rate. After a few hours, the rate of water collection slows and the temperature rises to 180–195° C. where the reaction is allowed to mix for an additional 2–4 hours. The dimethyl branched olefin mixture remaining in the flask is filtered to remove the catalyst. The catalyst filter cake is slurried with 500 ml of hexane and vacuum filtered. The catalyst filter cake is washed twice with 100 ml of hexane and the filtrate concentrated by evaporation of the hexane under vacuum. The resulting product is combined with the first filtrate to give 820 g of dimethyl branched olefin mixture with randomized branching.

Example 13

Substantially Dimethyl Branched Alkylbenzene Mixture with Randomized Branching and 2/3-Phenyl Index of About 200 and a 2-Methyl-2-Phenyl Index of About 0.04 (A Modified Alkylbenzene Mixture in Accordance with the Invention)

820 g of the dimethyl branched olefin mixture of example 12 and 160 g of a shape selective zeolite catalyst (acidic beta zeolite catalyst Zeocat™ PB/H) are added to a 2 gallon stainless steel, stirred autoclave and the autoclave is sealed. The autoclave is purged twice with 80 psig $N_2$ and then charged to 60 psig $N_2$. From outside the autoclave cell, 3000 g of benzene (contained in a isolated vessel and added by way of an isolated pumping system inside the isolated autoclave cell) is added to the autoclave. The mixture is stirred and heated to about 205° C. for about 8 hours. The autoclave is cooled to about 30° C. overnight. The valve is opened leading from the autoclave to the benzene condenser and collection tank. The autoclave is heated to about 120° C. with continuous collection of benzene. No more benzene is collected by the time the reactor reaches 120° C. and the reactor is then cooled to 40° C. The autoclave is then drained to remove the reaction mixture. The reaction mixture is filtered to remove catalyst and vacuum pulled on the mixture to remove any residual traces of benzene. The product is distilled under vacuum (1–5 mm of Hg). The dimethyl branched alkylbenzene mixture with randomized branching and 2/3-Phenyl Index of about 200 and a 2-methyl-2-phenyl index of about 0.04 is collected from 88° C.–160° C.

Example 14

Substantially Dimethyl Branched Alkylbenzenesulfonic Acid Mixture with Randomized Branching and a 2/3-Phenyl Index of About 200 and 2-Methyl-2-Phenyl Index of About 0.04 (A Modified Alkylbenzenesulfonic Acid Mixture in Accordance with the Invention)

The dimethyl branched alkylbenzene product of example 13 is sulfonated with a molar equivalent of chlorosulfonic acid using methylene chloride as solvent with HCl evolved as a side product. The resulting sulfonic acid product is concentrated by evaporation of methylene chloride under vacuum. The resulting sulfonic acid product has a 2/3-Phenyl Index of about 200 and a 2-methyl-2-phenyl index of about 0.04.

Example 15

Substantially Dimethyl Branched Alkylbenzene Sulfonic Acid, Sodium Salt Mixture with Randomized Branching and 2/3-Phenyl Index of About 200 and a 2-Methyl-2-Phenyl Index of About 0.04 (A Modified Alkylbenzenesulfonate Surfactant Mixture in Accordance with the Invention)

The dimethyl branched alkylbenzenesulfonic acid mixture of example 14 is neutralized with a molar equivalent of sodium methoxide in methanol and the methanol is evaporated to give solid dimethyl branched alkylbenzene sulfonate, sodium salt mixture with randomized branching and a 2/3-Phenyl Index of about 200 and a 2-methyl-2-phenyl index of about 0.04.

Example 16

Mixture of Linear and Branched Alkylbenzenes with a 2/3-Phenyl Index of About 200 and a 2-Methyl-2-Phenyl Index of About 0.01 (A Modified Alkylbenzene Mixture in Accordance with the Invention)

A modified alkylbenzene mixture is prepared by combining 147.5 g of the product of example example 3 and 63.2 g of the product of example 6. The resulting modified alkylbenzene mixture has a 2/3-phenyl index of about 200 and a 2-Methyl-2-phenyl Index of about 0.01.

Example 17

Mixture of Linear and Branched Alkylbenzenesulfonic Acid and Salts with a 2/3-Phenyl Index of About 200 and a 2-Methyl-2-Phenyl Index of About 0.01 (Modified Alkylbenzenesulfonic Acid Mixtures and Salt Mixtures of the Invention)

a) Modified Alkylbenzenesulfonic Acid Mixture of the Invention

The resulting modified alkylbenzene mixture of example is sulfonated with a molar equivalent of chlorosulfonic acid using methylene chloride as solvent with HCl evolved as a side product. The resulting sulfonic acid product is concentrated by evaporation of methylene chloride under vacuum. The resulting modified alkylbenzenesulfonic acid product has a 2/3-Phenyl Index of about 200 and a 2-methyl-2-phenyl index of about 0.01.

b) Modified Alkylbenzenesulfonate, Sodium Salt Mixture of the invention

The product of example 17a) is neutralized with a molar equivalent of sodium methoxide in methanol and the methanol is evaporated to give solid modified alkylbenzensulfonate, sodium salt mixture of the invention with a 2/3-Phenyl Index of about 200 and a 2-methyl-2-phenyl index of about 0.01.

Methods for Determining Compositional Parameters (2/3-phenyl index, 2-methyl-2-phenyl index) of Mixed Alkylbenzene/Alkylbenzenesulfonate/Alkylbenzenesulfonic Acid Systems It is well known in the art to determine compositional parameters of conventional linear alkylbenzenes and/or highly branched alkylbenzenesulfonates (TPBS, ABS) See, for example Surfactant Science Series, Volume 40, Chapter 6 and Surfactant Science Series, Volume 73, Chapter 7. Typically this is done by GC and/or GC-mass spectroscopy for the alkylbenzenes and HPLC for the alkylbenzenesulfonates or sulfonic acids; $^{13}C$ nmr is also commonly used. Another common practice is desulfonation. This permits GC and/or GC-mass spectroscopy to be used, since desulfonation converts the sulfonates or sulfonic acids to the alkylbenzenes which are tractable by such methods.

In general, the present invention provides unique and relatively complex mixtures of alkylbenzenes, and similarly complex surfactant mixtures of alkylbenzenesulfonates and/or alkylbenzenesulfonic acids. Compositional parameters of such compositions can be determined using variations and combinations of the art-known methods.

The sequence of methods to be used depends on the composition to be characterized as follows:

| Composition to be characterized | Sequence of Methods (Methods separated by commas are run in sequence, others can be run in parallel) |
|---|---|
| Alkylbenzene mixtures | GC, NMR1 NMR 2 |
| Alkylbenzene mixtures with impurities* | GC, DIS, GC, NMR1 NMR 2 |
| Alkylbenzenesulfonic acid mixtures | Option 1: HPLC, NMR3 NMR 4<br>Option 2: HPLC, DE, NMR1 NMR 2 |
| Alkylbenzenesulfonate salt mixtures | Option 1: HPLC, AC, NMR3 NMR 4<br>Option 2: HPLC, DE, NMR1 NMR 2 |
| Alkylbenzenesulfonic acid mixtures with impurities* | Option 1: HPLC, HPLC-P, HPLC, NMR3 NMR 4<br>Option 2: HPLC, DE, DIS, GC, NMR1 NMR 2 |
| Alkylbenzenesulfonate salt mixtures with impurities* | Option 1: HPLC, HPLC-P, HPLC, AC, NMR3 NMR 4<br>Option 2: HPLC, DE, DIS, GC, NMR1 NMR 2 |

*Typically preferred when the material contains more than about 10% impurities such as dialkylbenzenes, olefins, paraffins, hydrotropes, dialkylbenzenesulfonates, etc.

All NMR methods below use $CHCl_3$ as an external reference.

GC

Equipment

- Hewlett Packard Gas Chromatograph HP5890 Series II equipped with a split/splitless injector and FID
- J&W Scientific capillary column DB-1HT, 30 meter, 0.25 mm id, 0.1 um film thickness cat# 1221131
- Restek Red lite Septa 11 mm cat# 22306
- Restek 4 mm Gooseneck inlet sleeve with a carbofrit cat# 20799-209.5
- O-ring for inlet liner Hewlett Packard cat# 5180-4182
- J.T. Baker HPLC grade Methylene Chloride cat# 9315-33, or equivalent
- 2 ml GC autosampler vials with crimp tops, or equivalent Sample Preparation

- Weigh 4–5 mg of sample into a 2 ml GC autosampler vial
- Add 1 ml J.T. Baker HPLC grade Methylene Chloride, cat# 9315-33 to the GC vial, seal with 11 mm crimp vial teflon lined closures (caps), part # HP5181-1210 using crimper tool, part # HP8710-0979 and mix well The sample is now ready for injection into the GC GC Parameters

- Carrier Gas: Hydrogen
- Column Head Pressure: 9 psi
- Flows:
  - Column Flow @ 1 ml/min.
  - Split Vent @ ~3 ml/min.
  - Septum Purge @ 1 ml/min.
- Injection: HP 7673 Autosampler, 10 ul syringe, 1 ul injection
- Injector Temperature: 350 ° C.
- Detector Temperature: 400 ° C.
- Oven Temperature Program:
  - initial 70 ° C. hold 1 min.
  - rate 1° C./min.
  - final 180° C. hold 10 min.

Standards required for this method are 2-phenyloctane and 2-phenylpentadecane, each freshly distilled to a purity of greater than 98%. Run both standards using the conditions specified above to define the retention time for each standard. This defines a rentention time range which is the retention time range to be used for characterizing any alkylbenzenes or alkylbenzene mixtures in the context of this invention (e.g., test samples). Now run the test samples for which compositional parameters are to be determined. Test samples pass the GC test provided that greater than 90% of the total GC area percent is within the retention time range defined by the two standards. Test samples that pass the GC test can be used directly in the NMR1 and NMR2 test methods. Test samples that do not pass the GC test must be further purified by distillation until the test sample passes the GC test.

Desulfonation (DE)

The desulfonation method is a standard method described in "The Analysis of Detergents and Detergent Products" by G. F. Longman on pages 197–199. Two other useful descriptions of this standard method are given on page 230–231 of volume 40 of the Surfactant Sience Series edited by T. M. Schmitt: "Analysis of Surfactants" and on page 272 of volume 73 of the Surfactant Science Series: "Anionic Surfactants" edited by John Cross. This is an alternative method to the HPLC method, described herein, for evaluation of the branched and nonbranched alkylbenzenesulfonic acid and/or salt mixtures (Modified Alkylbenzensulfonic acid and or salt Mixtures). The method provides a means of converting the sulfonic acid and/or salt mixture into branched and nonbranched alkylbenzene mixtures which can then be analyzed by means of the GC and NMR methods NMR1 and NMR2 described herein.

HPLC

S. R. Ward, *Anal. Chem.,* 1989, 61, 2534; D. J. Pietrzyk and S. Chen, Univ. Iowa, Dept. of Chemistry.

| Apparatus | |
|---|---|
| Suitable HPLC System | Waters Division of Millipore or equivalent. |
| HPLC pump with He sparge and temperature control | Waters, model 600 or equivalent |
| Autosampler/injector | Waters 717, or equivalent |
| Autosampler 48 position tray | Waters or equivalent |
| UV detector | Waters PDA 996 or equivalent |
| Fluorescence detector | Waters 740 or equivalent |
| Data System/Integrator | Waters 860 or equivalent |
| Autosampler vials and caps | 4 mL capacity, Millipore #78514 and #78515. |
| HPLC Column, X2 | Supelcosil LC18, 5 μm, 4.6 mm × 25 cm, Supelcosil #58298 |
| Column Inlet Filter | Rheodyne 0.5 um × 3 mm Rheodyne #7335 |
| LC eluent membrane filters | Millipore SJHV M47 10, disposable filter funnel with 0.45 μm membrane. |
| Balance | Sartorius or equivalent; precision ± 0.0001 g. |
| Vacuum | Sample Clarification Kit with pumps and filters, Waters #WAT085113. |
| **Reagents** | |
| C8 LAS standard material | Sodium-p-2-octylbenzene sulfonate. |
| C15 LAS standard material | Sodium-p-2-pentadecylbenzene sulfonate. |

Procedure

A. Preparation of HPLC Mobile Phase

1. Mobile phase A a) Weigh 11.690 g sodium chloride and transfer to a 2000 mL volumetric flask. Dissolve in 200 mL HPLC grade water.

b) Add 800 mL of acetonitrile and mix. Dilute to volume after solution comes to room temperature. This prepares a solution of 100 mM NaCl/40% ACN.

c) Filter through an LC eluent membrane filter and degas prior to use.

2. Mobile phase B—Prepare 2000 mL of 60% acetonitrile in HPLC grade water. Filter through an LC eluent membrane filter and degas prior to use.

B. C8 and C15 Internal Standard Solution

1. Weigh 0.050 g of a 2-phenyloctylbenzenesulfonate and 0.050 g of 2-Phenylpentadecanesulfonate standards and quantitatively transfer to a 100 mL volumetric flask.

2. Dissolve with 30 mL ACN and dilute to volume with HPLC grade water. This prepares ca. 1500 ppm solution of the mixed standard.

C. Sample Solutions

1. Wash Solutions—Transfer 250 μL of the standard solution to a 1 mL autosampler vial and add 750 μL of the wash solution. Cap and place in the autosampler tray.

2. Alkylbenzenesulfonic acid or Alkylbenzenesulfonate—Weigh 0.10 g of the alkylbenzenesulfonic acid or salt and quantitatively transfer to a 100 mL volumetric flask. Dissolve with 30 mL ACN and dilute to volume with HPLC grade water. Transfer 250 μL of the standard solution to a 1 mL autosampler vial and add 750 μL of the sample solution. Cap and place in the autosampler tray. If solution is excessively turbid, filter through 0.45 μm membrane before transferring to auto-sampler vial. Cap and place in the auto-sampler tray.

D. HPLC System

1. Prime HPLC pump with mobile phase. Install column and column inlet filter and equilibrate with eluent (0.3 mL/min for at least 1 hr.).

2. Run samples using the following HPLC conditions:

| | | |
|---|---|---|
| Mobile phase A | 100 mM NaCl/40% ACN | |
| Mobile phase B | 40% $H_2O$/60% ACN | |
| time 0 min. | 100% Mobile phase A | 0% Mobile Phase B |
| time 75 min. | 5% Mobile phase A | 95% Mobile Phase B |
| time 98 min. | 5% Mobile phase A | 95% Mobile Phase B |
| time 110 min. | 100% Mobile phase A | 0% Mobile Phase B |
| time 120 min. | 100% Mobile phase A | 0% Mobile Phase B |
| Note: A gradient delay time of 5–10 minutes may be needed depending on dead volume of HPLC system. | | |
| Flow rate | 1.2 mL/min. | |
| Temperature | 25° C. | |
| He sparge rate | 50 mL/hr. | |
| UV detector | 225 nm | |
| Fluorescence detector | λ = 225 nm, λ = 295 nm with sensitivity at 10 x. | |
| Run time | 120 min. | |
| Injection volume | 10 μL | |
| Replicate injections | 2 | |
| Data rate | 0.45 MB/Hr. | |
| Resolution | 4.8 nm | |

3. The column should be washed with 100% water followed by 100% acetonitrile and stored in 80/20 ACN/water.

The HPLC elution time of the 2-phenyloctylbenzenesulfonate defines the lower limit and the elution time of the 2-phenylpentadecanesulfonate standard defines the upper limit of the HPLC analysis relating to the alkylbenzenesulfonic acid/salt mixture of the invention. If 90% of the alkylbenzenesulfonic acid/salt mixture components have retention times within the range of the above standards then the sample can be further defined by methods NMR 3 and NMR 4.

If the alkylbenzenesulfonic acid/salt mixture contains 10% or more of components outside the retention limits defined by the standards then the mixture should be further purified by method HPLC-P or by DE, DIS methods.

HPLC Preparative (HPLC-P)

Alkylbenzenesulfonic acids and/or the salts which contain substantial impurities (10% or greater) are purified by preparative HPLC. See, for example Surfactant Science Series, Volume 40, Chapter 7 and Surfactant Science Series, Volume 73, Chapter 7. This is routine to one skilled in the art. A sufficient quantity should be purified to meet the requirements of the NMR 3 and NMR 4.

Preparative LC method using Media Bond Elut Sep Pak® (HPLC-P)

Alkylbenzenesulfonic acids and/or the salts which contain substantial impurities (10% or greater) can also be purified by an LC method (also defined herein as HPLC-P). This procedure is actually preferred over HPLC column prep purification. As much as 500 mg of unpurified MLAS salts can be loaded onto a 10 g (60 ml) Mega Bond Elut Sep Pak® and with optimized chromatography the purified MLAS salt can be isolated and ready for freeze drying within 2 hours. A 100 mg sample of Modified alkylbenzenesulfonate salt can be loaded onto a 5 g (20 ml) Bond Elut Sep Pak and ready within the same amount of time.

A. Instrumentation

HPLC: Waters Model 600E gradient pump, Model 717 Autosampler, Water's Millennium PDA, Millenium Data Manager (v. 2.15)

Mega Bond Elut: C18 bonded phase, Varian 5 g or 10 g, PN:1225-6023, 1225-6031 with adaptors HPLC Columns: Supelcosil LC-18 (X2), 250×4.6 mm, 5 mm; #58298 Analytical Balance: Mettler Model AE240, capable of weighing samples to ±0.01 mg B. Accessories Volumetrics: glass, 10 mL Graduated Cylinder: 1 L HPLC Autosampler Vials: 4 mL glass vials with Teflon caps and glass low volume inserts and pipette capable of accurately delivering 1, 2, and 5 mL volumes C. Reagents and Chemicals Water (DI-$H_2O$): Distilled, deionized water from a Millipore, Milli-Q system or equivalent Acetonitrile ($CH_3CN$): HPLC grade from Baker or equivalent Sodium Chloride Crystal Baker Analyzed or equivalent D. HPLC Conditions Aqueous Phase Preparation A: To 600 mL of DI-$H_2O$ contained in a 1 L graduated cylinder, add 5.845 of sodium chloride. Mix well and add 400 ml ACN. Mix well.

B: To 400 ml of DI-$H_2O$ contained in a 1 L graduated cylinder, add 600 ml ACN and mix well.

Reservoir A: 60/40, $H_2O$/CAN with salt and Reservoir B: 40/60, $H_2O$/ACN

Run Conditions: Gradient: 100% A for 75 min. 5%A/95% B for 98 min. 5%A/95% B for 110 min. 100%A for 125 min.

| | |
|---|---|
| Column Temperature | Not Thermostatted (i.e., room temp.) |
| HPLC Flow Rate | 1.2 mL/min |
| Injection Volume | 10 mL |
| Run Time | 125 minutes |
| UV Detection | 225 nm |
| Conc. | >4 mg/ml |

SEP PAK Equilbration (Bond Elut, 5G)

1. Pass 10 ml of a solution containing 25/75 $H_2O$/ACN onto the sep pak by applying positive pressure with a 10 cc syringe at a rate of ~40 drops/min. Do not allow the sep pak to go dry.
2. Immediately pass 10 ml (×3) of a solution containing 70/30 $H_2O$/ACN in the same manner as #1. Do not allow the sep pak to go dry. Maintain a level of solution (~1 mm) at the head of the sep pak.
3. The sep pak is now ready for sample loading. MLAS Sample Loading/Separation and Isolation 4. Weigh <200 mg of sample into a 1 dram vial and add 2 ml of 70/30 $H_2O$/ACN. Sonicate and mix well.
5. Load sample onto Bond Elut and with positive pressure from a 10 cc syringe begin separation. Rinse vial with 1 ml (×2) portions of the 70/30 solution and load onto sep pak. Maintain ~1 mm of solution at the head of the sep pak.
6. Pass 10 ml of 70/30 onto the Bond Elut with positive pressure from a 10 cc syringe at a rate of ~40 drops/min.
7. 4. Repeat this with 3 ml and 4 ml and collect effluent if interested in impurities.

MLAS Isolation and Collection

1. Pass 10 ml of solution containing 25/75 $H_2O$/ACN with positive pressure from a 10 cc syringe and collect effluent. Repeat this with another 10 ml and again with 5 ml. The isolated MLAS is now ready for freeze drying and subsequent characterization.
2. Rotovap until ACN is removed and freeze dry the remaining $H_2O$. Sample is now ready for chromatography.

Note: When incorporating the Mega Bond Elut Sep Pak (10 g version) up to 500 mg of sample can be loaded onto the sep pak and with solution volume adjustments, the effluent can be ready for freeze drying within 2 hours.

SEP PAK Equilibration (Bond Elut, 10G)

1. Pass 20 ml of a solution containing 25/75 $H_2O$/ACN onto the sep pak using laboratory air or regulated cylinder air at a rate which will allow ~40 drops/min. You can not use positive pressure from a syringe because it is not sufficient to move the solution thru the sep pak. Do not allow the sep pak to go dry.
2. Immediately pass 20 ml (×2) and an additional 10 ml of a solution containing 70/30 $H_2O$/ACN in the same manner as #1. Do not allow the sep pak to go dry. Maintain a level of solution (~1 mm)at the head of the sep pak.
3. The sep pak is now ready for sample loading.

MLAS Sample Loading/Separation and Isolation

1. Weigh <500 mg of sample into a 2 dram vial and add 5 ml of 70/30 $H_2O$/ACN. Sonicate and mix well.
2. Load sample onto Bond Elut and with positive pressure from an air source begin separation. Rinse vial with 2 ml (×2) portions of the 70/30 solution and put onto the sep pak. Maintain ~1 mm of solution at the head of the sep pak.
3. Pass 20 ml of 70/30 onto the Bond Elut with positive pressure from an air source at a rate of ~40 drops/min. Repeat this with 6 ml and 8 ml and collect effluent if interested in impurities.

MLAS Isolation and Collection

1. Pass 20 ml of solution containing 25/75 $H_2O$/ACN with positive pressure from an air source and collect effluent.
2. Repeat this with another 20 ml and again with 10 ml. This isolated fraction contains the pure MLAS.
3. The isolated MLAS is now ready for freeze drying and subsequent characterization.
4. Rotovap until ACN is removed and freeze dry the remaining $H_2O$. Sample is now ready for chromatography.

Note: Adjustments in organic modifier concentration may be necessary for optimum separation and isolation.

Distillation (DIS)

A 5 liter, 3-necked round bottom flask with 24/40 joints is equipped with a magnetic stir bar. A few boiling chips (Hengar Granules, catalog #136-C) are added to the flask. A 9½ inch long vigreux condenser with a 24/40 joint is placed in the center neck of the flask. A water cooled condenser is attached to the top of the vigreux condenser which is fitted with a calibrated thermometer. A vacuum receiving flask is attached to the end of the condenser. A glass stopper is placed in one side arm of the 5 liter flask and a calibrated thermometer in the other. The flask and the vigreux condenser are wrapped with aluminum foil. To the 5 liter flask, is added 2270 g of an alkylbenzene mixture which contains 10% or more impurities as defined by the GC method. A vacuum line leading from a vacuum pump is attached to the receiving flask. The alkylbenzene mixture in the 5 liter flask is stirred and vacuum is applied to the system. Once the maximum vacuum is reached (at least 1 inch of Hg pressure by gauge or less), the alkylbenzene mixture is heated by means of an electric heating mantle. The distillate is collected in two fractions. Fraction A is collected from about 25° C. to about 90° C. as measured by the calibrated thermometer at the top of the vigreux column. Fraction B is collected from about 90° C. to about 155° C. as measured by the calibrated thermometer at the top of the vigreux column. Fraction A and pot residues (high boiling) are discarded. Fraction B (1881 g) contains the alkylbenzene mixture of interest. The method can be scaled according to the practitioner's needs provided that sufficient quantity of the alkylbenzene mixture remains after distillation for evaluation by NMR methods NMR1 and NMR2.

Acidification (AC)

Salts of alkylbenzenesulfonic acids are acidified by common means such as reaction in a solvent with HCl or sulfuric acid or by use of an acidic resin such as Amberlyst 15. Acificication is routine to one skilled in the art. After acidifying remove all solvents, especially any moisture, so that the samples are anhydrous and solvent-free.

NMR 1

$^{13}$C-NMR 2/3-Phenyl Index for Alkylbenzene Mixtures

A 400 mg sample of an alkylbenzene mixture is dissolved in 1 ml of anhydrous deuterated chloroform containing 1% v/v TMS as reference and placed in a standard NMR tube. The $^{13}$C NMR is run on the sample on a 300 MHz NMR spectrometer using a 20 second recycle time, a 40° $^{13}$C pulse width and gated heteronuclear decoupling. At least 2000 scans are recorded. The region of the $^{13}$C NMR spectrum between about 145.00 ppm to about 150.00 ppm is integrated. The 2/3-Phenyl index of an alkylbenzene mixture is defined by the following equation:

2/3-Phenyl Index=(Integral from about 147.65 ppm to about 148.05 ppm)/(Integral from about 145.70 ppm to about 146.15 ppm)×100

NMR 2

$^{13}$C-NMR 2-Methyl-2-Phenyl Index

A 400 mg sample of an anhydrous alkylbenzene mixture is dissolved in 1 ml of anhydrous deuterated chloroform containing 1% v/v TMS as reference and placed in a standard NMR tube. The $^{13}$C NMR is run on the sample on a 300 MHz NMR spectrometer using a 20 second recycle time, a 40° $^{13}$C pulse width and gated heteronuclear decoupling. At least 2000 scans are recorded. The $^{13}$C NMR spectrum region between about 145.00 ppm to about 150.00 ppm is integrated. The 2-methyl-2-phenyl index of an alkylbenzene mixture is defined by the following equation:

2-methyl-2-phenyl index=(Integral from about 149.35 ppm to about 149.80 ppm)/(Integral from about 145.00 ppm to about 150.00 ppm).

NMR 3

$^{13}$C-NMR 2/3-Phenyl Index for Alkylbenzenesulfonic Acid Mixtures

A 400 mg sample of an anhydrous alkylbenzenesulfonic acid mixture is dissolved in 1 ml of anhydrous deuterated chloroform containing 1% v/v TMS as reference and placed in a standard NMR tube. The $^{13}$C NMR is run on the sample on a 300 MHz NMR spectrometer using a 20 second recycle time, a 40° $^{13}$C pulse width and gated heteronuclear decoupling. At least 2000 scans are recorded. The $^{13}$C NMR spectrum region between about 152.50 ppm to about 156.90 ppm is integrated. The 2/3-Phenyl Index of an alkylbenzenesulfonic acid mixture is defined by the following equation:

2/3-Phenyl Index=(Integral from about 154.40 to about 154.80 ppm)/(Integral from about 152.70 ppm to about 153.15 ppm)×100

NMR 4

$^{13}$C-NMR 2-Methyl-2-Phenyl Index for Alkylbenzenesulfonic Acid Mixtures

A 400 mg sample of an anhydrous alkylbenzenesulfonic acid mixture is dissolved in 1 ml of anhydrous deuterated chloroform containing 1% v/v TMS as reference and placed in a standard NMR tube. The $^{13}$C NMR is run on the sample on a 300 MHz NMR spectrometer using a 20 second recycle time, a 40° $^{13}$C pulse width and gated heteronuclear decoupling. At least 2000 scans are recorded. The $^{13}$C NMR spectrum region between about 152.50 ppm to about 156.90 ppm is integrated. The 2-methyl-2-phenyl Index for an alkylbenzenesulfonic acid mixture is defined by the following equation:

2-methyl-2-phenyl index=(Integral from about 156.40 ppm to about 156.65 ppm)/(Integral from about 152.50 ppm to about 156.90 ppm).

Cleaning Compositions

The surfactant mixtures of the present invention can be incorporated into cleaning compositions. These compositions can be in any conventional form, namely, in the form of a liquid, powder, agglomerate, paste, tablet, bar, gel, or granule. The surfactant mixture of the present invention can be incorporated into a large variety of cleaning compositions. The simplest being combining it with a conventional cleaning adjunct. Such a composition would comprise:

(a) from about 0.1% to about 95%, preferably 0.5% to about 50%, more preferably from about 1% to about 30% of the surfactant mixture; and (b) from about 0.00001% to about 99.9%, preferably 1.0% to about 98%, more preferably from about 5% to about 95% of a conventional cleaning adjunct.

In one preferred embodiment, the composition may contain additional surfactants.

Such a composition may comprise:

(a) from about 0.1% to about 95%, preferably from about 0.5% to about 50%, more preferably from about 1% to about 35%, by weight of the modified alkylbenzene sulfonate surfactant mixture;

(b) from about 0.00001% to about 99.9%, preferably from about 5% to about 98%, more preferably from about 50% to about 95%, by weight of conventional cleaning adjuncts other than surfactants; and (c) from 0% to about 50%, preferably from about 0.1% to about 50%, more preferably from about 0.1% to about 35%, preferably from about 1% to about 15%, preferably from about 0.2% to about 10%, by weight of a surfactant other than the modified alkylbenzene sulfonate surfactant mixture, preferably, one or more surfactants selected from the group consisting of cationic surfactants, anionic surfactants, and anionic surfactants other than alkylbenzene sulfonates, more preferably a cationic surfactant is present, and the cationic surfactant when present is at a level of from about 0.2% to about 5%; provided that when the detergent composition comprises any other alkylbenzene sulfonate than the alkylbenzene sulfonate of said modified alkylbenzene sulfonate surfactant mixture, said modified alkylbenzene sulfonate surfactant mixture and said other alkylbenzene sulfonate, as a mixture, have an overall 2/3-phenyl index of from about 160 to about 275, preferably from about 170 to about 265, more preferably from about 180 to about 255.

Said overall 2/3-phenyl index is determined by measuring 2/3-phenyl index, as defined herein, on a blend of said modified alkylbenzene sulfonate surfactant mixture and said any other alkylbenzene sulfonate to be added to said detergent composition, said blend, for purposes of measurement, being prepared from aliquots of said modified alkylbenzene sulfonate surfactant mixture and said other alkylbenzene sulfonate not yet exposed to any other of said components of the detergent composition; and further provided that when said detergent composition comprises any alkylbenzene sulfonate surfactant other than said modified alkylbenzene sulfonate surfactant mixture (for example as a result of blending into the detergent composition one or more commercial, especially linear, typically linear $C_{10}$–$C_{14}$, alkylbenzene sulfonate surfactants), said detergent composition is further characterized by an overall 2-methyl-2-phenyl index of less than about 0.3, preferably from 0 to 0.2, more preferably no more than about 0.1, more preferably still, no more than about 0.05, wherein said overall 2-methyl-2-phenyl index is to be determined by measuring 2-methyl-2-phenyl index, as defined herein, on a blend of said modified alkylbenzene sulfonate surfactant mixture and any other alkylbenzene sulfonate to be added to said detergent composition, said blend, for purposes of measurement, being prepared from aliquots of said modified alkylbenzene sulfonate surfactant mixture and said other alkylbenzene sulfonate not yet exposed to any other of said components of the detergent composition.

These provisions may appear somewhat unusual, however they are consistent with the spirit and scope of the present invention, which encompasses a number of economical but less preferred approaches in terms of overall cleaning performance, such as blending of the modified alkylbenzene sulfonate surfactants with conventional linear alkylbenzene sulfonate surfactants either during synthesis or during formulation into the detergent composition. Moreover, as is well known to practitioners of detergent analysis, a number of detergent adjuncts (paramagnetic materials such as certain transition metal bleach catalysts, for example, and sometimes even water) are capable of interfering with methods for determining the parameters of alkylbenzene sulfonate surfactant mixtures as described hereinafter. Hence wherever possible, analysis should be conducted on dry materials before mixing them into the detergent compositions.

Alternatively, the detergent compositions of the present invention can be free of alkylbenzene sulfonate surfactants other than the surfactant mixtures of the present invention. Such a composition may comprise, preferably consist essentially of:

(a) from about 1% to about 50%, preferably from about 1% to about 35%, by weight of the modified alkylbenzene sulfonate surfactant mixture;

(b) from about 0.00001% to about 99.9%, preferably from about 5% to about 98%, more preferably from about 50% to about 95%, by weight of conventional cleaning adjuncts other than surfactants; and (c) from 0.1% to about 50%, preferably from about 0.1% to about 35%, more typically from about 1% to about 15%, by weight of surfactants other than alkylbenzene sulfonates, preferably, one or more surfactants selected from the group consisting of cationic surfactants, anionic surfactants, and anionic surfactants other than alkylbenzene sulfonates, more preferably wherein a cationic surfactant is present at a level of from about 0.2% to about 5%; and (d) from 0.1% to about 95% water.

Detergent compositions are included herein which contain from about 1% to about 50%, preferably from about 2% to about 30% by weight of the modified alkylbenzene sulfonate surfactant mixture and:

(b) about 0.000001% to about 10%, preferably from about 0.01% to about 2%, by weight selected form the group consisting of optical brighteners, dyes, photobleaches, hydrophobic bleach activators transition metal bleach catalysts and mixtures thereof, preferably at least two of this group, more preferably at least two of this group one of which is an optical brightener;

(c) about 0.1% to about 40% by weight, preferably not more than about 30%, by weight of surfactants selected from the group consisting of cationic surfactants, nonionic surfactants, anionic surfactants, and amine oxide surfactants, more preferably at least one cationic surfactant is present at a level of from about 0.1% to about 5% by weight and preferably selected from linear and branched, substituted and unsubstituted, $C_8$–$C_{16}$ alkyl ammonium salts, or at least one nonionic surfactant is present at a level of from about 0.5% to about 25% by weight, or at least one alkyl sulfate surfactant or alkyl(polyalkoxy)sulfate surfactant is present at a level of from about 0.5% to about 25% by weight; and (d) from about 10% to about 99% of conventional cleaning adjuncts other than any of (a)–(c);

provided that when said detergent composition comprises any alkylbenzene sulfonate surfactant other than said modified alkylbenzene sulfonate surfactant mixture, for example as a result of blending into the detergent composition one or more commercial, especially linear, typically linear $C_{10}$–$C_{14}$, alkylbenzene sulfonate surfactants (these have a 2/3-Phenyl index of from 75 to 160), said detergent composition is further characterized by an overall 2/3-phenyl index of at least about 160, preferably at least about 170, more preferably at least about 180, more preferably still, at least about 200, wherein said overall 2/3-phenyl index is determined by measuring 2/3-phenyl index, as defined herein, on a blend of said modified alkylbenzene sulfonate surfactant mixture and said any other alkylbenzene sulfonate to be added to said detergent composition, said blend, for purposes of measurement, being prepared from aliquots of said modified alkylbenzene sulfonate surfactant mixture and said other alkylbenzene sulfonate not yet exposed to any other of said components of the detergent composition; and further provided that when said detergent composition comprises any alkylbenzene sulfonate surfactant other than said modified alkylbenzene sulfonate surfactant mixture, for example as a result of blending into the detergent composition one or more commercial, especially linear, typically linear $C_{10}$–$C_{14}$, alkylbenzene sulfonate surfactants, said detergent composition is further characterized by an overall 2-methyl-2-phenyl index of less than about 0.3, preferably from 0 to 0.2, more preferably no more than about 0.1, more preferably still, no more than about 0.05, wherein said overall 2-methyl-2-phenyl index is to be determined by measuring 2-methyl-2-phenyl index, as defined herein, on a blend of said modified alkylbenzene sulfonate surfactant mixture and any other alkylbenzene sulfonate to be added to said detergent composition, said blend, for purposes of measurement, being prepared from aliquots of said modified alkylbenzene sulfonate surfactant mixture and said other alkylbenzene sulfonate not yet exposed to any other of said components of the detergent composition.

In one embodiment of the present invention, the detergent compositions are substantially free from alkylbenzene sulfonate surfactants other than the modified alkylbenzene sulfonate surfactant mixture. That is no alkylbenzene sulfonate surfactants other than the modified alkylbenzene sulfonate surfactant mixture are added to the detergent compositions.

In another embodiment of the present invention, the detergent compositions may contain as an additional surfactant at least about 0.1%, preferably no more than about 10% more preferably no more than about 5%, more preferably still, no more than about 1%, of a commercial $C_{10}$–$C_{14}$ linear alkylbenzene sulfonate surfactant. It is further preferred that the commercial $C_{10}$–$C_{14}$ linear alkylbenzene sulfonate surfactant has a 2/3 phenyl index of from 75 to 160.

In another embodiment of the present inventions the detergent compositions may contain as an additional surfactant at least about 0.1%, preferably no more than about 10%, more preferably no more than about 5%, more preferably still, no more than about 1%, of a commercial highly branched alkylbenzene sulfonate surfactant. For example TPBS or tetrapropylbenzene sulfonate.

The present invention encompasses less preferred but sometimes useful embodiments for their normal purposes, such as the addition of useful hydrotrope precursors and/or hydrotropes, such as $C_1$–$C_8$ alkylbenzenes, more typically toluenes, cumenes, xylenes, naphthalenes, or the sulfonated derivatives of any such materials, minor amounts of any other materials, such as tribranched alkylbenzene sulfonate surfactants, dialkylbenzenes and their derivatives, dialkyl tetralins, wetting agents, processing aids, and the like. It will be understood that, with the exception of hydrotropes, it will not be usual practice in the present invention to include any such materials. Likewise it will be understood that such materials, if and when they interfere with analytical methods, will not be included in samples of compositions used for analytical purposes.

Numerous variations of the present detergent compositions are useful. Such variations include:

the detergent composition which is substantially free from alkylbenzene sulfonate surfactants other than said modified alkylbenzene sulfonate surfactant mixture;

the detergent composition which comprises, in said component (c), at least about 0.1%, preferably no more than about 10%, more preferably no more than about 5%, more preferably still, no more than about 1%, of a commercial $C_{10}$–$C_{14}$ linear alkylbenzene sulfonate surfactant;

the detergent composition which comprises, in said component (c), at least about 0.1%, preferably no more than about 10%, more preferably no more than about 5%, more preferably still, no more than about 1%, of a commercial highly branched alkylbenzene sulfonate surfactant. (e.g., TPBS or tetrapropylbenzene sulfonate);

the detergent composition which comprises, in said component (c), a nonionic surfactant at a level of from about 0.5% to about 25% by weight of said detergent composition, and wherein said nonionic surfactant is a polyalkoxylated alcohol in capped or non-capped form having:—a hydrophobic group selected from linear $C_{10}$–$C_{16}$ alkyl, mid-chain $C_1$–$C_3$ branched $C_{10}$–$C_{16}$ alkyl, guerbet branched $C_{10}$–$C_{16}$ alkyl, and mixtures thereof and—a hydrophilic group selected from 1–15 ethoxylates, 1–15 propoxylates 1–15 butoxylates and mixtures thereof, in capped or uncapped form. (when uncapped, there is also present a terminal primary —OH moiety and when capped, there is also present a terminal moiety of the form —OR wherein R is a $C_1$–$C_6$ hydrocarbyl moiety, optionally comprising a primary or, preferably when present, a secondary alcohol.);

the detergent composition which comprises, in said component (c), an alkyl sulfate surfactant at a level of from about 0.5% to about 25% by weight of said detergent composition, wherein said alkyl sulfate surfactant has a hydrophobic group selected from linear $C_{10}$–$C_{18}$ alkyl, mid-chain $C_1$–$C_3$ branched $C_{10}$–$C_{18}$ alkyl, guerbet branched $C_{10}$–$C_{18}$ alkyl, and mixtures thereof and a cation selected from Na, K and mixtures thereof;

the detergent composition which comprises, in said component (c), an alkyl(polyalkoxy)sulfate surfactant at a level of from about 0.5% to about 25% by weight of said detergent composition, wherein said alkyl (polyalkoxy)sulfate surfactant has—a hydrophobic group selected from linear $C_{10}$–$C_{16}$ alkyl, mid-chain $C_1$–$C_3$ branched $C_{10}$–$C_{16}$ alkyl, guerbet branched $C_{10}$–$C_{16}$ alkyl, and mixtures thereof and—a (polyalkoxy)sulfate hydrophilic group selected from 1–15 polyethoxysulfate, 1–15 polypropoxysulfate, 1–15 polybutoxysulfate, 1–15 mixed poly(ethoxy/propoxylbutoxy)sulfates, and mixtures thereof, in capped or uncapped form; and—a cation selected from Na, K and mixtures thereof;

the detergent composition having the form of a heavy-duty liquid detergent;

the detergent composition having the form of a syndet laundry bar;

the detergent composition having the form of a heavy-duty granule;

the detergent composition having the form of a heavy-duty granule and wherein said conventional cleaning adjunct (d) comprises from about 10% to about 50% by weight of said detergent composition of a nonphosphate builder;

the detergent composition having the form of a heavy-duty granule and wherein said conventional cleaning adjunct (d) comprises from about 10% to about 50% by weight of said detergent composition of a phosphate builder; and the detergent composition having the form of a heavy-duty granule and wherein said conventional cleaning adjunct (d) comprises as said phosphate builder a member selected from the group consisting of sodium tripolyphosphate.

It is preferred that when the detergent composition comprises an alkyl(polyalkoxy)sulfate surfactant which has a hydrophobic group selected from linear $C_{10}$–$C_{16}$ alkyl, mid-chain $C_1$–$C_3$ branched $C_{10}$–$C_{16}$ alkyl, guerbet branched $C_{10}$–$C_{16}$ alkyl, and mixtures thereof; and a (polyalkoxy) sulfate hydrophilic group selected from 1–15 polyethoxysulfate, 1–15 polypropoxysulfate, 1–15 polybutoxysulfate, 1–15 mixed poly(ethoxy/propoxy/butoxy)sulfates, and mixtures thereof, in capped or uncapped form; and a cation selected from Na, K and mixtures thereof.

It is preferred that when the detergent composition comprises a nonionic surfactant, it is a polyalkoxylated alcohol in capped or non-capped form has a hydrophobic group selected from linear $C_{10}$–$C_{16}$ alkyl, mid-chain $C_1$–$C_3$ branched $C_{10}$–$C_{16}$ alkyl, guerbet branched $C_{10}$–$C_{16}$ alkyl, and mixtures thereof; and a hydrophilic group selected from 1–15 ethoxylates, 1–15 propoxylates 1–15 butoxylates and mixtures thereof, in capped or uncapped form. When uncapped, there is also present a terminal primary —OH moiety and when capped, there is also present a terminal moiety of the form —OR wherein R is a $C_1$–$C_6$ hydrocarbyl moiety, optionally comprising a primary or, preferably when present, a secondary alcohol.

It is preferred that when the detergent composition comprises an alkyl sulfate surfactant which has a hydrophobic group selected from linear $C_{10}$–$C_{16}$ alkyl, mid-chain $C_1$–$C_3$ branched $C_{10}$–$C_{18}$ alkyl, guerbet branched $C_{10}$–$C_{16}$ alkyl, and mixtures thereof and a cation selected from Na, K and mixtures thereof.

In one embodiment of the present invention, the detergent compositions are prepared by a process comprising a step selected from:

(i) blending a mixture of branched and linear alkylbenzene sulfonate surfactants having a 2/3-phenyl index of 500 to 700 with an alkylbenzene sulfonate surfactant mixture having a 2/3-phenyl index of 75 to 160 and (ii) blending a mixture of branched and linear alkylbenzenes having a 2/3-phenyl index of 500 to 700 with an alkylbenzene mixture having a 2/3-phenyl index of 75 to 160 and sulfonating said blend.

Preferably the conventional cleaning agent adjunct is selected from the group consisting of builders, detersive enzymes, bleaching systems, surfactants other than the surfactant mixture, typically selected from anionic, cationic and nonionic surfactants and, when present, preferably including a cationic surfactant, brighteners, at least partially water-soluble or water dispersible polymers, abrasives, bactericides, tarnish inhibitors, dyes, solvents, hydrotropes, perfumes, thickeners, antioxidants, processing aids, suds boosters, suds suppressors, buffers, anti-fungal agents, mildew control agents, insect repellents, anti-corrosive aids, chelants and mixtures thereof. More preferably the conventional cleaning adjunct comprises one or more of:

i) from about 0.1% to about 10% of a cationic surfactant, preferably selected from substituted, e.g., monoalkoxylated or polyalkoxylated, and unsubstituted, $C_8$–$C_{16}$ alkyl ammonium salts, more preferably $C_{10}$–$C_{14}$ alkyl trimethyl- or $C_{10}$–$C_{14}$ alkyl dimethyl-ammonium salts, very preferably $C_{10}$–$C_{14}$ dimethylethoxyammonium salts having the ethoxy moiety bonded to nitrogen; any water-soluble salt, e.g., the chloride is suitable;

ii) from about 0.0001% to about 25% of a bleach system, e.g., a mixture of a perborate or percarbonate salt and a bleach activator, bleach catalyst, organic bleach booster or mixtures thereof, preferably including a hydrophobic bleach activator such as NOBS and/or a hydrophilic bleach activator such as TAED;

iii) from about 0.001% to about 20% of a detersive enzyme, preferably selected from proteases, amylases, lipases, cellulases, endoglucanases, oxidases and mixtures thereof;

iv) from about 0.001% to about 10% of a soil release polymer; and v) from about 5% to about 45% of an inorganic builder, e.g., sodium tripolyphosphate, sodium carbonate, zeolite A, zeolite P, maximum aluminum zeolite P or the like, the non-phosphate builders preferably complemented by organic polycarboxylate polymers.

The surfactant compositions of the present invention can be used in a wide range of consumer cleaning product compositions including powders, liquids, granules, gels, pastes, tablets, pouches, bars, types delivered in dual-compartment containers, spray or foam detergents and other homogeneous or multiphasic consumer cleaning product forms. They can be used or applied by hand and/or can be applied in unitary or freely alterable dosage, or by automatic dispensing means, or are useful in appliances such as washing-machines or dishwashers or can be used in institutional cleaning contexts, including for example, for personal cleansing in public facilities, for bottle washing, for surgical instrument cleaning or for cleaning electronic components. They can have a wide range of pH, for example from about 2 to about 12 or higher, and they can have a wide range of alkalinity reserve which can include very high alkalinity reserves as in uses such as drain unblocking in which tens of grams of NaOH equivalent can be present per 100 grams of formulation, ranging through the 1–10 grams of NaOH equivalent and the mild or low-alkalinity ranges of liquid hand cleaners, down to the acid side such as in acidic hard-surface cleaners. Both high-foaming and low-foaming detergent types are encompassed.

Consumer product cleaning compositions are described in the "Surfactant Science Series", Marcel Dekker, New York, Volumes 1–67 and higher. Liquid compositions in particular are described in detail in the Volume 67, "Liquid Detergents", Ed. Kuo-Yann Lai, 1997, ISBN 0-8247-9391-9 incorporated herein by reference. More classical formulations, especially granular types, are described in "Detergent Manufacture including Zeolite Builders and Other New Materials", Ed. M. Sittig, Noyes Data Corporation, 1979 incorporated by reference. See also Kirk Othmer's Encyclopedia of Chemical Technology.

Consumer product cleaning compositions herein nonlimitingly include:

Light Duty Liquid Detergents (LDL): these compositions include LDL compositions having surfactancy improving magnesium ions (see for example WO 97/00930 A; GB 2,292,562 A; U.S. Pat. Nos. 5,376,310; 5,269,974; 5,230,823; 4,923,635; 4,681,704; 4,316,824; 4,133,779) and/or organic diamines and/or various foam stabilizers and/or foam boosters such as amine oxides (see for example U.S. Pat. No. 4,133,779) and/or skin feel modifiers of surfactant, emollient and/or enzymatic types including proteases; and/or antimicrobial agents; more comprehensive patent listings are given in Surfactant Science Series, Vol. 67, pages 240–248.

Heavy Duty Liquid Detergents (HDL): these compositions include both the_so-called "structured" or multi-phase (see for example U.S. Pat. Nos. 4,452,717; 4,526,709; 4,530,780; 4,618,446; 4,793,943; 4,659,497; 4,871,467; 4,891,147; 5,006,273; 5,021,195; 5,147,576; 5,160,655) and "non-structured" or isotropic liquid types and can in general be aqueous or nonaqueous (see, for example EP 738,778 A; WO 97/00937 A; WO 97/00936 A; EP 752,466 A; DE 19623623 A; WO 96/10073 A; WO 96/10072 A; U.S. Pat. Nos. 4,647,393; 4,648,983; 4,655,954; 4,661,280; EP 225,654; U.S. Pat. Nos. 4,690,771; 4,744,916; 4,753,750; 4,950,424; 5,004,556; 5,102,574; WO 94/23009; and can be with bleach (see for example U.S. Pat. Nos. 4,470,919; 5,250,212; EP 564,250; U.S. Pat. Nos. 5,264,143; 5,275,753; 5,288,746; WO 94/11483; EP 598,170; EP 598,973; EP 619,368; U.S. Pat. Nos. 5,431,848; 5,445,756) and/or enzymes (see for example U.S. Pat. Nos. 3,944,470; 4,111,855; 4,261,868; 4,287,082; 4,305,837; 4,404,115; 4,462,922; 4,529,5225; 4,537,706; 4,537,707; 4,670,179; 4,842,758; 4,900,475; 4,908,150; 5,082,585; 5,156,773; WO 92/19709; EP 583,534; EP 583,535; EP 583,536; WO 94/04542; U.S. Pat. No. 5,269,960; EP 633,311; U.S. Pat. Nos. 5,422,030; 5,431,842; 5,442,100) or without bleach and/or enzymes. Other patents relating to heavy-duty liquid detergents are tabulated or listed in Surfactant Science Series, Vol. 67, pages 309–324.

Heavy Duty Granular Detergents (HDG): these compositions include both the so-called "compact" or agglomerated or otherwise non-spray-dried, as well as the so-called "fluffy" or "densified" spray dried granules or spray-dried types. Included are both phosphated and nonphosphated types. Such detergents can include the more common anionic-surfactant based types or can be the so-called "high-nonionic surfactant" types in which commonly the nonionic surfactant is held in or on an absorbent such as zeolites or other porous_inorganic salts. Manufacture of HDG's is, for example, disclosed in EP 753,571 A; WO 96/38531 A; U.S. Pat. Nos. 5,576,285; 5,573,697; WO 96/34082 A; U.S. Pat. No. 5,569,645; EP 739,977 A; U.S. Pat. No. 5,565,422; EP 737,739 A; WO 96/27655 A; U.S. Pat. No. 5,554,587; WO 96/25482 A; WO 96/23048 A; WO 96/22352 A; EP 709,449 A; WO 96/09370 A; U.S. Pat. Nos. 5,496,487; 5,489,392 and EP 694,608 A.

"Softergents" (STW): these compositions include the various granular or liquid (see for example EP 753,569 A; U.S. Pat. Nos. 4,140,641; 4,639,321; 4,751,008; EP 315,126; U.S. Pat. Nos. 4,844,821; 4,844,824; 4,873,001; 4,911,852; 5,017,296; EP 422,787) softening-through-the wash types of product and in general can have organic (e.g., quaternary) or inorganic (e.g., clay) softeners.

Hard Surface Cleaners (HSC): these compositions include all-purpose cleaners such as cream cleansers and liquid all-purpose cleaners; spray all-purpose_cleaners including glass and tile cleaners and bleach spray cleaners; and bathroom cleaners including mildew-removing, bleach-containing, antimicrobial, acidic, neutral and basic types. See, for example EP 743,280 A; EP 743,279 A. Acidic cleaners include those of WO 96/34938 A.

Bar Soaps (BS&HW): these compositions include personal cleansing bars as well as so-called laundry bars (see, for example WO 96/35772 A); including both the syndet and soap-based types and types with softener (see U.S. Pat. No. 5,500,137 or WO 96/01889 A); such compositions can include those made by common soap-making techniques such as plodding and/or more unconventional techniques such as casting, absorption of surfactant into a porous support, or the like. Other bar soaps (see for example BR 9502668; WO 96/04361 A; WO 96/04360 A; U.S. Pat. No. 5,540,852 ) are also included. Other handwash detergents include those such as are described in GB 2,292,155 A and WO 96/01306 A.

Shampoos and Conditioners (S&C): (see, for example WO 96/37594 A; WO 96/17917 A; WO 96/17590 A; WO 96/17591 A). Such compositions in general include both simple shampoos and the so-called "two-in-one" or with conditioner types.

Liquid Soaps (LS): these compositions include both the so-called "antibacterial" and conventional types, as well as those with or without skin conditioners and include types suitable for use in pump dispensers, and by other means such as wall-held devices used institutionally.

Fabric Softeners (FS): these compositions include both the conventional liquid and liquid concentrate types (see, for example EP 754,749 A; WO 96/21715 A; U.S. Pat. No. 5,531,910; EP 705,900 A; U.S. Pat. No. 5,500,138) as well as dryer-added or substrate-supported types (see, for example U.S. Pat. Nos. 5,562,847; 5,559,088; EP 704,522 A). Other fabric softeners include solids (see, for example U.S. Pat. No. 5,505,866).

Special Purpose Cleaners (SPC) including home dry cleaning systems (see for example WO 96/30583 A; WO 96/30472 A; WO 96/30471 A; U.S. Pat. No. 5,547,476; WO 96/37652 A); bleach pretreatment products for laundry (see EP 751,210 A); fabric care pretreatment products (see for example EP 752,469 A); liquid fine fabric detergent types, especially the high-foaming variety; rinse-aids for dish-washing; liquid bleaches including both chlorine type and oxygen bleach type, and disinfecting agents, mouthwashes, denture cleaners (see, for example WO 96/19563 A; WO 96/19562 A), car or carpet cleaners or shampoos (see, for example EP 751,213 A; WO 96/15308 A), hair rinses, shower gels, foam baths and personal care cleaners (see, for example WO 96/37595 A; WO 96/37592 A; WO 96/37591 A; WO 96/37589 A; WO 96/37588 A; GB 2,297,975 A; GB 2,297,762 A; GB 2,297,761 A; WO 96/17916 A; WO 96/12468 A) and metal cleaners; as well as cleaning auxiliaries such as bleach additives and "stain-stick" or other pre-treat types including special foam type cleaners (see, for example EP 753,560 A; EP 753,559 A; EP 753,558 A; EP 753,557 A; EP 753,556 A) and anti-sunfade treatments (see WO 96/03486 A; WO 96/03481 A; WO 96/03369 A) are also encompassed. Detergents with enduring perfume (see for example U.S. Pat. No. 5,500,154; WO 96/02490) are increasingly popular.

Laundry or Cleaning Adjunct Materials and Methods

In general, a laundry or cleaning adjunct is any material required to transform a composition containing only the minimum essential ingredients (herein the essential modified alkylbenzene sulfonate surfactant mixture) into a composition useful for laundry or other consumer product cleaning purposes. In preferred embodiments, laundry or cleaning adjuncts are easily recognizable to those of skill in the art as being absolutely characteristic of laundry or cleaning products, especially of laundry or cleaning products intended for direct use by a consumer in a domestic environment.

The precise nature of these additional components, and levels of incorporation thereof, will depend on the physical form of the composition and the nature of the cleaning operation for which it is to be used.

Preferably, the adjunct ingredients if used with bleach should have good stability therewith. Certain preferred detergent compositions herein should be boron-free and/or phosphate-free as required by legislation. Levels of adjuncts are from about 0.00001% to about 99.9%, by weight of the compositions. Use levels of the overall compositions can vary widely depending on the intended application, ranging for example from a few ppm in solution to so-called "direct application" of the neat cleaning composition to the surface to be cleaned.

Common adjuncts include builders, surfactants, enzymes, polymers, bleaches, bleach activators, catalytic materials and the like excluding any materials already defined hereinabove as part of the essential component of the inventive compositions. Other adjuncts herein can include suds boosters, suds suppressors (antifoams) and the like, diverse active ingredients or specialized materials such as dispersant polymers (e.g., from BASF Corp. or Rohm & Haas), color speckles, silvercare, anti-tarnish and/or anti-corrosion agents, dyes, fillers, germicides, alkalinity sources, hydrotropes, anti-oxidants, enzyme stabilizing agents, pro-perfumes, perfumes, solubilizing agents, carriers, processing aids, pigments, and, for liquid formulations, solvents, as described in detail hereinafter.

Quite typically, laundry or cleaning compositions herein such as laundry detergents, laundry detergent additives, hard surface cleaners, synthetic and soap-based laundry bars, fabric softeners and fabric treatment liquids, solids and treatment articles of all kinds will require several adjuncts, though certain simply formulated products, such as bleach additives, may require only, for example, an oxygen bleaching agent and a surfactant as described herein. A comprehensive list of suitable laundry or cleaning adjunct materials and methods can be found in US Provisional Patent application No. 60/053,318 filed Jul. 21, 1997 and assigned to Procter & Gamble.

Detersive surfactants—The instant compositions desirably include a detersive surfactant used as a co-surfactant with the essential surfactant mixtures. Since the present invention is surfactant-related, in the descriptions of the preferred embodiments of the detergent compositions of the invention, surfactant materials are described and accounted for separately from nonsurfactant adjuncts. Detersive surfactants are extensively illustrated in U.S. Pat. No. 3,929,678, Dec. 30, 1975 Laughlin, et al, and U.S. Pat. No. 4,259,217, Mar. 31, 1981, Murphy; in the series "Surfactant Science", Marcel Dekker, Inc., New York and Basel; in "Handbook of Surfactants", M. R. Porter, Chapman and Hall, 2nd Ed., 1994; in "Surfactants in Consumer Products", Ed. J. Falbe, Springer-Verlag, 1987; and in numerous detergent-related patents assigned to Procter & Gamble and other detergent and consumer product manufacturers.

The detersive surfactant herein includes anionic, nonionic, zwitterionic or amphoteric types of surfactant known for use as cleaning agents in textile laundering, but does not include completely foam-free or completely insoluble surfactants (though these may be used as optional adjuncts). Examples of the type of surfactant considered optional for the present purposes are relatively uncommon as compared with cleaning surfactants but include, for example, the common fabric softener materials such as dioctadecyldimethylammonium chloride.

In more detail, detersive surfactants useful herein, typically at levels from about 1% to about 55%, by weight, suitably include: (1) conventional alkylbenzene sulfonates, including the hard (ABS, TPBS) or linear types and made by known processe such as various HF or solid HF e.g., DETAL® (UOP) process, or made by using other Lewis Acid catalysts e.g., $AlCl_3$, or made using acidic silica/alumina or made from chlorinated hydrocarbons; (2) olefin sulfonates, including α-olefin sulfonates and sulfonates derived from fatty acids and fatty esters; (3) alkyl or alkenyl sulfosuccinates, including the diester and half-ester types as well as sulfosuccinamates and other sulfonate/carboxylate surfactant types such as the sulfosuccinates derived from ethoxylated alcohols and alkanolamides; (4) paraffin or alkane sulfonate- and alkyl or alkenyl carboxysulfonate-types including the product of adding bisulfite to alpha olefins; (5) alkylnaphthalenesulfonates; (6) alkyl isethionates and alkoxypropanesulfonates, as well as fatty isethionate esters, fatty esters of ethoxylated isethionate and other ester sulfonates such as the ester of 3-hydroxypropanesulfonate or AVANEL S types; (7) benzene, cumene, toluene, xylene, and naphthalene sulfonates, useful especially for their hydrotroping properties; (8) alkyl ether sulfonates; (9) alkyl amide sulfonates; (10) α-sulfo fatty acid salts or esters and internal sulfo fatty acid esters; (11) alkylglycerylsulfonates; (12) ligninsulfonates; (13) petroleum sulfonates, sometimes known as heavy alkylate sulfonates; (14) diphenyl oxide disulfonates; (15) linear or branched alkylsulfates or alkenyl sulfates; (16) alkyl or alkylphenol alkoxylate sulfates and the corresponding polyalkoxylates, sometimes known as alkyl ether sulfates, as well as the alkenylalkoxysulfates or alkenylpolyalkoxy sulfates; (17) alkyl amide sulfates or alkenyl amide sulfates, including sulfated alkanolamides and their alkoxylates and polyalkoxylates; (18) sulfated oils, sulfated alkylglycerides, sulfated alkylpolyglycosides or sulfated sugar-derived surfactants; (19) alkyl alkoxycarboxylates and alkylpolyalkoxycarboxylates, including galacturonic acid salts; (20) alkyl ester carboxylates and alkenyl ester carboxylates; (21) alkyl or alkenyl carboxylates, especially conventional soaps and α,ω-dicarboxylates, including also the alkyl- and alkenylsuccinates; (22) alkyl or alkenyl amide alkoxy- and polyalkoxy-carboxylates; (23) alkyl and alkenyl amidocarboxylate surfactant types, including the sarcosinates, taurides, glycinates, aminopropionates and iminopropionates; (24) amide soaps, sometimes referred to as fatty acid cyanamides; (25) alkylpolyaminocarboxylates; (26) phosphorus-based surfactants, including alkyl or alkenyl phosphate esters, alkyl ether phosphates including their alkoxylated derivatives, phopshatidic acid salts, alkyl phosphonic acid salts, alkyl di(polyoxyalkylene alkanol) phosphates, amphoteric phosphates such as lecithins; and phosphate/carboxylate, phosphate/sulfate and phosphate/sulfonate types; (27) Pluronic- and Tetronic-type nonionic surfactants; (28) the so-called EO/PO Block polymers, including the diblock and triblock EPE and PEP types; (29) fatty acid polyglycol esters; (30) capped and non-capped alkyl or alkylphenol ethoxylates, propoxylates and butoxylates including fatty alcohol polyethyleneglycol ethers; (31) fatty alcohols, especially where useful as viscosity-modifying surfactants or present as unreacted components of other surfactants; (32) N-alkyl polyhydroxy fatty acid amides, especially the alkyl N-alkylglucamides; (33) nonionic surfactants derived from mono- or polysaccharides or sorbitan, especially the alkylpolyglycosides, as well as sucrose fatty acid esters; (34) ethylene glycol-, propylene glycol-, glycerol- and polyglyceryl-esters and their alkoxylates, especially glycerol ethers and the fatty acid/glycerol monoesters and diesters; (35) aldobionamide surfactants; (36) alkyl succinimide nonionic surfactant types; (37) acetylenic alcohol surfactants, such as the SURFYNOLS; (38) alkanolamide surfactants and their alkoxylated derivatives including fatty acid alkanolamides and fatty acid alkanolamide polyglycol ethers; (39) alkylpyrrolidones; (40) alkyl amine oxides, including alkoxylated or polyalkoxylated amine oxides and amine oxides derived from sugars; (41) alkyl phosphine oxides; (42) sulfoxide surfactants; (43) amphoteric sulfonates, especially sulfobetaines; (44) betaine-type amphoterics, including aminocarboxylate-derived types; (45) amphoteric sulfates such as the alkyl ammonio polyethoxysulfates; (46) fatty and petroleum-derived alkylamines and amine salts; (47) alkylimidazolines; (48) alkylamidoamines and their alkoxylate and polyalkoxylate derivatives; and (49) conventional cationic surfactants, including water-soluble alkyltrimethylammonium salts. Moreover, more unusual surfactant types are included, such as: (50) alkylamidoamine oxides, carboxylates and quaternary salts; (51) sugar-derived surfactants modeled after any of the hereinabove-referenced more conventional nonsugar types; (52) fluorosurfactants; (53) biosurfactants; (54) organosilicon or fluorocarbon surfactants; (55) gemini surfactants, other than the above-referenced diphenyl oxide disulfonates, including those derived from glucose; (56) polymeric surfactants including amphopolycarboxyglycinates; and (57) bolaform surfactants; in short any surfactant known for aqueous or non-aqueous cleaning.

In any of the above detersive surfactants, hydrophobe chain length is typically in the general range $C_8$–$C_{20}$,l with chain lengths in the range $C_8$–$C_{18}$ often being preferred, especially when laundering is to be conducted in cool water. Selection of chainlengths and degree of alkoxylation for conventional purposes are taught in the standard texts. When the detersive surfactant is a salt, any compatible cation may be present, including H (that is, the acid or partly acid form of a potentially acidic surfactant may be used), Na, K, Mg, ammonium or alkanolammonium, or combinations of cations. Mixtures of detersive surfactants having different charges are commonly preferred, especially anionic/cationic, anionic/nonionic, anionic/nonionic/cationic, anionic/nonionic/amphoteric, nonionic/cationic and nonionic/amphoteric mixtures. Moreover, any single detersive surfactant may be substituted, often with desirable results for cool water washing, by mixtures of otherwise similar detersive surfactants having differing chainlengths, degree of unsaturation or branching, degree of alkoxylation (especially ethoxylation), insertion of substituents such as ether oxygen atoms in the hydrophobes, or any combinations thereof.

Preferred among the above-identified detersive surfactants are: acid, sodium and ammonium $C_9$–$C_{20}$ linear alkylbenzene sulfonates, particularly sodium linear secondary alkyl $C_{10}$–$C_{15}$ benzenesulfonates though in some regions ABS may be used (1); olefinsulfonate salts, (2), that is, material made by reacting olefins, particularly $C_{10}$–$C_{20}$ α-olefins, with sulfur trioxide and then neutralizing and hydrolyzing the reaction product; sodium and ammonium $C_7$–$C_{12}$ dialkyl sulfosuccinates, (3); alkane monosulfonates, (4), such as those derived by reacting $C_8$–$C_{20}$ α-olefins with sodium bisulfite and those derived by reacting paraffins with $SO_2$ and $C_{12}$ and then hydrolyzing with a base to form a random sulfonate; α-Sulfo fatty acid salts or esters, (10); sodium alkylglycerylsulfonates, (11), especially those ethers of the higher alcohols derived from tallow or coconut oil and synthetic alcohols derived from petroleum; alkyl or alkenyl sulfates, (15), which may be primary or secondary, saturated or unsaturated, branched or unbranched. Such compounds when branched can be random or regular. When secondary, they preferably have formula $CH_3(CH_2)_x(CHOSO_3^-M^+)CH_3$ or $CH_3(CH_2)_y(CHOSO_3^-M^+)CH_2CH_3$ where x and (y+1) are integers of at least 7, preferably at least 9 and M is a water-soluble cation, preferably sodium. When unsaturated, sulfates such as oleyl sulfate are preferred, while the sodium and ammonium alkyl sulfates, especially those produced by sulfating $C_8$–$C_{18}$ alcohols, produced for example from tallow or coconut oil are also useful; also preferred are the alkyl or alkenyl ether sulfates, (16), especially the ethoxy sulphates having about 0.5 moles or higher of ethoxylation, preferably from 0.5–8; the alkylethercarboxylates, (19), especially the EO 1–5 ethoxycarboxylates; soaps or fatty acids (21), preferably the more water-soluble types; aminoacid-type surfactants, (23), such as sarcosinates, especially oleyl sarcosinate; phosphate esters, (26); alkyl or alkylphenol ethoxylates, propoxylates and butoxylates, (30), especially the ethoxylates "AE", including the so-called narrow peaked alkyl ethoxylates and $C_6$–$C_{12}$ alkyl phenol alkoxylates as well as the products of aliphatic primary or secondary linear or branched $C_8$–$C_{18}$ alcohols with ethylene oxide, generally 2–30 EO; N-alkyl polyhydroxy fatty acid amides especially the $C_{12}$–$C_{18}$ N-methylglucamides, (32), see WO 9206154, and N-alkoxy polyhydroxy fatty acid amides, such as $C_{10}$–$C_{18}$ N-(3-methoxypropyl) glucamide while N-propyl through N-hexyl $C_{12}$–$C_{18}$ glucamides can be used for low sudsing; alkyl polyglycosides, (33); amine oxides, (40), preferably alkyldimethylamine N-oxides and their dihydrates; sulfobetaines or "sultaines", (43); betaines (44); and gemini surfactants.

Cationic surfactants suitable for use in the present invention include those having a long-chain hydrocarbyl group. Examples of such cationic co-surfactants include the ammonium co-surfactants such as alkyldimethylammonium halogenides, and those co-surfactants having the formula:

$$[R^2(OR^3)_y][R^4(OR^3)_y]_2R^5N^+X^-$$

wherein $R^2$ is an alkyl or alkyl benzyl group having from 8 to 18 carbon atoms in the alkyl chain, each $R^3$ is selected from the group consisting of —$CH_2CH_2$—, —$CH_2CH(CH_3)$—, —$CH_2CH(CH_2OH)$—, —$CH_2CH_2CH_2$—, and mixtures thereof, each $R^4$ is selected from the group consisting of $C_1$–$C_4$ alkyl, $C_1$–$C_4$ hydroxyalkyl, benzyl ring structures formed by joining the two $R^4$ groups, —$CH_2CHOH$—$CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Examples of other suitable cationic surfactants are described in following documents, all of which are incorporated by reference herein in their entirety: M.C. Publishing Co., McCutcheon's, Detergents & Emulsifiers, (North American edition 1997); Schwartz, et al., Surface Active Agents, Their Chemistry and Technology, New York: Interscience Publishers, 1949; U.S. Pat. Nos. 3,155,591; 3,929,678; 3,959,461 4,387,090 and 4,228,044.

Examples of suitable cationic surfactants are those corresponding to the general formula:

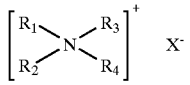

wherein $R_1$, $R_2$, $R_3$, and $R_4$ are independently selected from an aliphatic group of from 1 to about 22 carbon atoms or an aromatic, alkoxy, polyoxyalkylene, alkylamido, hydroxyalkyl, aryl or alkylaryl group having up to about 22 carbon atoms; and X is a salt-forming anion such as those selected from halogen, (e.g. chloride, bromide), acetate, citrate, lactate, glycolate, phosphate nitrate, sulfate, and alkylsulfate radicals. The aliphatic groups can contain, in addition to carbon and hydrogen atoms, ether linkages, and other groups such as amino groups. The longer chain aliphatic groups. e.g., those of about 12 carbons, or higher, can be saturated or unsaturated. Preferred is when $R_1$, $R_2$, $R_3$, and $R_4$ are independently selected from C1 to about C22 alkyl. Especially preferred are cationic materials containing two long alkyl chains and two short alkyl chains or those containing one long alkyl chain and three short alkyl chains. The long alkyl chains in the compounds described in the previous sentence have from about 12 to about 22 carbon atoms, preferably from about 16 to about 22 carbon atoms, and the short alkyl chains in the compounds described in the previous sentence have from 1 to about 3 carbon atoms, preferably from 1 to about 2 carbon atoms.

Suitable levels of cationic detersive surfactant herein are from about 0.1% to about 20%, preferably from about 1% to about 15%, although much higher levels, e.g., up to about 30% or more, may be useful especially in nonionic: cationic (i.e., limited or anionic-free) formulations. Highly preferred compositions however combine the cationic surfactant at a low level, e.g., from about 0.1% to about 5%, preferably not more than about 2%, with the inventive modified alkylbenzene sulfonate surfactant mixtures.

Another type of useful surfactants are the so-called dianionics. These are surfactants which have at least two anionic groups present on the surfactant molecule. Some suitable dianionic surfactants are further described in copending U.S. Serial Nos. 60/020,503, 60/020,772, 60/020,928, 60/020,832 and 60/020,773 all filed on Jun. 28, 1996, and Nos. 60/023,539, 60/023493, 60/023,540 and 60/023,527 filed on Aug. 8th, 1996, the disclosures of which are incorporated herein by reference.

Additionally and preferably, the surfactant may be a branched alkyl sulfate, branched alkyl alkoxylate, or branched alkyl alkoxylate sulfate. These surfactants are further described in No. 60/061,971, Oct. 14, 1997, No. 60/061,975, Oct. 14, 1997, No. 60/062,086, Oct. 14, 1997, No. 60/061,916, Oct. 14, 1997, No. 60/061,970, Oct. 14, 1997, No. 60/062,407, Oct. 14, 1997,. Other suitable mid-chain branched surfactants can be found in U.S. Patent applications Serial Nos. 60/032,035, 60/031,845, 60/031,916, 60/031,917, 60/031,761, 60/031,762 and 60/031,844. Mixtures of these branched surfactants with conventional linear surfactants are also suitable for use in the present compositions.

Suitable levels of anionic detersive surfactants herein are in the range from about 1% to about 50% or higher, preferably from about 2% to about 30%, more preferably still, from about 5% to about 20% by weight of the detergent composition.

Suitable levels of nonionic detersive surfactant herein are from about 1% to about 40%, preferably from about 2% to about 30%, more preferably from about 5% to about 20%.

Desirable weight ratios of anionic:nonionic surfactants in combination include from 1.0:9.0 to 1.0:0.25, preferably 1.0:1.5 to 1.0:0.4.

Desirable weight ratios of anionic:cationic surfactants in combination include from 50:1 to 5:1,more preferably 35:1 to 15:1.

Suitable levels of cationic detersive surfactant herein are from about 0.1% to about 20%, preferably from about 1% to about 15%, although much higher levels, e.g., up to about 30% or more, may be useful especially in nonionic : cationic (i.e., limited or anionic-free) formulations.

Amphoteric or zwitterionic detersive surfactants when present are usually useful at levels in the range from about 0.1% to about 20% by weight of the detergent composition. Often levels will be limited to about 5% or less, especially when the amphoteric is costly.

Detersive Enzymes—Enzymes are preferably included in the present detergent compositions for a variety of purposes, including removal of protein-based, carbohydrate-based, or triglyceride-based stains from substrates, for the prevention of refugee dye transfer in fabric laundering, and for fabric restoration. Recent enzyme disclosures in detergents useful herein include bleach/amylase/protease combinations (EP 755,999 A; EP 756,001 A; EP 756,000 A); chondriotinase (EP 747,469 A); protease variants (WO 96/28566 A; WO 96/28557 A; WO 96/28556 A; WO 96/25489 A); xylanase (EP 709,452 A); keratinase (EP 747,470 A), lipase (GB 2,297,979 A; WO 96/16153 A; WO 96/12004 A; EP 698,659 A; WO 96/16154 A); cellulase (GB 2,294,269 A; WO 96/27649 A; GB 2,303,147 A); thermitase (WO 96/28558 A). More generally, suitable enzymes include proteases, amylases, lipases, cellulases, peroxidases, xylanases, keratinases, chondriotinases; thermitases, cutinases and mixtures thereof of any suitable origin, such as vegetable, animal, bacterial, fungal and yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases. Suitable enzymes are also described in U.S. Pat. Nos. 5,677,272, 5,679,630, 5,703,027, 5,703,034, 5,705,464, 5,707,950, 5,707,951, 5,710,115, 5,710,116, 5,710,118, 5,710,119 and 5,721,202.

"Detersive enzyme", as used herein, means any enzyme having a cleaning, stain removing or otherwise beneficial effect in a laundry, hard surface cleaning or personal care detergent composition. Preferred detersive enzymes are hydrolases such as proteases, amylases and lipases. Preferred enzymes for laundry purposes include, but are not limited to, proteases, cellulases, lipases and peroxidases. Highly preferred are amylases and/or proteases, including both current commercially available types and improved types which, though more and more bleach compatible though successive improvements, have a remaining degree of bleach deactivation susceptibility.

Enzymes are normally incorporated into detergent or detergent additive compositions at levels sufficient to provide a "cleaning-effective amount". The term "cleaning effective amount" refers to any amount capable of producing a cleaning, stain removal, soil removal, whitening, deodorizing, or freshness improving effect on substrates such as fabrics, dishware and the like. In practical terms for current commercial preparations, typical amounts are up to about 5 mg by weight, more typically 0.01 mg to 3 mg, of active enzyme per gram of the detergent composition. Stated otherwise, the compositions herein will typically comprise from 0.001% to 5%, preferably 0.01%–1% by weight of a commercial enzyme preparation. Protease enzymes are usually present in such commercial preparations at levels sufficient to provide from 0.005 to 0.1 Anson units (AU) of activity per gram of composition. For certain detergents it may be desirable to increase the active enzyme content of the commercial preparation in order to minimize the total amount of non-catalytically active materials and thereby improve spotting/filming or other end-results. Higher active levels may also be desirable in highly concentrated detergent formulations.

Suitable examples of proteases are the subtilisins which are obtained from particular strains of *B. subtilis* and *B. licheniformis*. One suitable protease is obtained from a strain of Bacillus, having maximum activity throughout the pH range of 8–12, developed and sold as ESPERASE® by Novo Industries A/S of Denmark, hereinafter "Novo". The preparation of this enzyme and analogous enzymes is described in GB 1,243,784 to Novo. Other suitable proteases include ALCALASE®) and SAVINASE® from Novo and MAXATASE® from International Bio-Synthetics, Inc., The Netherlands; as well as Protease A as disclosed in EP 130,756 A, Jan. 9, 1985 and Protease B as disclosed in EP 303,761 A, Apr. 28, 1987 and EP 130,756 A, Jan. 9, 1985. See also a high pH protease from Bacillus sp. NCIMB 40338 described in WO 9318140 A to Novo. Enzymatic detergents comprising protease, one or more other enzymes, and a reversible protease inhibitor are described in WO 9203529 A to Novo. Other preferred proteases include those of WO 9510591 A to Procter & Gamble . When desired, a protease having decreased adsorption and increased hydrolysis is available as described in WO 9507791 to Procter & Gamble. A recombinant trypsin-like protease for detergents suitable herein is described in WO 9425583 to Novo.

In more detail, an especially preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +15 +206, +210, +216, +217, +218, +222, +260, +265, and/or +274 according to the numbering of *Bacillus amyloliquefaciens* subtilisin, as described in WO 95/10615 published Apr. 20, 1995 by Genencor International.

Useful proteases are also described in PCT publications: WO 95/30010 published Nov. 9, 1995 by The Procter & Gamble Company; WO 95/30011 published Nov. 9, 1995 by The Procter & Gamble Company; WO 95/29979 published Nov. 9, 1995 by The Procter & Gamble Company.

Amylases suitable herein include, for example, α-amylases described in GB 1,296,839 to Novo; RAPIDASE®, International Bio-Synthetics, Inc. and TERMAMYL®, Novo. FUNGAMYL® from Novo is especially useful. Engineering of enzymes for improved stability, e.g., oxidative stability, is known. See, for example J. Biological Chem., Vol. 260, No. 11, June 1985, pp. 6518–6521. Certain preferred embodiments of the present compositions can make use of amylases having improved stability in detergents, especially improved oxidative stability as measured against a reference-point of TERMAMYL® in commercial use in 1993. These preferred amylases herein share the characteristic of being "stability-enhanced" amylases, characterized, at a minimum, by a measurable improvement in one or more of: oxidative stability, e.g., to hydrogen peroxide/tetraacetylethylenediamine in buffered solution at pH 9–10; thermal stability, e.g., at common wash temperatures such as about 60° C.; or alkaline stability, e.g., at a pH from about 8 to about 11, measured versus the above-identified reference-point amylase. Stability can be measured using any of the art-disclosed technical tests. See, for example, references disclosed in WO 9402597. Stability-enhanced amylases can be obtained from Novo or from Genencor International. One class of highly preferred amylases herein have the commonality of being derived using site-directed mutagenesis from one or more of the Bacillus amylases, especially the Bacillus α-amylases, regardless of whether one, two or multiple amylase strains are the immediate precursors. Oxidative stability-enhanced amylases vs. the above-identified reference amylase are preferred for use, especially in bleaching, more preferably oxygen bleaching, as distinct from chlorine bleaching, detergent compositions herein. Such preferred amylases include (a) an amylase according to the hereinbefore incorporated WO 9402597, Novo, Feb. 3, 1994, as further illustrated by a mutant in which substitution is made, using alanine or threonine, preferably threonine, of the methionine residue located in position 197 of the *B. licheniformis* alpha-amylase, known as TERMAMYL®, or the homologous position variation of a similar parent amylase, such as *B. amyloliquefaciens, B. subtilis*, or *B. stearothermophilus*; (b) stability-enhanced amylases as described by Genencor International in a paper entitled "Oxidatively Resistant alpha-Amylases" presented at the 207th American Chemical Society National Meeting, March 13–17 1994, by C. Mitchinson. Therein it was noted that bleaches in automatic dishwashing detergents inactivate alpha-amylases but that improved oxidative stability amylases have been made by Genencor from *B. licheniformis* NCIB8061. Methionine (Met) was identified as the most likely residue to be modified. Met was substituted, one at a time, in positions 8, 15, 197, 256, 304, 366 and 438 leading to specific mutants, particularly important being M197L and M197T with the M197T variant being the most stable expressed variant. Stability was measured in CASCADE® and SUNLIGHT®; (c) particularly preferred amylases herein include amylase variants having additional modification in the immediate parent as described in WO 9510603 A and are available from the assignee, Novo, as DURAMYL®. Other particularly preferred oxidative stability enhanced amylase include those described in WO 9418314 to Genencor International and WO 9402597 to Novo. Any other oxidative stability-enhanced amylase can be used, for example as derived by site-directed mutagenesis from known chimeric, hybrid or simple mutant parent forms of available amylases. Other preferred enzyme modifications are accessible. See WO 9509909 A to Novo.

Other amylase enzymes include those described in WO 95/26397 and in co-pending application by Novo Nordisk PCT/DK96/00056. Specific amylase enzymes for use in the detergent compositions of the present invention include α-amylases characterized by having a specific activity at least 25% higher than the specific activity of Termamyl® at a temperature range of 25° C. to 55° C. and at a pH value in the range of 8 to 10, measured by the Phadebas® α-amylase activity assay. (Such Phadebas® α-amylase activity assay is described at pages 9–10, WO 95/26397.) Also included herein are α-amylases which are at least 80% homologous with the amino acid sequences shown in the SEQ ID listings in the references. These enzymes are preferably incorporated into laundry detergent compositions at a level from 0.00018% to 0.060% pure enzyme by weight of the total composition, more preferably from 0.00024% to 0.048% pure enzyme by weight of the total composition.

Cellulases usable herein include both bacterial and fungal types, preferably having a pH optimum between 5 and 9.5. U.S. Pat. No. 4,435,307, Barbesgoard et al, Mar. 6, 1984, discloses suitable fungal cellulases from Humicola insolens or Humicola strain DSM1800 or a cellulase 212-producing fungus belonging to the genus Aeromonas, and cellulase extracted from the hepatopancreas of a marine mollusk, Dolabella Auricula Solander. Suitable cellulases are also disclosed in GB-A-2.075.028; GB-A-2.095.275 and DE-OS-2.247.832. CAREZYME® and CELLUZYME® (Novo) are especially useful. See also WO 9117243 to Novo.

Suitable lipase enzymes for detergent usage include those produced by microorganisms of the Pseudomonas group, such as *Pseudomonas stutzeri* ATCC 19.154, as disclosed in GB 1,372,034. See also lipases in Japanese Patent Application 53,20487, laid open Feb. 24, 1978. This lipase is available from Amano Pharmaceutical Co. Ltd., Nagoya, Japan, under the trade name Lipase P "Amano, " or "Amano-P." Other suitable commercial lipases include Amano-CES, lipases ex *Chromobacter viscosum,* e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli.* LIPOLASE® enzyme derived from *Humicola lanuginosa* and commercially available from Novo, see also EP 341, 947, is a preferred lipase for use herein. Lipase and amylase variants stabilized against peroxidase enzymes are described in WO 9414951 A to Novo. See also WO 9205249 and RD 94359044.

Cutinase enzymes suitable for use herein are described in WO 8809367 A to Genencor.

Peroxidase enzymes may be used in combination with oxygen sources, e.g., percarbonate, perborate, hydrogen peroxide, etc., for "solution bleaching" or prevention of transfer of dyes or pigments removed from substrates during the wash to other substrates present in the wash solution. Known peroxidases include horseradish peroxidase, ligninase, and haloperoxidases such as chloro- or bromo-peroxidase. Peroxidase-containing detergent compositions are disclosed in WO 89099813 A, Oct. 19, 1989 to Novo and WO 8909813 A to Novo.

A range of enzyme materials and means for their incorporation into synthetic detergent compositions is also disclosed in WO 9307263 A and WO 9307260 A to Genencor International, WO 8908694 A to Novo, and U.S. Pat. No. 3,553,139, Jan. 5, 1971 to McCarty et al. Enzymes are further disclosed in U.S. Pat. No. 4,101,457, Place et al, Jul. 18, 1978, and in U.S. Pat. No. 4,507,219, Hughes, Mar. 26, 1985. Enzyme materials useful for liquid detergent formulations, and their incorporation into such formulations, are disclosed in U.S. Pat. No. 4,261,868, Hora et al, Apr. 14, 1981. Enzymes for use in detergents can be stabilized by various techniques. Enzyme stabilization techniques are disclosed and exemplified in U.S. Pat. No. 3,600,319, Aug. 17, 1971, Gedge et al, EP 199,405 and EP 200,586, Oct. 29, 1986, Venegas. Enzyme stabilization systems are also described, for example, in U.S. Pat. No. 3,519,570. A useful Bacillus, sp. AC13 giving proteases, xylanases and cellulases, is described in WO 9401532 A to Novo.

Builders—Detergent builders are preferably included in the compositions herein, for example to assist in controlling mineral, especially Ca and/or Mg, hardness in wash water or to assist in the removal and/or suspension of particulate soils from surfaces and sometimes to provide alkalinity and/or buffering action. In solid formulations, builders sometimes serve as absorbents for surfactants. Alternately, certain compositions can be formulated with completely water-soluble builders, whether organic or inorganic, depending on the intended use.

Suitable silicate builders include water-soluble and hydrous solid types and including those having chain-, layer-, or three-dimensional-structure as well as amorphous-solid silicates or other types, for example especially adapted for use in non-structured-liquid detergents. Preferred are alkali metal silicates, particularly those liquids and solids having a $SiO_2$:$Na_2O$ ratio in the range 1.6:1 to 3.2:1, including solid hydrous 2-ratio silicates marketed by PQ Corp. under the tradename BRITESIL®, e.g., BRITESIL H2O; and layered silicates, e.g., those described in U.S. Pat. No. 4,664,839, May 12, 1987, H. P. Rieck. NaSKS-6, sometimes abbreviated "SKS-6", is a crystalline layered aluminum-free $\delta$-$Na_2SiO_5$ morphology silicate marketed by Hoechst and is preferred especially in granular laundry compositions. See preparative methods in German DE-A-3,417,649 and DE-A-3,742,043. Other layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0, can also or alternately be used herein. Layered silicates from Hoechst also include NaSKS-5, NaSKS-7 and NaSKS-11, as the $\alpha$, $\beta$, and $\gamma$ layer-silicate forms. Other silicates may also be useful, such as magnesium silicate, which can serve as a crispening agent in granules, as a stabilizing agent for bleaches, and as a component of suds control systems.

Also suitable for use herein are synthesized crystalline ion exchange materials or hydrates thereof having chain structure and a composition represented by the following general formula in an anhydride form: $xM_2O_y.SiO_2.zM'O$ wherein M is Na and/or K, M' is Ca and/or Mg; y/x is 0.5 to 2.0 and z/x is 0.005 to 1.0 as taught in U.S. Pat. No. 5,427,711, Sakaguchi et al, Jun. 27, 1995.

Aluminosilicate builders, such as zeolites, are especially useful in granular detergents, but can also be incorporated in liquids, pastes of gels. Suitable for the present purposes are those having empirical formula: $[M_z(AlO_2)_z(SiO_2)_v].xH_2O$ wherein z and v are integers of at least 6, M is an alkali metal, preferably Na and/or K, the molar ratio of z to v is in the range from 1.0 to 0.5, and x is an integer from 15 to 264. Aluminosilicates can be crystalline or amorphous, naturally-occurring or synthetically derived. An aluminosilicate production method is in U.S. Pat. No. 3,985,669, Krummel, et al, Oct. 12, 1976. Preferred synthetic crystalline aluminosilicate ion exchange materials are available as Zeolite A, Zeolite P (B), Zeolite X and, to whatever extent this differs from Zeolite P, the so-called Zeolite MAP. Natural types, including clinoptilolite, may be used. Zeolite A has the formula: $Na_{12}[(AlO_2)_{12}(SiO_2)_{12}].xH_2O$ wherein x is from 20 to 30, especially 27. Dehydrated zeolites (x=0–10) may also be used. Preferably, the aluminosilicate has a particle size of 0.1–10 microns in diameter.

Detergent builders in place of or in addition to the silicates and aluminosilicates described hereinbefore can optionally be included in the compositions herein, for example to assist in controlling mineral, especially Ca and/or Mg, hardness in wash water or to assist in the removal of particulate soils from surfaces. Builders can operate via a variety of mechanisms including forming soluble or insoluble complexes with hardness ions, by ion exchange, and by offering a surface more favorable to the precipitation of hardness ions than are the surfaces of articles to be cleaned. Builder level can vary widely depending upon end use and physical form of the composition. Built detergents typically comprise at least about 1% builder. Liquid formulations typically comprise about 5% to about 50%, more typically 5% to 35% of builder. Granular formulations typically comprise from about 10% to about 80%, more typically 15% to 50% builder by weight of the detergent composition. Lower or higher levels of builders are not excluded. For example, certain detergent additive or high-surfactant formulations can be unbuilt.

Suitable builders herein can be selected from the group consisting of phosphates and polyphosphates, especially the sodium salts; carbonates, bicarbonates, sesquicarbonates and carbonate minerals other than sodium carbonate or sesquicarbonate; organic mono-, di-, tri-, and tetracarboxylates especially water-soluble nonsurfactant carboxylates in acid, sodium, potassium or alkanolammonium salt form, as well as oligomeric or water-soluble low molecular weight polymer carboxylates including aliphatic and aromatic types; and phytic acid. These may be complemented by borates, e.g., for pH-buffering purposes, or by sulfates, especially sodium sulfate and any other fillers or carriers which may be important to the engineering of stable surfactant and/or builder-containing detergent compositions.

Builder mixtures, sometimes termed "builder systems" can be used and typically comprise two or more conventional builders, optionally complemented by chelants, pH-buffers or fillers, though these latter materials are generally accounted for separately when describing quantities of materials herein. In terms of relative quantities of surfactant and builder in the present detergents, preferred builder systems are typically formulated at a weight ratio of surfactant to builder of from about 60:1 to about 1:80. Certain preferred laundry detergents have said ratio in the range 0.90:1.0 to 4.0:1.0, more preferably from 0.95:1.0 to 3.0:1.0.

P-containing detergent builders often preferred where permitted by legislation include, but are not limited to, the alkali metal, ammonium and alkanolammonium salts of polyphosphates exemplified by the tripolyphosphates, pyrophosphates, glassy polymeric meta-phosphates; and phosphonates.

Suitable carbonate builders include alkaline earth and alkali metal carbonates as disclosed in German Patent Application No. 2,321,001 published on Nov. 15, 1973, although sodium bicarbonate, sodium carbonate, sodium sesquicarbonate, and other carbonate minerals such as trona or any convenient multiple salts of sodium carbonate and calcium carbonate such as those having the composition $2Na_2CO_3.CaCO_3$ when anhydrous, and even calcium carbonates including calcite, aragonite and vaterite, especially forms having high surface areas relative to compact calcite may be useful, for example as seeds or for use in synthetic detergent bars.

Suitable "organic detergent builders", as described herein for use in the cleaning compositions include polycarboxylate compounds, including water-soluble nonsurfactant dicarboxylates and tricarboxylates. More typically builder polycarboxylates have a plurality of carboxylate groups, preferably at least 3 carboxylates. Carboxylate builders can be formulated in acid, partially neutral, neutral or overbased form. When in salt form, alkali metals, such as sodium, potassium, and lithium, or alkanolammonium salts are preferred. Polycarboxylate builders include the ether polycarboxylates, such as oxydisuccinate, see Berg, U.S. Pat. No. 3,128,287, Apr. 7, 1964, and Lamberti et al, U.S. Pat. No. 3,635,830, Jan. 18, 1972; "TMS/TDS" builders of U.S. Pat. No. 4,663,071, Bush et al, May 5, 1987; and other ether carboxylates including cyclic and alicyclic compounds, such as those described in U.S. Pat. Nos. 3,923,679; 3,835,163; 4,158,635; 4,120,874 and 4,102,903.

Other suitable organic detergent builders are the ether hydroxypolycarboxylates, copolymers of maleic anhydride with ethylene or vinyl methyl ether; 1,3,5-trihydroxy benzene-2,4,6-trisulphonic acid; carboxymethyloxysuccinic acid; the various alkali metal, ammonium and substituted ammonium salts of polyacetic acids such as ethylenediamine tetraacetic acid and nitrilotriacetic acid; as well as mellitic acid, succinic acid, polymaleic acid, benzene 1,3,5-tricarboxylic acid, carboxymethyloxysuccinic acid, and soluble salts thereof.

Citrates, e.g., citric acid and soluble salts thereof are important carboxylate builders e.g., for heavy duty liquid detergents, due to availability from renewable resources and biodegradability. Citrates can also be used in granular compositions, especially in combination with zeolite and/or layered silicates. Oxydisuccinates are also especially useful in such compositions and combinations.

Where permitted, and especially in the formulation of bars used for hand-laundering operations, alkali metal phosphates such as sodium tripolyphosphates, sodium pyrophosphate and sodium orthophosphate can be used. Phosphonate builders such as ethane-1-hydroxy-1,1-diphosphonate and other known phosphonates, e.g., those of U.S. Pat. Nos. 3,159,581; 3,213,030; 3,422,021; 3,400,148 and 3,422,137 can also be used and may have desirable antiscaling properties.

Certain detersive surfactants or their short-chain homologues also have a builder action. For unambiguous formula accounting purposes, when they have surfactant capability, these materials are summed up as detersive surfactants. Preferred types for builder functionality are illustrated by: 3,3-dicarboxy-4-oxa-1,6-hexanedioates and the related compounds disclosed in U.S. Pat. No. 4,566,984, Bush, Jan. 28, 1986. Succinic acid builders include the $C_5$–$C_{20}$ alkyl and alkenyl succinic acids and salts thereof. Succinate builders also include: laurylsuccinate, myristylsuccinate, palmitylsuccinate, 2-dodecenylsuccinate (preferred), 2-pentadecenylsuccinate, and the like. Lauryl-succinates are described in European Patent Application 86200690.5/0, 200,263, published Nov. 5, 1986. Fatty acids, e.g., $C_{12}$–$C_{18}$ monocarboxylic acids, can also be incorporated into the compositions as surfactant/builder materials alone or in combination with the aforementioned builders, especially citrate and/or the succinate builders, to provide additional builder activity. Other suitable polycarboxylates are disclosed in U.S. Pat. No. 4,144,226, Crutchfield et al, Mar. 13, 1979 and in U.S. Pat. No. 3,308,067, Diehl, Mar. 7, 1967. See also Diehl, U.S. Pat. No. 3,723,322.

Other types of inorganic builder materials which can be used have the formula $(M_x)_iCa_y(CO_3)_z$ wherein x and i are integers from 1 to 15, y is an integer from 1 to 10, z is an integer from 2 to 25, $M_i$ are cations, at least one of which is a water-soluble, and the equation $\Sigma_i$=1–15($x_i$ multiplied by the valence of $M_i$)+2y=2z is satisfied such that the formula has a neutral or "balanced" charge. These builders are referred to herein as "Mineral Builders", examples of these builders, their use and preparation can be found in U.S. Pat. No. 5,707,959. Another suitable class of inorganic builders are the Magnesiosilicates, see WO97/0179.

Oxygen Bleaching Agents

Cleaning compositions of the present invention preferably may comprise, as part or all of the conventional adjunct materials, an "oxygen bleaching agent". Oxygen bleaching agents useful in the present invention can be any of the oxidizing agents known for laundry, hard surface cleaning, automatic dishwashing or denture cleaning purposes. Oxygen bleaches or mixtures thereof are preferred, though other oxidant bleaches, such as an enzymatic hydrogen peroxide producing system, or hypohalites such as chlorine bleaches like hypochlorite, may also be used. Oxygen bleaching "systems" in general contain two or more materials contributing to oxygen bleaching, commonly a source of oxygen bleach, such as perborate or even oxygen from the air, and a catalyst and/or a bleach activator Common oxygen bleaches of the peroxygen type include hydrogen peroxide, inorganic peroxohydrates, organic peroxohydrates and the organic peroxyacids, including hydrophilic and hydrophobic mono- or di-peroxyacids. These can be peroxycarboxylic acids, peroxyimidic acids, amidoperoxycarboxylic acids, or their salts including the calcium, magnesium, or mixed-cation salts. Peracids of various kinds can be used both in free form and as precursors known as "bleach activators" or "bleach promoters" which, when combined with a source of hydrogen peroxide, perhydrolyze to release the corresponding peracid.

Also useful herein as oxygen bleaches are the inorganic peroxides such as $Na_2O_2$, superoxides such as $KO_2$, organic hydroperoxides such as cumene hydroperoxide and t-butyl hydroperoxide, and the inorganic peroxoacids and their salts such as the peroxosulfuric acid salts, especially the potassium salts of peroxodisulfuric acid and, more preferably, of peroxomonosulfuric acid including the commercial triple-salt form sold as OXONE by DuPont and also any equivalent commercially available forms such as CUROX from Akzo or CAROAT from Degussa. Certain organic peroxides, such as dibenzoyl peroxide, may be useful, especially as additives rather than as primary oxygen bleach.

Mixed oxygen bleach systems are generally useful, as are mixtures of any oxygen bleaches with the known bleach activators, organic catalysts, enzymatic catalysts and mixtures thereof; moreover such mixtures may further include brighteners, photobleaches and dye transfer inhibitors of types well-known in the art.

Preferred oxygen bleaches, as noted, include the peroxohydrates, sometimes known as peroxyhydrates or peroxohydrates. These are organic or, more commonly, inorganic salts capable of releasing hydrogen peroxide readily. Peroxohydrates are the most common examples of "hydrogen peroxide source" materials and include the perborates, percarbonates, perphosphates, and persilicates. Suitable peroxohydrates include sodium carbonate peroxyhydrate and equivalent commercial "percarbonate" bleaches, and any of the so-called sodium perborate hydrates, the "tetrahydrate" and "monohydrate" being preferred; though sodium pyrophosphate peroxyhydrate can be used. Many such peroxohydrates are available in processed forms with coatings, such as of silicate and/or borate and/or waxy materials and/or surfactants, or have particle geometries, such as compact spheres, which improve storage stability. By way of organic peroxohydrates, urea peroxyhydrate can also be useful herein.

Percarbonate bleach includes, for example, dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Percarbonates and perborates are widely available in commerce, for example from FMC, Solyay and Tokai Denka.

Organic percarboxylic acids useful herein as the oxygen bleach include magnesium monoperoxyphthalate hexahydrate, available from Interox, m-chloro perbenzoic acid and its salts, 4-nonylamino-4-oxoperoxybutyric acid and diperoxydodecanedioic acid and their salts. Such bleaches are disclosed in U.S. Pat. No. 4,483,781, U.S. patent application Ser. No. 740,446, Bums et al, filed Jun. 3, 1985, EP-A 133,354, published Feb. 20, 1985, and U.S. Pat. No. 4,412,934. Organic percarboxylic acids usable herein include those containing one, two or more peroxy groups, and can be aliphatic or aromatic. Highly preferred oxygen bleaches also include 6-nonylamino-6-oxoperoxycaproic acid (NAPAA) as described in U.S. Pat. No. 4,634,551.

An extensive and exhaustive listing of useful oxygen bleaches, including inorganic peroxohydrates, organic peroxohydrates and the organic peroxyacids, including hydrophilic and hydrophobic mono- or di-peroxyacids, peroxycarboxylic acids, peroxyimidic acids, amidoperoxycarboxylic acids, or their salts including the calcium, magnesium, or mixed-cation salts, can be found in U.S. Pat. Nos. 5,622,646 and 5,686,014.

Other useful pcracids and bleach activators herein are in the family of imidoperacids and imido bleach activators. These include phthaloylimidoperoxycaproic acid and related arylimido-substituted and acyloxynitrogen derivatives. For listings of such compounds, preparations and their incorporation into laundry compositions including both granules and liquids, See U.S. Pat. Nos. 5,487,818; 5,470,988, 5,466,825; 5,419,846; 5,415,796; 5,391,324; 5,328,634; 5,310,934; 5,279,757; 5,246,620; 5,245,075; 5,294,362; 5,423,998; 5,208,340; 5,132,431 and 5,087385.

Useful diperoxyacids include, for example, 1,12-diperoxydodecanedioic acid (DPDA); 1,9-diperoxyazelaic acid; diperoxybrassilic acid; diperoxysebasic acid and diperoxyisophthalic acid; 2-decyldiperoxybutane-1,4-dioic acid; and 4,4'-sulphonylbisperoxybenzoic acid.

More generally, the terms "hydrophilic" and "hydrophobic" used herein in connection with any of the oxygen bleaches, especially the peracids, and in connection with bleach activators, are in the first instance based on whether a given oxygen bleach effectively performs bleaching of fugitive dyes in solution thereby preventing fabric graying and discoloration and/or removes more hydrophilic stains such as tea, wine and grape juice—in this case it is termed "hydrophilic". When the oxygen bleach or bleach activator has a significant stain removal, whiteness-improving or cleaning effect on dingy, greasy, carotenoid, or other hydrophobic soils, it is termed "hydrophobic". The terms are applicable also when referring to peracids or bleach activators used in combination with a hydrogen peroxide source. The current commercial benchmarks for hydrophilic performance of oxygen bleach systems are: TAED or peracetic acid, for benchmarking hydrophilic bleaching. NOBS or NAPAA are the corresponding benchmarks for hydrophobic bleaching. The terms "hydrophilic", "hydrophobic" and "hydrotropic" with reference to oxygen bleaches including peracids and here extended to bleach activator have also been used somewhat more narrowly in the literature. See especially Kirk Othmer's Encyclopedia of Chemical Technology, Vol. 4., pages 284–285. This reference provides a chromatographic retention time and critical micelle concentration-based set of criteria, and is useful to identify and/or characterize preferred sub-classes of hydrophobic, hydrophilic and hydrotropic oxygen bleaches and bleach activators that can be used in the present invention.

Bleach Activators

Bleach activators useful herein include amides, imides, esters and anhydrides. Commonly at least one substituted or unsubstituted acyl moiety is present, covalently connected to a leaving group as in the structure R—C(O)—L. In one preferred mode of use, bleach activators are combined with a source of hydrogen peroxide, such as the perborates or percarbonates, in a single product. Conveniently, the single product leads to in situ production in aqueous solution (i.e., during the washing process) of the percarboxylic acid corresponding to the bleach activator. The product itself can be hydrous, for example a powder, provided that water is controlled in amount and mobility such that storage stability is acceptable. Alternately, the product can be an anhydrous solid or liquid. In another mode, the bleach activator or oxygen bleach is incorporated in a pretreatment product, such as a stain stick; soiled, pretreated substrates can then be exposed to further treatments, for example of a hydrogen peroxide source. With respect to the above bleach activator structure RC(O)L, the atom in the leaving group connecting to the peracid-forming acyl moiety R(C)O— is most typically O or N. Bleach activators can have non-charged, positively or negatively charged peracid-forming moieties and/or noncharged, positively or negatively charged leaving groups. One or more peracid-forming moieties or leaving-groups can be present. See, for example, U.S. Pat. Nos.

5,595,967, 5,561,235, 5,560,862 or the bis-(peroxycarbonic) system of U.S. Pat. No. 5,534,179. Mixtures of suitable bleach activators can also be used. Bleach activators can be substituted with electron-donating or electron-releasing moieties either in the leaving-group or in the peracid-forming moiety or moieties, changing their reactivity and making them more or less suited to particular pH or wash conditions. For example, electron-withdrawing groups such as $NO_2$ improve the efficacy of bleach activators intended for use in mild-pH (e.g., from about 7.5—to about 9.5) wash conditions.

An extensive and exhaustive disclosure of suitable bleach activators and suitable leaving groups, as well as how to determine suitable activators, can be found in U.S. Pat. Nos. 5,686,014 and 5,622,646.

Cationic bleach activators include quaternary carbamate-, quaternary carbonate-, quaternary ester- and quaternary amide-types, delivering a range of cationic peroxyimidic, peroxycarbonic or peroxycarboxylic acids to the wash. An analogous but non-cationic palette of bleach activators is available when quaternary derivatives are not desired. In more detail, cationic activators include quaternary ammonium-substituted activators of WO 96–06915, U.S. Pat. Nos. 4,751,015 and 4,397,757, EP-A-284292, EP-A-331,229 and EP-A-03520. Also useful are cationic nitriles as disclosed in EP-A-303,520 and in European Patent Specification 458,396 and 464,880. Other nitrile types have electron-withdrawing substituents as described in U.S. Pat. No. 5,591,378.

Other bleach activator disclosures include GB 836,988; 864,798; 907,356; 1,003,310 and 1,519,351; German Patent 3,337,921; EP-A-0185522; EP-A-0174132; EP-A-0120591; U.S. Pat. Nos. 1,246,339; 3,332,882; 4,128,494; 4,412,934 and 4,675,393, and the phenol sulfonate ester of alkanoyl aminoacids disclosed in U.S. Pat. No. 5,523,434. Suitable bleach activators include any acetylated diamine types, whether hydrophilic or hydrophobic in character.

Of the above classes of bleach precursors, preferred classes include the esters, including acyl phenol sulfonates, acyl alkyl phenol sulfonates or acyl oxybenzenesulfonates (OBS leaving-group); the acyl-amides; and the quaternary ammonium substituted peroxyacid precursors including the cationic nitriles.

Preferred bleach activators include N,N,N'N'-tetraacetyl ethylene diamine (TAED) or any of its close relatives including the triacetyl or other unsymmetrical derivatives. TAED and the acetylated carbohydrates such as glucose pentaacetate and tetraacetyl xylose are preferred hydrophilic bleach activators. Depending on the application, acetyl triethyl citrate, a liquid, also has some utility, as does phenyl benzoate.

Preferred hydrophobic bleach activators include sodium nonanoyloxybenzene sulfonate (NOBS or SNOBS), N-(alkanoyl)aminoalkanoyloxy benzene sulfonates, such as 4-[N-(nonanoyl)aminohexanoyloxy]-benzene sulfonate or (NACA-OBS) as described in U.S. Pat. No. 5,534,642 and in EPA 0 355 384 A1, substituted amide types described in detail hereinafter, such as activators related to NAPAA, and activators related to certain imidoperacid bleaches, for example as described in U.S. Pat. No. 5,061,807, issued Oct. 29, 1991 and assigned to Hoechst Aktiengesellschaft of Frankfurt, Germany and Japanese Laid-Open Patent Application (Kokai) No. 4-28799.

Another group of peracids and bleach activators herein are those derivable from acyclic imidoperoxycarboxylic acids and salts thereof, See U.S. Pat. No. 5415796, and cyclic imidoperoxycarboxylic acids and salts thereof, see U.S. Pat. Nos. 5,061,807, 5,132,431, 5,6542,69, 5,246,620, 5,419,864 and 5,438,147.

Other suitable bleach activators include sodium-4-benzoyloxy benzene sulfonate (SBOBS); sodium-1-methyl-2-benzoyloxy benzene-4-sulphonate; sodium-4-methyl-3-benzoyloxy benzoate (SPCC); trimethyl ammonium toluyloxy-benzene sulfonate; or sodium 3,5,5-trimethyl hexanoyloxybenzene sulfonate (STHOBS).

Bleach activators may be used in an amount of up to 20%, preferably from 0.1–10% by weight, of the composition, though higher levels, 40% or more, are acceptable, for example in highly concentrated bleach additive product forms or forms intended for appliance automated dosing.

Highly preferred bleach activators useful herein are amide-substituted and an extensive and exhaustive disclosure of these activators can be found in U.S. Pat. Nos. 5,686,014 and 5,622,646.

Other useful activators, disclosed in U.S. Pat. No. 4,966,723, are benzoxazin-type, such as a $C_6H_4$ ring to which is fused in the 1,2-positions a moiety —C(O)OC($R^1$)═N—. A highly preferred activator of the benzoxazin-type is:

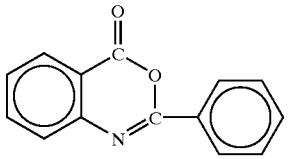

Depending on the activator and precise application, good bleaching results can be obtained from bleaching systems having with in-use pH of from about 6 to about 13, preferably from about 9.0 to about 10.5. Typically, for example, activators with electron-withdrawing moieties are used for near-neutral or sub-neutral pH ranges. Alkalis and buffering agents can be used to secure such pH.

Acyl lactam activators are very useful herein, especially the acyl caprolactams (see for example WO 94–28102 A) and acyl valerolactams (see U.S. Pat. No. 5,503,639). See also U.S. Pat. No. 4,545,784 which discloses acyl caprolactams, including benzoyl caprolactam adsorbed into sodium perborate. In certain preferred embodiments of the invention, NOBS, lactam activators, imide activators or amide-functional activators, especially the more hydrophobic derivatives, are desirably combined with hydrophilic activators such as TAED, typically at weight ratios of hydrophobic activator: TAED in the range of 1:5 to 5:1, preferably about 1:1. Other suitable lactam activators are alpha-modified, see WO 96–22350 A1, Jul. 25, 1996. Lactam activators, especially the more hydrophobic types, are desirably used in combination with TAED, typically at weight ratios of amido-derived or caprolactam activators: TAED in the range of 1:5 to 5:1, preferably about 1:1. See also the bleach activators having cyclic amidine leaving-group disclosed in U.S. Pat. No. 5,552,556.

Nonlimiting examples of additional activators useful herein are to be found in U.S. Pat. Nos. 4,915,854, 4,412,934 and 4,634,551. The hydrophobic activator nonanoyloxybenzene sulfonate (NOBS) and the hydrophilic tetraacetyl ethylene diamine (TAED) activator are typical, and mixtures thereof can also be used.

Additional activators useful herein include those of U.S. Pat. No. 5,545,349, which is also incorporated herein by reference.

Transition Metal Bleach Catalysts

If desired, the bleaching compounds can be catalyzed by means of a manganese compound. Such compounds are well known in the art and include, for example, the manganese-based catalysts disclosed in U.S. Pat. Nos. 5,246,621, 5,244,594; 5,194,416; 5,114,606; European Pat. App. Pub. Nos. 549,271A1, 549,272A1, 544,440A2, 544,490A1; and PCT applications PCT/IB98/00298, PCT/IB98/00299, PCT/IB98100300, and PCT/IB98/00302; Preferred examples of these catalysts include $Mn^{IV}_2(u\text{-}O)_3$(1,4,7-trimethyl-1,4,7-triazacyclononane)$_2(PF_6)_2$, $Mn^{III}_2(u\text{-}O)_1(u\text{-}OAc)_2$(1,4,7-trimethyl-1,4,7-triazacyclononane)$_2(ClO_4)_2$, $Mn^{IV}_4(u\text{-}O)_6$(1,4,7-triazacyclononane)$_4(ClO_4)_4$, $Mn^{III}\text{-}Mn^{IV}_4(u\text{-}O)_1(u\text{-}OAc)_2$-(1,4,7-trimethyl-1,4,7-triazacyclononane)$_2(ClO_4)_3$, $Mn^{IV}$(1,4,7-trimethyl-1,4,7-triazacyclononane)-$(OCH_3)_3(PF_6)$, and mixtures thereof. Other metal-based bleach catalysts include those disclosed in U.S. Pat. Nos. 4,430,243, 5,114,611 5,622,646 and 5,686,014. The use of manganese with various complex ligands to enhance bleaching is also reported in the following U.S. Pat. Nos. 4,728,455; 5,284,944; 5,246,612; 5,256,779; 5,280,117; 5,274,147; 5,153,161; and 5,227,084.

Cobalt bleach catalysts useful herein are known, and are described, for example, in M. L. Tobe, "Base Hydrolysis of Transition-Metal Complexes", *Adv. Inorg. Bioinorg. Mech.,* (1983), 2, pages 1–94. The most preferred cobalt catalyst useful herein are cobalt pentaamine acetate salts having the formula $[Co(NH_3)_5OAc]T_y$, wherein "OAc" represents an acetate moiety and "$T_y$" is an anion, and especially cobalt pentaamine acetate chloride, $[Co(NH_3)_5OAc]Cl_2$; as well as $[Co(NH_3)_5OAc](OAc)_2$; $[Co(NH_3)_5OAc](PF_6)_2$; $[Co(NH_3)_5OAc](SO_4)$; $[Co(NH_3)_5OAc](BF_4)_2$; and $[Co(NH_3)_5OAc](NO_3)_2$ (herein "PAC"). These cobalt catalysts are readily prepared by known procedures, such as taught for example in the Tobe article and the references cited therein, and in U.S. Pat. No. 4,810,410, to Diakun et al, issued Mar. 7, 1989.

Compositions herein may also suitably include as a bleach catalyst the class of transition metal complexes of a macropolycyclic rigid ligand. The phrase "macropolycyclic rigid ligand" is sometimes abbreviated as "MRL". One useful MRL is [MnByclamCl2], where "Bcyclam" is (5,12-dimethyl-1,5,8,12-tetraaza-bicyclo[6.6.2]hexadecane). See PCT applications PCT/IB98/00298, PCT/IB98/00299, PCT/IB98/00300, and PCT/IB98/00302. The amount used is a catalytically effective amount, suitably about 1 ppb or more, for example up to about 99.9%, more typically about 0.001 ppm or more, preferably from about 0.05 ppm to about 500 ppm (wherein "pp" denotes parts per billion by weight and "ppm" denotes parts per million by weight).

As a practical matter, and not by way of limitation, the compositions and cleaning processes herein can be adjusted to provide on the order of at least one part per hundred million of the active bleach catalyst species in the aqueous washing medium, and will preferably provide from about 0.01 ppm to about 25 ppm, more preferably from about 0.05 ppm to about 10 ppm, and most preferably from about 0.1 ppm to about 5 ppm, of the bleach catalyst species in the wash liquor. In order to obtain such levels in the wash liquor of an automatic washing process, typical compositions herein will comprise from about 0.0005% to about 0.2%, more preferably from about 0.004% to about 0.08%, of bleach catalyst, especially manganese or cobalt catalysts, by weight of the cleaning compositions.

Enzymatic Sources of Hydrogen Peroxide

On a different track from the bleach activators illustrated hereinabove, another suitable hydrogen peroxide generating system is a combination of a $C_1$–$C_4$ alkanol oxidase and a $C_1$–$C_4$ alkanol, especially a combination of methanol oxidase (MOX) and ethanol. Such combinations are disclosed in WO 94/03003. Other enzymatic materials related to bleaching, such as peroxidases, haloperoxidases, oxidases, superoxide dismutases, catalases and their enhancers or, more commonly, inhibitors, may be used as optional ingredients in the instant compositions.

Oxygen Transfer Agents and Precursors

Also useful herein are any of the known organic bleach catalysts, oxygen transfer agents or precursors therefor. These include the compounds themselves and/or their precursors, for example any suitable ketone for production of dioxiranes and/or any of the hetero-atom containing analogs of dioxirane precursors or dioxiranes, such as sulfonimines $R^1R^2C{=}NSO_2R^3$, see EP 446 982 A, published 1991 and sulfonyloxaziridines, see EP 446,981 A, published 1991. Preferred examples of such materials include hydrophilic or hydrophobic ketones, used especially in conjunction with monoperoxysulfates to produce dioxiranes in situ, and/or the imines described in U.S. Pat. No. 5,576,282 and references described therein. Oxygen bleaches preferably used in conjunction with such oxygen transfer agents or precursors include percarboxylic acids and salts, percarbonic acids and salts, peroxymonosulfuric acid and salts, and mixtures thereof. See also U.S. Pat. Nos. 5,360,568; 5,360,569; 5,370,826 and 5,442,066.

Although oxygen bleach systems and/or their precursors may be susceptible to decomposition during storage in the presence of moisture, air (oxygen and/or carbon dioxide) and trace metals (especially rust or simple salts or colloidal oxides of the transition metals) and when subjected to light, stability can be improved by adding common sequestrants (chelants) and/or polymeric dispersants and/or a small amount of antioxidant to the bleach system or product. See, for example, U.S. Pat. No. 5,545,349. Antioxidants are often added to detergent ingredients ranging from enzymes to surfactants. Their presence is not necessarily inconsistent with use of an oxidant bleach; for example, the introduction of a phase barrier may be used to stabilize an apparently incompatible combination of an enzyme and antioxidant, on one hand, and an oxygen bleach, on the other. Although commonly known substances can be used as antioxidants, For example see U.S. Pat. Nos. 5,686,014, 5,622,646, 5,055,218, 4,853,143, 4,539,130 and 4,483,778. Preferred antioxidants are 3,5-di-tert-butyl-4-hydroxytoluene, 2,5-di-tert-butylhydroquinone and D,L-alpha-tocopherol.

Polymeric Soil Release Agent—The compositions according to the present invention may optionally comprise one or more soil release agents. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of the laundry cycle and , thus, serve as an anchor for the hydrophilic segments. This can enable stains occurring subsequent to treatment with the soil release agent to be more easily cleaned in later washing procedures.

If utilized, soil release agents will generally comprise from about 0.01% to about 10% preferably from about 0.1% to about 5%, more preferably from about 0.2% to about 3% by weight, of the composition.

The following, all included herein by reference, describe soil release polymers suitable for us in the present invention. U.S. Pat. No. 5,691,298 Gosselink et al., issued Nov. 25, 1997; U.S. Pat. No. 5,599,782 Pan et al., issued Feb. 4, 1997; U.S. Pat. No. 5,415,807 Gosselink et al., issued May 16, 1995; U.S. Pat. No. 5,182,043 Morrall et al., issued Jan. 26, 1993; U.S. Pat. No. 4,956,447 Gosselink et al., issued Sep. 11, 1990; U.S. Pat. No. 4,976,879 Maldonado et al. issued Dec. 11, 1990; U.S. Pat. No. 4,968,451 Scheibel et al., issued Nov. 6, 1990; U.S. Pat. No. 4,925,577 Borcher, Sr. et al., issued May 15, 1990; U.S. Pat. No. 4,861,512 Gosselink, issued Aug. 29, 1989; U.S. Pat. No. 4,877,896 Maldonado et al., issued Oct. 31, 1989; U.S. 4,702,857 Gosselink et al., issued Oct. 27, 1987; U.S. Pat. No. 4,711,730 Gosselink et al., issued Dec. 8, 1987; U.S. Pat. No. 4,721,580 Gosselink issued Jan. 26, 1988; U.S. Pat. No. 4,000,093 Nicol et al., issued Dec. 28, 1976; U.S. Pat. No. 3,959,230 Hayes, issued May 25, 1976; U.S. Pat. No. 3,893,929 Basadur, issued Jul. 8, 1975; and European Patent Application 0 219 048, published Apr. 22, 1987 by Kud et al.

Further suitable soil release agents are described in U.S. Pat. No. 4,201,824 Voilland et al.; U.S. Pat. No. 4,240,918 Lagasse et al.; U.S. Pat. No. 4,525,524 Tung et al.; U.S. Pat. No. 4,579,681 Ruppert et al.; U.S. Pat. Nos. 4,220,918; 4,787,989; EP 279,134 A, 1988 to Rhone-Poulenc Chemie; EP 457,205 A to BASF (1991); and DE 2,335,044 to Unilever N.V., 1974; all incorporated herein by reference.

Clay Soil Removal/Anti-redeposition Agents—The compositions of the present invention can also optionally contain water-soluble ethoxylated amines having clay soil removal and antiredeposition properties. Granular detergent compositions which contain these compounds typically contain from about 0.01% to about 10.0% by weight of the water-soluble ethoxylated amines; liquid detergent compositions typically contain about 0.01% to about 5%.

A preferred soil release and anti-redeposition agent is ethoxylated tetraethylene pentamine. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. See U.S. Pat. No. 4,891,160, VanderMeer, issued Jan. 2, 1990 and WO 95/32272, published Nov. 30, 1995. Another type of preferred antiredeposition agent includes the carboxy methyl cellulose (CMC) materials. These materials are well known in the art.

Polymeric Dispersing Agents—Polymeric dispersing agents can advantageously be utilized at levels from about 0.1% to about 7%, by weight, in the compositions herein, especially in the presence of zeolite and/or layered silicate builders. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release, peptization, and anti-redeposition.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from about 500 to about 100,000, preferably from about 1,000 to about 50,000, more preferably from about 1,500 to about 10,000.

Polyaspartate and polyglutamate dispersing agents may also be used, especially in conjunction with zeolite builders. Dispersing agents such as polyaspartate preferably have a molecular weight (avg.) of about 10,000.

Other polymer types which may be more desirable for biodegradability, improved bleach stability, or cleaning purposes include various terpolymers and hydrophobically modified copolymers, including those marketed by Rohm & Haas, BASF Corp., Nippon Shokubai and others for all manner of water-treatment, textile treatment, or detergent applications.

Brightener—Any optical brighteners or other brightening or whitening agents known in the art can be incorporated at levels typically from about 0.01% to about 1.2%, by weight, into the detergent compositions herein when they are designed for fabric washing or treatment.

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Arctic White CC and Arctic White CWD, the 2-(4-styryl-phenyl)-2H-naptho[1,2-d] triazoles; 4,4'-bis-(1,2,3-triazol-2-yl)-stilbenes; 4,4'-bis (styryl)bisphenyls; and the aminocoumarins. Specific examples of these brighteners include 4-methyl-7-diethyl-amino coumarin; 1,2-bis(benzimidazol-2-yl)ethylene; 1,3-diphenyl-pyrazolines; 2,5-bis(benzoxazol-2-yl)thiophene; 2-styryl-naptho[1,2-d]oxazole; and 2-(stilben-4-yl)-2H-naphtho[1,2-d]triazole. See also U.S. Pat. No. 3,646,015, issued Feb. 29, 1972 to Hamilton.

Dye Transfer Inhibiting Agents—The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%. See U.S. Pat. No. 5,633,255 to Fredj.

Chelating Agents—The detergent compositions herein may also optionally contain one or chelating agents, particularly chelating agents for adventitious transition metals. Those commonly found in wash water include iron and/or manganese in water-soluble, colloidal or particulate form, and may be associated as oxides or hydroxides, or found in association with soils such as humic substances. Preferred chelants are those which effectively control such transition metals, especially including controlling deposition of such transition-metals or their compounds on fabrics and/or controlling undesired redox reactions in the wash medium and/or at fabric or hard surface interfaces. Such chelating agents include those having low molecular weights as well as polymeric types, typically having at least one, preferably two or more donor heteroatoms such as O or N, capable of co-ordination to a transition-metal. Common chelating agents can be selected from the group consisting of aminocarboxylates, aminophosphonates, polyfunctionally-substituted aromatic chelating agents and mixtures thereof.

If utilized, chelating agents will generally comprise from about 0.001% to about 15% by weight of the detergent compositions herein. More preferably, if utilized, chelating agents will comprise from about 0.01% to about 3.0% by weight of such compositions.

Suds Suppressors—Compounds for reducing or suppressing the formation of suds can be incorporated into the compositions of the present invention when required by the intended use, especially washing of laundry in washing appliances. Other compositions, such as those designed for hand-washing, may desirably be high-sudsing and may omit such ingredients Suds suppression can be of particular importance in the so-called "high concentration cleaning process" as described in U.S. Pat. No. 4,489,455 and 4,489,574 and in front-loading European-style washing machines.

A wide variety of materials may be used as suds suppressors and are well known in the art. See, for example, Kirk Othmer Encyclopedia of Chemical Technology, Third Edition, Volume 7, pages 430–447 (Wiley, 1979).

The compositions herein will generally comprise from 0% to about 10% of suds suppressor. When utilized as suds suppressors, monocarboxylic fatty acids, and salts thereof, will be present typically in amounts up to about 5%, preferably 0.5%–3% by weight, of the detergent composition. although higher amounts may be used. Preferably from about 0.01% to about 1% of silicone suds suppressor is used, more preferably from about 0.25% to about 0.5%. These weight percentage values include any silica that may be utilized in combination with polyorganosiloxane, as well as any suds suppressor adjunct materials that may be utilized. Monostearyl phosphate suds suppressors are generally utilized in amounts ranging from about 0.1% to about 2%, by weight, of the composition. Hydrocarbon suds suppressors are typically utilized in amounts ranging from about 0.01% to about 5.0%, although higher levels can be used. The alcohol suds suppressors are typically used at 0.2%–3% by weight of the finished compositions.

Alkoxylated Polycarboxylates—Alkoxylated polycarboxylates such as those prepared from polyacrylates are useful herein to provide additional grease removal performance. Such materials are described in WO 91/08281 and PCT 90/01815 at p. 4 et seq., incorporated herein by reference. Chemically, these materials comprise polyacrylates having one ethoxy side-chain per every 7–8 acrylate units. The side-chains are of the formula $—(CH_2CH_2O)_m(CH_2)_nCH_3$ wherein m is 2–3 and n is 6–12. The side-chains are ester-linked to the polyacrylate "backbone" to provide a "com" polymer type structure. The molecular weight can vary, but is typically in the range of about 2000 to about 50,000. Such alkoxylated polycarboxylates can comprise from about 0.05% to about 10%, by weight, of the compositions herein.

Fabric Softeners—Various through-the-wash fabric softeners, especially the impalpable smectite clays of U.S. Pat. No. 4,062,647, Storm and Nirschl, issued Dec. 13, 1977, as well as other softener clays known in the art, can optionally be used typically at levels of from about 0.5% to about 10% by weight in the present compositions to provide fabric softener benefits concurrently with fabric cleaning. Clay softeners can be used in combination with amine and cationic softeners as disclosed, for example, in U.S. Pat. No. 4,375,416, Crisp et al, Mar. 1, 1983 and U.S. Pat. No. 4,291,071, Harris et al, issued Sep. 22, 1981. Moreover, in laundry cleaning methods herein, known fabric softeners, including biodegradable types, can be used in pretreat, mainwash, post-wash and dryer-added modes.

Perfumes—Perfumes and perfumery ingredients useful in the present compositions and processes comprise a wide variety of natural and synthetic chemical ingredients, including, but not limited to, aldehydes, ketones, esters, and the like. Also included are various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes typically comprise from about 0.01% to about 2%, by weight, of the detergent compositions herein, and individual perfumery ingredients can comprise from about 0.0001% to about 90% of a finished perfume composition.

Other Ingredients—A wide variety of other ingredients useful in detergent compositions can be included in the compositions herein, including other active ingredients, carriers, hydrotropes, processing aids, dyes or pigments, solvents for liquid formulations, solid fillers for bar compositions, etc. If high sudsing is desired, suds boosters such as the $C_{10}$–$C_{16}$ alkanolamides can be incorporated into the compositions, typically at 1%–10% levels.

The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, water-soluble magnesium and/or calcium salts such as $MgCl_2$, $MgSO_4$, $CaCl_2$, $CaSO_4$ and the like, can be added at levels of, typically, 0.1%–2%, to provide additional suds and to enhance grease removal performance, especially for liquid dishwashing purposes.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient. is released from the substrate into the aqueous washing liquor, where it performs its intended detersive function.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactant, but polyols such as those containing from 2 to about 6 carbon atoms and from 2 to about 6 hydroxy groups (e.g., 1,3-propanediol, ethylene glycol, glycerine, and 1,2-propanediol) can also be used. The compositions may contain from 5% to 90%, typically 10% to 50% of such carriers.

The detergent compositions herein will preferably be formulated such that, during use in aqueous cleaning operations, the wash water will have a pH of between about 6.5 and about 11, preferably between about 7.0 and 10.5, more preferably between about 7.0 to about 9.5. Liquid dishwashing product formulations preferably have a pH between about 6.8 and about 9.0. Laundry products are typically at pH 9–11. Techniques for controlling pH at recommended usage levels include the use of buffers, alkalis, acids, etc., and are well known to those skilled in the art.

Form of the Compositions

The compositions in accordance with the invention can take a variety of physical forms including granular, gel, tablet, bar and liquid forms. The compositions include the so-called concentrated granular detergent compositions adapted to be added to a washing machine by means of a dispensing device placed in the machine drum with the soiled fabric load.

The mean particle size of the components of granular compositions in accordance with the invention should preferably be such that no more that 5% of particles are greater than 1.7 mm in diameter and not more than 5% of particles are less than 0.15 mm in diameter.

The term mean particle size as defined herein is calculated by sieving a sample of the composition into a number of fractions (typically 5 fractions) on a series of Tyler sieves. The weight fractions thereby obtained are plotted against the aperture size of the sieves. The mean particle size is taken to be the aperture size through which 50% by weight of the sample would pass.

Certain preferred granular detergent compositions in accordance with the present invention are the high-density types, now common in the marketplace; these typically have a bulk density of at least 600 g/liter. more preferably from 650 g/liter to 1200 g/liter.

High Density Detergent Composition Processes

Various means and equipment are available to prepare high density (i.e., greater than about 550, preferably greater than about 650, grams/liter or "g/l"), high solubility, free-flowing, granular detergent compositions according to the present invention. Current commercial practice in the field employs spray-drying towers to manufacture granular laundry detergents which often have a density less than about 500 g/l. In this procedure, an aqueous slurry of various heat-stable ingredients in the final detergent composition are formed into homogeneous granules by passage through a spray-drying tower, using conventional techniques, at temperatures of about 175° C. to about 225° C. However, if spray drying is used as part of the overall process herein, additional or alternative process steps as described hereinafter must be used to obtain the level of density (i.e., >650 g/l) required by modern compact, low dosage detergent products.

For example, spray-dried granules from a tower can be densified further by loading a liquid such as water or a nonionic surfactant into the pores of the granules and/or subjecting them to one or more high speed mixer/densifiers. A suitable high speed mixer/densifier for this process is a device marketed under the tradename "Lödige CB 30" or "L ödige CB 30 Recycler" which comprises a static cylindrical mixing drum having a central rotating shaft with mixing/cutting blades mounted thereon. In use, the ingredients for the detergent composition are introduced into the drum and the shaft/blade assembly is rotated at speeds in the range of 100–2500 rpm to provide thorough mixing/densification. See Jacobs et al, U.S. Pat. No. 5,149,455, issued Sep. 22, 1992, and U.S. Pat. No. 5,565,422, issued Oct. 15, 1996 to Del Greco et al. Other such apparatus includes the devices marketed under the tradename "Shugi Granulator" and under the tradename "Drais K-TTP 80).

Another process step which can be used to densify further spray-dried granules involves treating the spray-dried granules in a moderate speed mixer/densifier. Equipment such as that marketed under the tradename "Lödige KM" (Series 300 or 600) or "Lödige Ploughshare" mixer/densifiers are suitable for this process step. Such equipment is typically operated at 40–160 rpm. The residence time of the detergent ingredients in the moderate speed mixer/densifier is from about 0.1 to 12 minutes conveniently measured by dividing the steady state mixer/densifier weight by the throughput (e.g., Kg/hr). Other useful equipment includes the device which is available under the tradename "Drais K-T 160". This process step which employs a moderate speed mixer/densifier (e.g. Lödige KM) can be used by itself or sequentially with the aforementioned high speed mixer/densifier (e.g. Lödige CB) to achieve the desired density. Other types of granules manufacturing apparatus useful herein include the apparatus disclosed in U.S. Pat. No. 2,306,898, to G. L. Heller, Dec. 29, 1942.

While it may be more suitable to use the high speed mixer/densifier followed by the low speed mixer/densifier, the reverse sequential mixer/densifier configuration also can be used. One or a combination of various parameters including residence times in the mixer/densifiers, operating temperatures of the equipment, temperature and/or composition of the granules, the use of adjunct ingredients such as liquid binders and flow aids, can be used to optimize densification of the spray-dried granules in the process of the invention. By way of example, see the processes in Appel et al, U.S. Pat. No. 5,133,924, issued Jul. 28, 1992; Delwel et al, U.S. Pat. No. 4,637,891, issued Jan. 20, 1987; Kruse et al, U.S. Pat. No. 4,726,908, issued Feb. 23, 1988; and, Bortolotti et al, U.S. Pat. No. 5,160,657, issued Nov. 3, 1992.

In those situations in which particularly heat sensitive or highly volatile detergent ingredients are to be incorporated into the final detergent composition, processes which do not include spray drying towers are preferred. The formulator can eliminate the spray-drying step by feeding, in either a continuous or batch mode, starting detergent ingredients directly into mixing equipment that is commercially available. One particularly preferred embodiment involves charging a surfactant paste and an anhydrous material into a high speed mixer/densifier (e.g. Lödige CB) followed by a moderate speed mixer/densifier (e.g. Lödige KM) to form high density detergent agglomerates. See Capeci et al, U.S. Pat. No. 5,366,652, issued Nov. 22, 1994 and Capeci et al, U.S. Pat. No. 5,486,303, issued Jan. 23, 1996. Optionally, the liquid/solids ratio of the starting detergent ingredients in such a process can be selected to obtain high density agglomerates that are more free flowing and crisp. See Capeci et al, U.S. Pat. No. 5,565,137, issued Oct. 15, 1996.

Optionally, the process may include one or more recycle streams of undersized particles produced by the process which are fed back to the mixer/densifiers for further agglomeration or build-up. The oversized particles produced by this process can be sent to grinding apparatus and then fed back to the mixing/densifying equipment. These additional recycle process steps facilitate build-up agglomeration of the starting detergent ingredients resulting in a finished composition having a uniform distribution of the desired particle size (400–700 microns) and density (>550 g/l). See Capeci et al, U.S. Pat. No. 5,516,448, issued May 14, 1996 and Capeci et al, U.S. Pat. No. 5,489,392, issued Feb. 6, 1996. Other suitable processes which do not call for the use of spray-drying towers are described by Bollier et al, U.S. Pat. No. 4,828,721, issued May 9, 1989; Beerse et al, U.S. Pat. No. 5,108,646, issued Apr. 28, 1992; and, Jolicoeur, U.S. Pat. No. 5,178,798, issued Jan. 12, 1993.

In yet another embodiment, a high density detergent composition using a fluidized bed mixer. In this process, the various ingredients of the finished composition are combined in an aqueous slurry (typically 80% solids content) and sprayed into a fluidized bed to provide the finished detergent granules. Prior to the fluidized bed, this process can optionally include the step of mixing the slurry using the aforementioned Lödige CB mixer/densifier or a "Flexomix 160" mixer/densifier, available from Shugi. Fluidized bed or moving beds of the type available under the tradename "Escher Wyss" can be used in such processes.

Another suitable process which can be used herein involves feeding a liquid acid precursor of an anionic surfactant, an alkaline inorganic material (e.g. sodium carbonate) and optionally other detergent ingredients into a high speed mixer/densifier so as to form particles containing a partially or totally neutralized anionic surfactant salt and the other starting detergent ingredients. Optionally, the contents in the high speed mixer/densifier can be sent to a moderate speed mixer/densifier (e.g. Lödige KM) for further mixing resulting in the finished high density detergent composition. See Appel et al, U.S. Pat. No. 5,164,108, issued Nov. 17, 1992.

Optionally, high density detergent compositions according to the invention can be produced by blending conventional or densified spray-dried detergent granules with detergent agglomerates in various proportions (e.g. a 60:40 weight ratio of granules to agglomerates) produced by one or a combination of the processes discussed herein. See U.S. Pat. No. 5,569,645, issued Oct. 29, 1996 to Dinniwell et al. Additional adjunct ingredients such as enzymes, perfumes, brighteners and the like can be sprayed or admixed with the agglomerates, granules or mixtures thereof produced by the processes discussed herein.

Laundry Washing Method

Machine laundry methods herein typically comprise treating soiled laundry. with an aqueous wash solution in a washing machine having dissolved or dispensed therein an effective amount of a machine laundry detergent composition in accord with the invention. By an effective amount of the detergent composition it is here meant from 40 g to 300 g of product dissolved or dispersed in a wash solution of volume from 5 to 65 liters, as are typical product dosages and wash solution volumes commonly employed in conventional machine laundry methods.

As noted, surfactants are used herein in detergent compositions, preferably in combination with other detersive surfactants, at levels which are effective for achieving at least a directional improvement in cleaning performance. In the context of a fabric laundry composition, such "usage levels" can vary widely, depending not only on the type and severity of the soils and stains, but also on the wash water temperature, the volume of wash water and the type of washing machine.

In a preferred use aspect a dispensing device is employed in the washing method. The dispensing device is charged with the detergent product, and is used to introduce the product directly into the drum of the washing machine before the commencement of the wash cycle. Its volume capacity should be such as to be able to contain sufficient detergent product as would normally be used in the washing method.

Once the washing machine has been loaded with laundry the dispensing device containing the detergent product is placed inside the drum. At the commencement of the wash cycle of the washing machine water is introduced into the drum and the drum periodically rotates. The design of the dispensing device should be such that it permits containment of the dry detergent product but then allows release of this product during the wash cycle in response to its agitation as the drum rotates and also as a result of its contact with the wash water.

Alternatively, the dispensing device may be a flexible container, such as a bag or pouch. The bag may be of fibrous construction coated with a water impermeable protective material so as to retain the contents, such as is disclosed in European published Patent Application No. 0018678. Alternatively it may be formed of a water-insoluble synthetic polymeric material provided with an edge seal or closure designed to rupture in aqueous media as disclosed in European published Patent Application Nos. 0011500, 0011501, 0011502, and 0011968. A convenient form of water frangible closure comprises a water soluble adhesive disposed along and sealing one edge of a pouch formed of a water impermeable polymeric film such as polyethylene or polypropylene.

EXAMPLES

Cleaning Product Compositions

In these Examples, the following abbreviation is used for a modified alkylbenzene sulfonate, sodium salt form or potassium salt form, prepared according to any of the preceding process examples: MLAS The following abbreviations are used for cleaning product adjunct materials:

| | |
|---|---|
| Cxy Amine Oxide | Alkyldimethylamine N-Oxide RN(O)Me2 of given chainlength Cxy where average total carbon range of the non-methyl alkyl moiety R is from 10 + x to 10 + y |
| Amylase | Amylolytic enzyme of activity 60KNU/g sold by NOVO Industries A/S under the tradename Termamyl 60T. Alternatively, the amylase is selected from: Fungamyl ®; Duramyl ®; BAN ®; and α amylase enzymes described in WO95/26397 and in co-pending application by Novo Nordisk PCT/DK96/00056. |
| APA | C8–C10 amido propyl dimethyl amine |
| Cxy Betaine | Alkyldimethyl Betaine having an average total carbon range of alkyl moiety from 10 + x to 10 + y |
| Bicarbonate | Anhydrous sodium bicarbonate with a particle size distribution between 400 μm and 1200 μm |
| Borax | Na tetraborate decahydrate |
| BPP | Butoxy - propoxy - propanol |
| Brightener 1 | Disodium 4,4'-bis(2-sulphostyryl)biphenyl |
| Brightener 2 | Disodium 4,4'-bis(4-anilino-6-morpholino-1.3.5-triazin-2-yl)amino)stilbene-2.2'-disulfonate |
| $CaCl_2$ | Calcium chloride |
| Carbonate | $Na_2CO_3$ anhydrous, 200 μm–900 μm |
| Cellulase | Cellulolytic enzyme, 1000 CEVU/g, NOVO, Carezyme ® |
| Citrate | Trisodium citrate dihydrate, 86.4%, 425 μm–850 μm |
| Citric Acid | Citric Acid, Anhydrous |
| CMC | Sodium carboxymethyl cellulose |
| CxyAS | Alkyl sulfate, Na salt or other salt if specified having an average total carbon range of alkyl moiety from 10 + x to 10 + y |
| CxyEz | Commercial linear or branched alcohol ethoxylate (not having mid-chain methyl branching) and having an average total carbon range of alkyl moiety from 10 + x to 10 + y average z moles of ethylene oxide |
| CxyEzS | Alkyl ethoxylate sulfate, Na salt (or other salt if specified) having an average total carbon range of alkyl moiety from 10 + x to 10 + y and an average of z moles of ethylene oxide |
| Diamine | Alkyl diamine, e.g., 1,3 propanediamine, Dytek EP, Dytek A, (Dupont) or selected from: dimethyl aminopropyl amine; 1,6-hexane diamine; 1,3 propane diamine; 2-methyl 1,5 pentane diamine; 1,3-pentanediamine; 1-methyl-diaminopropane; 1,3 cyclohexane diamine; 1,2 cyclohexane diamine |
| Dimethicone | 40 (gum)/60 (fluid) wt. Blend of SE-76 dimethicone gum (G.E Silicones Div.)/ dimethicone fluid of viscosity 350 cS. |
| DTPA | Diethylene triamine pentaacetic acid |
| DTPMP | Diethylene triamine penta(methylene phosphonate), Monsanto (Dequest 2060) |
| Endolase | Endoglucanase, activity 3000 CEVU/g, NOVO |
| EtOH | Ethanol |
| Fatty Acid (C12/18) | Cl2–C18 fatty acid |
| Fatty Acid (C12/14) | Cl2–C14 fatty acid |
| Fatty Acid (C14/18) | Cl4–C18 fatty acid |
| Fatty Acid (RPS) | Rapeseed fatty acid |
| Fatty Acid (TPK) | Topped palm kernel fatty acid |
| Formate | Formate (Sodium) |
| HEDP | 1,1-hydroxyethane diphosphonic acid |
| Hydrotrope | selected from sodium, potassium, Magnesium, Calcium, ammonium or water-soluble substituted ammonium salts of toluene sulfonic acid, naphthalene sulfonic acid, cumene sulfonic acid, xylene sulfonic acid. |
| Isofol 12 | X12 (average) Guerbet alcohols (Condea) |
| Isofol 16 | C16 (average) Guerbet alcohols (Condea) |
| LAS | Linear Alkylbenzene Sulfonate (e.g., C11.8, Na or K salt) |
| Lipase | Lipolytic enzyme, 100kLU/g. NOVO, Lipolase ®, Alternatively, the lipase is selected from: Amano-P; M1 Lipase ®; Lipomax ®; D96L - |

-continued

| | |
|---|---|
| | lipolytic enzyme variant of the native lipase derived from *Humicola lanuginosa* as described in U.S. Ser. No. 08/341,826; and the *Humicola lanuginosa* strain DSM 4106. |
| LMFAA | C12–14 alkyl N-methyl glucamide |
| MA/AA | Copolymer 1:4 maleic/acrylic acid, Na salt, avg. mw. 70,000. |
| MBAxEy | Mid-chain branched primary alkyl ethoxylate (average total carbons = x; average EO = y) |
| MBAxEyS | Mid-chain branched or modified primary alkyl ethoxylate sulfate, Na salt (average total carbons = x; average EO = y) according to the invention (see Example 9) |
| MBAyS | Mid-chain branched primary alkyl sulfate, Na salt (average total carbons = y) |
| MEA | Monoethanolamine |
| Cxy MES | Alkyl methyl ester sulfonate, Na salt having an average total carbon range of alkyl moiety from 10 + x to 10 + y |
| $MgCl_2$ | Magnesium chloride |
| MnCAT | Macrocyclic Manganese Bleach Catalyst as in EP 544,440 A or, preferably, use [Mn(Bcyclam)$Cl_2$] wherein Bcyclam = 5,12-dimethyl-1,5,8,12-tetraaza-bicyclo[6.6.2] hexadecane or a comparable bridged tetra-aza macrocycle |
| NaDCC | Sodium dichloroisocyanurate |
| NaOH | Sodium hydroxide |
| Cxy NaPS | Paraffin sulfonate, Na salt having an average total carbon range of alkyl moiety from 10 + x to 10 + y |
| NaSKS-6 | Crystalline layered silicate of formula δ-$Na_2Si_2O_5$ |
| NaTS | Sodium toluene sulfonate |
| NOBS | Nonanoyloxybenzene sulfonate, sodium salt |
| LOBS | C12 oxybenzenesulfonate sodium salt |
| PAA | Polyacrylic Acid (mw = 4500) |
| PAE | Ethoxylated tetraethylene pentamine |
| PAEC | Methyl quaternized ethoxylated dihexylene triamine |
| PB1 | Anhydrous sodium perborate bleach of nominal formula $NaBO_2.H_2O_2$ |
| PEG | Polyethylene glycol (mw = 4600) |
| Percarbonate | Sodium Percarbonate of nominal formula $2Na_2CO_3.3H_2O_2$ |
| PG | Propanediol |
| Photobleach | Sulfonated Zinc Phthalocyanine encapsulated in dextrin soluble polymer |
| PIE | Ethoxylated polyethyleneimine, water-soluble |
| Protease | Proteolytic enzyme, 4KNPU/g, NOVO, Savinase ®. Alternatively, the protease is selected from: Maxatase ®; Maxacal ®; Maxapem 15 ®; subtilisin BPN and BPN'; Protease B; Protease A; Protease D; Primase ®; Durazym ®; Opticlean ®; and Optimase ®; and Alcalase ®. |
| QAS | $R_2.N^+(CH_3)_x((C_2H_4O)yH)z$ with $R_2 = C_8$–$C_{18}$ x + z = 3, x = 0 to 3, z = 0 to 3, y = 1 to 15. |
| Cxy SAS | Secondary alkyl sulfate, Na salt having an average total carbon range of alkyl moiety from 10 + x to 10 + y |
| Silicate | Sodium Silicate, amorphous ($SiO_2$:$Na_2O$; 2.0 ratio) |
| Silicone antifoam | Polydimethylsiloxane foam controller + siloxane-oxyalkylene copolymer as dispersing agent; ratio of foam controller:dispersing agent = 10:1 to 100:1; or, combination of fumed silica and high viscosity polydimethylsiloxane (optionally chemically modified) |
| Solvent | nonaqueous solvent e.g., hexylene glycol, see also propylene glycol |
| SRP 1 | Sulfobenzoyl end capped esters with oxyethylene oxy and terephthaloyl backbone |
| SRP 2 | Sulfonated ethoxylated terephthalate polymer |
| SRP 3 | Methyl capped ethoxylated terephthalate polymer |
| STPP | Sodium tripolyphosphate, anhydrous |
| Sulfate | Sodium sulfate, anhydrous |
| TAED | Tetraacetylethylenediamine |
| TFA | C16–18 alkyl N-methyl glucamide |

-continued

| | |
|---|---|
| Zeolite A | Hydrated Sodium Aluminosilicate, $Na_{12}(A10_2SiO_2)_{12}.27H_2O$; 0.1–10 μm |
| Zeolite MAP | Zeolite (Maximum aluminum P) detergent grade (Crosfield) |

Typical ingredients often referred to as "minors" can include perfumes, dyes, pH trims etc.

The following example is illustrative of the present invention, but is not meant to limit or otherwise define its scope. All parts, percentages and ratios used are expressed as percent weight unless otherwise noted.

Example 18

The following laundry detergent compositions A to F are prepared in accordance with the invention:

| | A | B | C | D | E | F |
|---|---|---|---|---|---|---|
| MLAS | 22 | 16.5 | 11 | 1–5.5 | 10–25 | 5–35 |
| Any Combination of: C45AS C45E1S or C23E3S LAS C26 SAS C47 NaPS C48 MES MBA 16.5S MBA 15.5E2S | 0 | 1–5.5 | 11 | 16.5 | 0–5 | 0–10 |
| QAS | 0–2 | 0–2 | 0–2 | 0–2 | 0–4 | 0 |
| C23E6.5 or C45E7 | 1.5 | 1.5 | 1.5 | 1.5 | 0–4 | 0–4 |
| Zeolite A | 27.8 | 0 | 27.8 | 27.8 | 20–30 | 0 |
| Zeolite MAP | 0 | 27.8 | 0 | 0 | 0 | 0 |
| STPP | 0 | 0 | 0 | 0 | 0 | 5–65 |
| PAA | 2.3 | 2.3 | 2.3 | 2.3 | 0–5 | 0–5 |
| Carbonate | 27.3 | 27.3 | 27.3 | 27.3 | 20–30 | 0–30 |
| Silicate | 0.6 | 0.6 | 0.6 | 0.6 | 0–2 | 0–6 |
| PB1 | 1.0 | 1.0 | 0–10 | 0–10 | 0–10 | 0–20 |
| NOBS | 0–1 | 0–1 | 0–1 | 0.1 | 0.5–3 | 0–5 |
| LOBS | 0 | 0 | 0–3 | 0 | 0 | 0 |
| TAED | 0 | 0 | 0 | 2 | 0 | 0–5 |
| MnCAT | 0 | 0 | 0 | 0 | 2 ppm | 0–1 |
| Protease | 0–0.5 | 0–0.5 | 0–0.5 | 0–0.5 | 0–0.5 | 0–1 |
| Cellulase | 0–0.3 | 0–0.3 | 0–0.3 | 0–0.3 | 0–0.5 | 0–1 |
| Amylase | 0–0.5 | 0–0.5 | 0–0.5 | 0–0.5 | 0–1 | 0–1 |
| SRP 1 or SRP 2 | 0.4 | 0.4 | 0.4 | 0.4 | 0–1 | 0–5 |
| Brightener 1 or 2 | 0.2 | 0.2 | 0.2 | 0.2 | 0–0.3 | 0–5 |
| PEG | 1.6 | 1.6 | 1.6 | 1.6 | 0–2 | 0–3 |
| Silicone Antifoam | 0.42 | 0.42 | 0.42 | 0.42 | 0–0.5 | 0–1 |
| Sulfate, Water, Minors | to 100% | to 100% | to 100% | to 100% | to 100% | to 100% |
| Density (g/L) | 400–700 | 600–700 | 600–700 | 600–700 | 600–700 | 450–750 |

Example 19

The following laundry detergent compositions G to J suitable for hand-washing soiled fabrics are prepared in accord with the invention:

| | G | H | I | J |
|---|---|---|---|---|
| MLAS | 18 | 22 | 18 | 22 |
| STPP | 20 | 40 | 22 | 28 |
| Carbonate | 15 | 8 | 20 | 15 |
| Silicates | 15 | 10 | 15 | 10 |
| Protease | 0 | 0 | 0.3 | 0.3 |
| Perborate | 0 | 0 | 0 | 10 |
| Sodium Chloride | 25 | 15 | 20 | 10 |
| Brightener | 0–0.3 | 0.2 | 0.2 | 0.2 |
| Moisture & Minors | - - - Balance - - - | | | |

Example 20

Cleaning Product Compositions

The following liquid laundry detergent compositions K to O are prepared in accord with the invention. Abbreviations are as used in the preceding Examples.

| | K | L | M | N | O |
|---|---|---|---|---|---|
| MLAS | 1–7 | 7–12 | 12–17 | 17–22 | 1–35 |
| Any combination of: C25E1.8-2.5S MBA15.5E1.8S MBA15.5S C25AS (linear to high 2-alkyl) C47 NaPS C26 SAS LAS C26 MES | 15–21 | 10–15 | 5–10 | 0–5 | 0–25 |
| LMFAA | 0–3.5 | 0–3.5 | 0–3.5 | 0–3.5 | 0–8 |
| C23E9 or C23E6.5 | 0–2 | 0–2 | 0–2 | 0–2 | 0–8 |
| APA | 0–0.5 | 0–0.5 | 0–0.5 | 0–0.5 | 0–2 |
| Citric Acid | 5 | 5 | 5 | 5 | 0–8 |
| Fatty Acid (TPK or C12/14) | 2 | 2 | 2 | 2 | 0–14 |
| EtOH | 4 | 4 | 4 | 4 | 0–8 |
| PG | 6 | 6 | 6 | 6 | 0–10 |
| MEA | 1 | 1 | 1 | 1 | 0–3 |
| NaOH | 3 | 3 | 3 | 3 | 0–7 |
| Hydrotrope or NaTS | 2.3 | 2.3 | 2.3 | 2.3 | 0–4 |
| Formate | 0.1 | 0.1 | 0.1 | 0.1 | 0–1 |
| Borax | 2.5 | 2.5 | 2.5 | 2.5 | 0–5 |
| Protease | 0.9 | 0.9 | 0.9 | 0.9 | 0–1.3 |
| Lipase | 0.06 | 0.06 | 0.06 | 0.06 | 0–0.3 |
| Amylase | 0.15 | 0.15 | 0.15 | 0.15 | 0–0.4 |
| Cellulase | 0.05 | 0.05 | 0.05 | 0.05 | 0–0.2 |
| PAE | 0–0.6 | 0–0.6 | 0–0.6 | 0–0.6 | 0–2.5 |
| PIE | 1.2 | 1.2 | 1.2 | 1.2 | 0–2.5 |
| PAEC | 0–0.4 | 0–0.4 | 0–0.4 | 0–0.4 | 0–2 |
| SRP 2 | 0.2 | 0.2 | 0.2 | 0.2 | 0–0.5 |
| Brightener 1 or 2 | 0.15 | 0.15 | 0.15 | 0.15 | 0–0.5 |
| Silicone antifoam | 0.12 | 0.12 | 0.12 | 0.12 | 0–0.3 |
| Fumed Silica | 0.0015 | 0.0015 | 0.0015 | 0.0015 | 0–0.003 |
| Perfume | 0.3 | 0.3 | 0.3 | 0.3 | 0–0.6 |
| Dye | 0.0013 | 0.0013 | 0.0013 | 0.0013 | 0–0.003 |
| Moisture/minors | Balance | Balance | Balance | Balance | Balance |
| Product pH (10% in DI water) | 7.7 | 7.7 | 7.7 | 7.7 | 6–9.5 |

Example 21

Non-limiting examples P–Q of a bleach-containing non-aqueous liquid laundry detergent composition are prepared as follows:

| Component | P Wt. % | Q Range (% wt.) |
|---|---|---|
| Liquid Phase | | |
| MLAS | 15 | 1–35 |
| LAS | 12 | 0–35 |
| C24E5 | 14 | 10–20 |
| Solvent or Hexylene glycol | 27 | 20–30 |
| Perfume | 0.4 | 0–1 |
| Solid Phase | | |
| Protease | 0.4 | 0–1 |
| Citrate | 4 | 3–6 |
| PB1 | 3.5 | 2–7 |
| NOBS | 8 | 2–12 |
| Carbonate | 14 | 5–20 |
| DTPA | 1 | 0–1.5 |
| Brightener 1 | 0.4 | 0–0.6 |
| Silicon antifoam | 0.1 | 0–0.3 |
| Minors | Balance | Balance |

The resulting anhydrous heavy duty liquid laundry detergent provides excellent stain and soil removal performance when used in normal fabric laundering operations.

Example 22

The following examples R–V further illustrate the invention herein with respect to shampoo formulations.

| Component | R | S | T | U | V |
|---|---|---|---|---|---|
| Ammonium C24E2S | 5 | 3 | 2 | 10 | 8 |
| Ammonium C24AS | 5 | 5 | 4 | 5 | 8 |
| MLAS | 0.6 | 1 | 4 | 5 | 7 |
| Cocamide MEA | 0 | 0.68 | 0.68 | 0.8 | 0 |
| PEG 14,000 mol. wt. | 0.1 | 0.35 | 0.5 | 0.1 | 0 |
| Cocoamidopropylbetaine | 2.5 | 2.5 | 0 | 0 | 1.5 |
| Cetyl alcohol | 0.42 | 0.42 | 0.42 | 0.5 | 0.5 |
| Stearyl alcohol | 0.18 | 0.18 | 0.18 | 0.2 | 0.18 |
| Ethylene glycol distearate | 1.5 | 1.5 | 1.5 | 1.5 | 1.5 |
| Dimethicone | 1.75 | 1.75 | 1.75 | 1.75 | 2.0 |
| Perfume | 0.45 | 0.45 | 0.45 | 0.45 | 0.45 |
| Water and minors | balance | balance | balance | balance | balance |

Example 23

Linear and Branched Alkylbenzene Mixture with a 2/3-Phenyl Index of about 200 and a 2-Methyl-2-Phenyl Index of about 0.02 (Alkylbenzene Mixture According to the Invention)

110.25 g of the substantially mono methyl branched olefin mixture of example 2, 36.75 g of a nonbranched olefin mixture (decene:undecene:dodecene:tridecene ratio of 2:9:20:18) and 36 g of a shape selective zeolite catalyst (acidic beta zeolite catalyst; Zeocat™ PB/H) are added to a 2 gallon stainless steel, stirred autoclave. Residual olefin and catalyst in the container are washed into the autoclave with 300 ml of n-hexane and the autoclave is sealed. From outside the autoclave cell, 2000 g of benzene (contained in a isolated vessel and added by way of an isolated pumping system inside the isolated autoclave cell) is added to the autoclave. The autoclave is purged twice with 250 psig $N_2$, and then charged to 60 psig $N_2$. The mixture is stirred and heated to about 200° C. for about 4–5 hours. The autoclave is cooled to about 20° C. overnight. The valve is opened leading from the autoclave to the benzene condenser and collection tank. The autoclave is heated to about 120° C. with continuous collection of benzene. No more benzene is collected by the time the reactor reaches 120° C. The reactor is then cooled to 40° C. and 750 g of n-hexane is pumped into the autoclave with mixing. The autoclave is then drained to remove the reaction mixture. The reaction mixture is filtered to remove catalyst and the n-hexane is removed under vacuum. The product is distilled under vacuum (1–5 mm of Hg). A modified alkylbenzene mixture with a 2/3-Phenyl index of about 200 and a 2-methyl-2-phenyl index of about 0.02 is collected from 76° C.–130° C. (167 g).

Example 24

Modified Alkylbenzenesulfonic Acid Mixture according to the Invention (Branched and Nonbranched Alkylbenzenesulfonic Acid Mixture) with a 2/3-Phenyl Index of about 200 and a 2-Methyl-2-Phenyl Index of about 0.02

The modified alkylbenzene mixture of example 23 is sulfonated with a molar equivalent of chlorosulfonic acid using methylene chloride as solvent. The methylene chloride is removed to give 210 g of a modified alkylbenzenesulfonic acid mixture with a 2/3-Phenyl index of about 200 and a 2-methyl-2-phenyl index of about 0.02.

Example 25

Modified Alkylbenzenesulfonate, Sodium Salt Mixture According to the Invention (Branched and Nonbranched Alkylbenzenesulfonate, Sodium Salt Mixture) with a 2/3-Phenyl Index of about 200 and a 2-Methyl-2-Phenyl Index of about 0.02

The modified alkylbenzenesulfonic acid of example 24 is neutralized with a molar equivalent of sodium methoxide in methanol and the methanol is evaporated to give 225 g of a modified alkylbenzenesulfonate, sodium salt mixture with a 2/3-Phenyl index of about 200 and a 2-methyl-2-phenyl index of about 0.02.

Example 26

Detergent compositions as in Examples 17–22 are repeated, substituting MLAS with the product of Example 25.

What is claimed is:

1. A modified alkylbenzene sulfonate surfactant mixture comprising:

(a) from 15% to 99% by weight of a mixture of branched alkylbenzene sulfonates having formula (I):

(I)

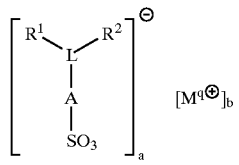

wherein L is an acyclic aliphatic moiety consisting of carbon and hydrogen, said L having two methyl termini and said L having no substituents other than A, $R^1$ and $R^2$; and wherein said mixture of branched alkylbenzene sulfonates contains two or more of said branched alkylbenzene sulfonates differing in molecular weight of the anion of said formula (I) and wherein said mixture of branched alkylbenzene sulfonates has a sum of carbon atoms in $R^1$, L and $R^2$ of from 9 to 15 and an average aliphatic carbon content of from 10.0 to 14.0 carbon atoms; M is a cation or cation mixture having a valence q; a and b are integers selected such that said branched alkylbenzene sulfonates are electroneutral; $R^1$ is $C_1$–$C_3$ alkyl; $R^2$ is selected from H and $C_1$–$C_3$ alkyl; A is a benzene moiety; and (b) from 1% to 85% by weight of a mixture of nonbranched alkylbenzene sulfonates having formula (II):

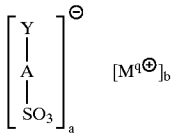

(II)

wherein a, b, M, A and q are as defined hereinbefore and Y is an unsubstituted linear aliphatic moiety consisting of carbon and hydrogen having two methyl termini, and wherein said Y has a sum of carbon atoms of from 9 to 15, and said Y has an average aliphatic carbon content of from 10.0 to 14.0 carbon atoms; and wherein said modified alkylbenzene sulfonate surfactant mixture is further characterized by a 2/3-phenyl index of from 160 to 275.

2. A modified alkylbenzene sulfonate surfactant mixture according to claim 1 wherein M is selected from H, Na, K and mixtures thereof, a=1; b=1; q=1; and said modified alkylbenzene sulfonate surfactant mixture has a 2-methyl-2-phenyl index of less than 0.3.

3. A modified alkylbenzene sulfonate surfactant mixture according to any one of claims 1 to 2 wherein said 2-methyl-2-phenyl index is from 0 to 0.1.

4. A modified alkylbenzene sulfonate surfactant mixture according to any one of claims 1 to 3 which is the product of a process using as catalyst a zeolite beta.

5. A modified alkylbenzene sulfonate surfactant mixture according to any one of claims 1 to 4 wherein said catalyst is in at least partially acidic form.

6. A detergent composition comprising:

(a) from 0.1% to 95%, by weight of modified alkylbenzene sulfonate surfactant mixture according to any one of claims 1 to 5;

(b) from 0.00001% to 99.9%, by weight of conventional cleaning adjuncts other than surfactants; and (c) from 0% to 50%, by weight, of a surfactant other than said modified alkylbenzene sulfonate surfactant mixture;

provided that when said detergent composition comprises any other alkylbenzene sulfonate than the alkylbenzene sulfonate of said modified alkylbenzene sulfonate surfactant mixture, said modified alkylbenzene sulfonate surfactant mixture and said other alkylbenzene sulfonate, as a mixture, have an overall 2/3-phenyl index of from 160 to 275.

7. A method for treating a fabric comprising contacting said fabric with the detergent composition of claim 6.

8. A modified alkylbenzene sulfonate surfactant mixture according to claim 2 consisting essentially of said mixture of branched alkylbenzene sulfonates and nonbranched alkylbenzene sulfonates, wherein said 2-methyl-2-phenyl index of said modified alkylbenzene sulfonate surfactant mixture is less than about 0.05, and wherein in said mixture of branched and nonbranched alkylbenzene sulfonates, said average aliphatic carbon content is from about 11.5 to about 12.5 carbon atoms; said $R^1$ is methyl; said $R^2$ is selected from H and methyl provided that in at least about 0.7 mole fraction of said branched alkylbenzene sulfonates $R^2$ is H; and wherein said sum of carbon atoms in $R^1$, L and $R^2$ is from 10 to 14; and further wherein in said mixture of nonbranched alkylbenzene sulfonates, said Y has a sum of carbon atoms of from 10 to 14 carbon atoms, said average aliphatic carbon content of said nonbranched alkylbenzene sulfonates is from about 11.5 to about 12.5 carbon atoms, and said M is a monovalent cation or cation mixture selected from H, Na and mixtures thereof.

9. A modified alkylbenzene sulfonate surfactant mixture comprising the product of a process comprising the steps of:

(I) alkylating benzene with an alkylating mixture in the presence of a zeolite beta catalyst;

(II) sulfonating the product of (I); and (III) neutralizing the product of (II);

wherein said alkylating mixture comprises:

(a) from about 1% to about 99.9%, by weight of branched $C_9$–$C_{20}$ monoolefins, said branched monoolefins having structures identical with those of the branched monoolefins formed by dehydrogenating branched paraffins of formula $R^1LR^2$ wherein L is an acyclic aliphatic moiety consisting of carbon and hydrogen and containing two terminal methyls; $R^1$ is $C_1$ to $C_3$ alkyl; and $R^2$ is selected from H and $C_1$ to $C_3$ alkyl; and (b) from about 0.1% to about 85%, by weight of $C_9$–$C_{20}$ linear aliphatic olefins;

wherein said alkylating mixture contains said branched $C_9$–$C_{20}$ monoolefins having at least two different carbon numbers in said $C_9$–$C_{20}$ range, and has a mean carbon content of from about 9.0 to about 15.0 carbon atoms; and wherein said components (a) and (b) are at a weight ratio of at least about 15:85.

10. A modified alkylbenzene sulfonate surfactant mixture according to claim 9 wherein said alkylating mixture consists essentially of:

(a) from about 1.0% to about 47.5%, by weight of said branched alkylating agent selected from:

(i) $C_9$–$C_{14}$ internal monoolefins $R^1LR^2$ wherein L is an acyclic olefinic moiety consisting of carbon and hydrogen and containing two terminal methyls;

(ii) $C_9$–$C_{14}$ alpha monoolefins $R^1AR^2$ wherein A is an acyclic alpha-olefinic moiety consisting of carbon and hydrogen and containing one terminal methyl and one terminal olefinic methylene; and (iii) mixtures thereof;

wherein in any of (i)–(iii), said $R^1$ is methyl, and said $R^2$ is H or methyl provided that in at least about 0.7 mole fraction of the total of said monoolefins, $R^2$ is H; and (b) from about 0.1% to about 25%, by weight of $C_9$–$C_{14}$ linear aliphatic olefins; and (c) from about 50% to about 98.9%, by weight of carrier materials selected from paraffins and inert nonparaffinic solvents;

wherein said alkylating mixture contains said branched alkylating agents having at least two different carbon numbers in said $C_9$–$C_{14}$ range, and has a mean carbon content of from about 11.5 to about 12.5 carbon atoms; and wherein said components (a) and (b) are at a weight ratio of from about 20:80 to about 49:51.

11. A modified alkylbenzene sulfonate surfactant mixture according to claim 9 wherein said step (III) is performed using a basic salt, said basic salt having a cation selected from the group consisting of alkali metal, alkaline earth metal, ammonium, substituted ammonium, and mixtures thereof and an anion selected from hydroxide, oxide, carbonate, silicate, phosphate, and mixtures thereof.

12. A modified alkylbenzene sulfonate surfactant mixture according to claim 9 wherein step (II) is performed using a sulfonating agent selected from the group consisting of sulfur trioxide, sulfur trioxide/air mixtures, and sulfuric acid.

13. A detergent composition comprising:

(a) from about 0.1% to about 95%, by weight of modified alkylbenzene sulfonate surfactant mixture according to claim 9; and (b) from about 0.00001% to about 99.9%, by weight of a conventional cleaning adjunct.

14. A detergent composition according to claim 6 wherein said detergent composition is in the form of a liquid, powder, agglomerates, paste, tablet, bar, gel, or granule.

15. A method for treating a fabric comprising contacting said fabric with a detergent composition according to claim 13.

16. A detergent composition comprising:

(a) from about 0.1% to about 50%, by weight of a linear alkylbenzene sulfonate surfactant mixture having a 2/3-phenyl index of from about 160 to about 275;

(b) from about 0.1% to about 99.9% by weight of conventional cleaning adjuncts other than surfactants; and (c) from 0% to about 50%, by weight, of a surfactant other than said linear alkylbenzene sulfonate surfactant mixture;

provided that when said detergent composition comprises any other alkylbenzene sulfonate than the alkylbenzene sulfonate of said linear alkylbenzene sulfonate surfactant mixture, said linear alkylbenzene sulfonate surfactant mixture and said other alkylbenzene sulfonate, as a mixture, have an overall 2/3-phenyl index of from about 160 to about 275.

17. A detergent composition comprising:

(a) from about 1% to about 50%, modified alkylbenzene sulfonate surfactant mixture according to claim 1, wherein said modified alkylbenzene sulfonate surfactant mixture has a 2-methyl-2-phenyl index of less than 0.3;

(b) from about 0.000001% to about 10%, by weight of a member selected from the group consisting of optical brighteners, dyes, photobleaches, hydrophobic bleach activators and transition metal bleach catalysts;

(c) from 0.1% to about 40% by weight of surfactants selected from the group consisting of cationic surfactants, nonionic surfactants, anionic surfactants, and amine oxide surfactants; and (d) from about 10% to about 99%, by weight of conventional cleaning adjuncts;

provided that when said detergent composition comprises any alkylbenzene sulfonate surfactant other than said linear alkylbenzene sulfonate surfactant mixture, said detergent composition is further characterized by an overall 2/3-phenyl index of at least about 160, wherein said overall 2/3-phenyl index is determined by measuring 2/3-phenyl index, as defined herein, on a blend of said linear alkylbenzene sulfonate surfactant mixture and said any other alkylbenzene sulfonate to be added to said detergent composition, said blend, for purposes of measurement, being prepared from aliquots of said linear alkylbenzene sulfonate surfactant mixture and said other alkylbenzene sulfonate not yet exposed to any other of said components of the detergent composition; and further provided that when said detergent composition comprises any alkylbenzene sulfonate surfactant other than said linear alkylbenzene sulfonate surfactant mixture said detergent composition is further characterized by an overall 2-methyl-2-phenyl index of less than about 0.3, wherein said overall 2-methyl-2-phenyl index is to be determined by measuring 2-methyl-2-phenyl index, as defined herein, on a blend of said linear alkylbenzene sulfonate surfactant mixture and any other alkylbenzene sulfonate to be added to said detergent composition, said blend, for purposes of measurement, being prepared from aliquots of said linear alkylbenzene sulfonate surfactant mixture and said other alkylbenzene sulfonate not yet exposed to any other of said components of the detergent composition.

18. A detergent composition according to claim 17 that is substantially free from alkylbenzene sulfonate surfactants other than said linear alkylbenzene sulfonate surfactant mixture.

19. A detergent composition according to claim 17 which comprises, in said component (c), a nonionic surfactant at a level of from about 0.5% to about 25% by weight of said detergent composition, and wherein said nonionic surfactant is a polyalkoxylated alcohol in capped or non-capped form having: a hydrophobic group selected from linear $C_{10}$–$C_{16}$ alkyl, mid-chain $C_1$–$C_3$ branched $C_{10}$–$C_{16}$ alkyl, guerbet branched $C_{10}$–$C_{16}$ alkyl, and mixtures thereof; and a hydrophilic group selected from 1–15 ethoxylates, 1–15 propoxylates 1–15 butoxylates and mixtures thereof, in capped or uncapped form.

20. A detergent composition comprising a modified alkylbenzene sulfonate surfactant mixture wherein said modified alkylbenzene sulfonate surfactant mixture is prepared by a process comprising a step selected from:

(i) blending a mixture of branched and linear alkylbenzene sulfonate surfactants having a 2/3-phenyl index of 500 to 700 with an alkylbenzene sulfonate surfactant mixture having a 2/3-phenyl index of 75 to 160; and, (ii) blending a mixture of branched and linear alkylbenzenes having a 2/3-phenyl index of 500 to 700 with an alkylbenzene mixture having a 2/3-phenyl index of 75 to 160 and sulfonating said blend.

* * * * *

UNITED STATES PATENT AND TRADEMARK OFFICE

CERTIFICATE OF CORRECTION

PATENT NO. : 6,583,096 B1
DATED : June 24, 2003
INVENTOR(S) : Kevin Lee Kott et al.

It is certified that error appears in the above-identified patent and that said Letters Patent is hereby corrected as shown below:

Column 71,
Line 37, "any of the claims 1 to 2" should read -- claim 1 --.
Line 40, "any of the claims 1 to 3" should read -- claim 1 --.
Line 43, "any of the claims 1 to 4" should read -- claim 1 --.
Lines 47-48, "any of the claims 1 to 5" should read -- claim 1 --.

Signed and Sealed this

Eighteenth Day of November, 2003

JAMES E. ROGAN
*Director of the United States Patent and Trademark Office*